US008237343B2

(12) United States Patent
Hotta et al.

(10) Patent No.: US 8,237,343 B2
(45) Date of Patent: Aug. 7, 2012

(54) SPARK PLUG HAVING A METAL FITTING PORTION FOR HOLDING AN INSULATOR AT A PORTION OPPOSITE A TIP END

(75) Inventors: Nobuyuki Hotta, Aichi (JP); Eiji Kodera, Aichi (JP); Kazushige Ohbayashi, Aichi (JP); Noriyasu Sugimoto, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 402 days.

(21) Appl. No.: 12/064,423

(22) PCT Filed: Aug. 22, 2006

(86) PCT No.: PCT/JP2006/316374

§ 371 (c)(1),
(2), (4) Date: Feb. 21, 2008

(87) PCT Pub. No.: WO2007/023790

PCT Pub. Date: Mar. 1, 2007

(65) Prior Publication Data

US 2009/0102345 A1 Apr. 23, 2009

(30) Foreign Application Priority Data

| | | |
|---|---|---|
| Aug. 22, 2005 | (JP) | 2005-239884 |
| Aug. 22, 2005 | (JP) | 2005-239885 |
| Aug. 22, 2005 | (JP) | 2005-239886 |
| Aug. 22, 2005 | (JP) | 2005-239887 |
| Sep. 5, 2005 | (JP) | 2005-256173 |
| Apr. 4, 2006 | (JP) | 2006-102850 |
| May 16, 2006 | (JP) | 2006-136778 |

(51) Int. Cl.
*H01T 13/02* (2006.01)

(52) U.S. Cl. ..... 313/143; 313/118

(58) Field of Classification Search ..... 313/118, 313/135, 144, 145, 238; 123/169; 439/625; 174/152

See application file for complete search history.

(56) References Cited

U.S. PATENT DOCUMENTS 3,451,110 A 6/1969 Bray (Continued)

FOREIGN PATENT DOCUMENTS

DE 100 47 498 A1 4/2002

(Continued)

OTHER PUBLICATIONS

"Vickers Hardness Test—Test Method", Japanese Industrial Standard, JIS Z 2244, 1998, 11 Pages.

*Primary Examiner* — Peter Macchiarolo
(74) *Attorney, Agent, or Firm* — Sughrue Mion, PLLC

(57) ABSTRACT

Provided is a spark plug that includes a center electrode extending in an axial direction, a cylindrical insulator that holds the center electrode, and a cylindrical main metal fitting, which has a ground electrode at a tip portion thereof. The cylindrical main metal fitting includes a tool engagement portion for mounting the spark plug to an engine and a metal fitting-side fitting portion provided at a rear side of the main metal fitting opposite from the tip portion. The metal fitting-side fitting portion holds the insulator in a tightly fitted state in a radial direction.

29 Claims, 44 Drawing Sheets

U.S. PATENT DOCUMENTS

| | | | | |
|---|---|---|---|---|
| 5,672,812 | A * | 9/1997 | Meyer | 313/118 |
| 6,204,594 | B1 * | 3/2001 | Ingham | 313/141 |
| 6,357,408 | B1 | 3/2002 | Bridge et al. | |
| 6,559,577 | B2 * | 5/2003 | Okazaki et al. | 313/118 |
| 6,759,796 | B2 * | 7/2004 | Klett et al. | 313/143 |
| 2002/0000765 | A1 * | 1/2002 | Suzuki | 313/141 |
| 2002/0057044 | A1 | 5/2002 | Klett et al. | |
| 2002/0067112 | A1 | 6/2002 | Suzuki et al. | |
| 2006/0113883 | A1 * | 6/2006 | Kanao | 313/141 |

FOREIGN PATENT DOCUMENTS

| | | | |
|---|---|---|---|
| EP | 1 209 784 | A1 | 5/2002 |
| EP | 1 304 783 | A1 | 4/2003 |
| JP | 41-1363 | B1 | 2/1966 |
| JP | 48-109319 | | 12/1973 |
| JP | 49-034996 | | 10/1975 |
| JP | 50-123732 | | 10/1975 |
| JP | 58-62580 | U | 4/1983 |
| JP | 61-61780 | U | 4/1986 |
| JP | 62-193690 | U | 12/1987 |
| JP | 63-148585 | A | 6/1988 |
| JP | 2-183989 | A | 7/1990 |
| JP | 60-240086 | A | 11/1995 |
| JP | 9-260024 | A | 10/1997 |
| JP | 2000-77164 | A | 3/2000 |
| JP | 2000-164318 | A | 6/2000 |
| JP | 2002-158078 | A | 5/2002 |
| JP | 2002-164147 | A | 6/2002 |
| JP | 2003-178853 | A | 6/2003 |

* cited by examiner

SPARK PLUG HAVING A METAL FITTING PORTION FOR HOLDING AN INSULATOR AT A PORTION OPPOSITE A TIP END

TECHNICAL FIELD

The present invention relates to a spark plug used for an internal combustion engine such as automobile engines.

BACKGROUND ART

It is known that a conventional spark plug has a structure provided with a center electrode, an insulator for holding the center electrode and a main metal fitting which is equipped with a ground electrode at its tip end portion and has a tool engagement portion for mounting on an engine, and the insulator is supported and fixed in the main metal fitting. Such a spark plug generally has a structure that the insulator is inserted into the main metal fitting having a cylindrical shape, and one end of the main metal fitting is caulked to support and fix the insulator in it (see, for example, Patent Reference 1).

The insulator is cylindrical and has a large-diameter portion which is formed on the intermediate potion in the axial direction of the insulator to protrude in a radial direction to have a flange shape and a largest outer diameter, an intermediate-diameter portion which has an outer diameter smaller than the large-diameter portion formed adjacent to the tip end side of the large-diameter portion, and a small-diameter portion which is formed on the tip end side of the intermediate-diameter portion via a step portion having an end surface facing the tip end and has an outer diameter smaller than the intermediate-diameter portion. Meanwhile, a rear end-side body portion which has an outer diameter smaller than the large-diameter portion and keeps a substantially constant outer diameter up to the rear end of the insulator is formed on a rear end side of the large-diameter portion. The center electrode is disposed at the tip end side on the inside of the insulator, and a metallic connecting terminal is connected to it via a conductive glass seal or a resistor. The connecting terminal is disposed to partly protrude from the rear end of the insulator.

A general spark plug such as the one of Patent Reference 1 having the above-described insulator has the rear end portion of the main metal fitting caulked inward in the radial direction to enable to push the large-diameter portion of the insulator directly or indirectly via talc or the like toward the tip end in the axial direction, so that the step portion of the insulator is pushed to the engagement portion which is protruded inward in the radial direction of the main metal fitting. The step portion and the engagement portion are engaged directly or indirectly with an intervening substance such as a packing or the like therebetween to maintain airtightness between the insulator and the main metal fitting. Thus, to push the insulator from the main metal fitting toward the tip end in the axial direction, it is necessary to form a flange-shaped large-diameter portion on the insulator.

However, the formation of the large-diameter portion as described above prevents the spark plug from having a smaller diameter. Therefore, it cannot fully meet the demand from the engine side that the spark plug is desired to have a smaller diameter. Accordingly, there is also proposed a spark plug having the insulator, which does not have the flange-shaped large-diameter portion, by supporting and fixing the insulator to the main metal fitting by a welded connection, an adhesive connection, shrink fitting or the like (see, for example, Patent Reference 2).

Patent Reference 1: JP-A 2002-164147

Patent Reference 2: JP-A 2002-158078

DISCLOSURE OF THE INVENTION

According to the above-described conventional technologies, the spark plug which holds the insulator in the axial direction by caulking the main metal fitting as in Patent Reference 1 is not formed to have a small diameter though the main metal fitting sufficiently holds the insulator and has high reliability. And, the spark plug having the main metal fitting and the insulator fixed by a welded connection, an adhesive connection, shrink fitting or the like can be made to have a small diameter but has not been put into practical use because it is hard to secure the vibration resistance and the connected portion with sufficient reliability.

One of the causes is a problem of airtightness whether the engine combustion chamber can be sufficiently kept airtight. For example, the spark plug described in Patent Reference 2 has a connection structure to hold the insulator at an axial position where the tool engagement portion is positioned to engage a tool for mounting the spark plug on the engine. Therefore, rotating torque, which is applied when the spark plug is screwed into the engine, acts on the tool engagement portion to cause a possibility of separation of the connection between the main metal fitting and the insulator. Then, there is a possibility of leaking a combustion/unburnt gas from the combustion chamber through a weakened connected portion.

The present invention has been achieved to solve the above-noted problems. The invention provides a spark plug which can be configured to have a smaller diameter in comparison with conventional ones and to assure the vibration resistance and the connected portion have sufficient reliability.

The spark plug of the present invention is a spark plug comprising a center electrode which is extended in an axial direction, a cylindrical insulator which holds the center electrode, and a cylindrical main metal fitting which has a ground electrode at a tip end portion and a tool engagement portion for mounting on an engine, wherein the main metal fitting has a metal fitting-side fitting portion provided at a part of a rear end side of the main metal fitting from the tool engagement portion and the metal fitting-side fitting portion holds the insulator in a tightly fitted state in a radial direction by the metal fitting-side fitting portion.

The spark plug of the invention has the insulator held in a tightly fitted state using the metal fitting-side fitting portion of the main metal fitting. The tightly fitted state is obtained by any of press fitting, shrink fitting and cold fitting. Thus, the main metal fitting can hold the insulator without disposing on the insulator the flange-shaped large-diameter portion for pushing the insulator by the main metal fitting in the same manner as the prior art. Therefore, the insulator has a maximum diameter smaller than the conventional one. In other words, the insulator can be made to have a diameter smaller than the conventional one. To provide a tightly fitted state, there can be selected a method, such as press fitting, shrink fitting, cold fitting or the like which does not use a brazing material. The tightly fitted state means that the force for holding the insulator in the axial direction against the main metal fitting is not to hold by applying the force in the axial direction by the main metal fitting but to hold the insulator from the radial direction by the metal fitting-side fitting portion as described in Patent Reference 1.

And, the disposition of the metal fitting-side fitting portion for holding the insulator on the rear end side distant from the tool engagement portion can prevent a twisting torque or an axial force from affecting the metal fitting-side fitting portion and can improve the insulator holding reliability of the metal fitting-side fitting portion when a tool is engaged with the tool engagement portion to tighten the spark plug to the engine block. And, since the insulator is held on the rear end side of the main metal fitting, a resonance frequency can be increased even when the insulator is vibrated, and a vibration resistance property can be improved.

When configured as described above, it becomes difficult to obtain airtightness between the insulator and the main metal fitting when engaging them in the axial direction according to a conventional spark plug. But, in the present invention, there is no problem because airtightness can be obtained by closely connecting the insulator and the main metal fitting at the metal fitting-side fitting portion.

It is desirable that the metal fitting-side fitting portion, which provides airtightness, is configured to fit a portion of the insulator having the largest diameter at a portion housed into the main metal fitting in the axial direction so as to hold the insulator by the main metal fitting. Thus, it becomes possible to firmly hold the insulator without breaking it because the insulator itself is made to have a small diameter and its largest-diameter portion is used for holding.

For more secure holding of the insulator, it is desired to configure as follows. Specifically, it is configured that the insulator is in a tightly fitted state in the metal fitting-side fitting portion at an axial position where the connecting terminal is inserted into the insulator and the glass seal is filled between the insulator and the connecting terminal. By adopting the above structure, the insulator can be prevented from being broken by a large stress applied from the main metal fitting. In this case, if the connecting terminal has a smooth outer shape, the number of portions to which the stress is applied is few. Therefore, it is desired that the outside surface of the connecting terminal at this portion is free from irregularities due to screws, knurls and the like.

As means for holding the insulator by the metal fitting-side fitting portion, press fitting can be selected, and it is desirable that an introductory part for press-fitting have a diameter smaller than that of the rear end side and that the introductory part is disposed on the tip end side of the press-fitted portion of the insulator. And, in a case where the introductory part for press-fitting is tapered, it is desired that the taper is formed at a taper angle of 1 to 5° with respect to the axial direction. Thus, it becomes possible to produce by a simpler process, and a sufficient pull-out load can be secured. Besides, the pull-out load can be increased by performing a heat treatment after the insulator is press-fitted into the metal fitting-side fitting portion of the main metal fitting. It is presumed that the contact state of the metal fitting-side fitting portion is a point contact before the heat treatment, but a high surface pressure is locally applied to the point contact portion, application of heat under the above state makes the main metal fitting material soft, the contact state is changed from the point contact to a surface contact by plastic deformation, and a real contact area of the metal fitting-side fitting portion increases.

According to any of the above-described spark plugs, a contact portion, which is in contact with the insulator press-fitted into the rear end side, is formed within the metal fitting-side fitting portion, and a pull-out portion, which is not in contact with the insulator in a press-fitted state, is formed on the tip end side of the metal fitting-side fitting portion. By configuring the metal fitting-side fitting portion formed on the main metal fitting as described above, the press-fitting load required for press fitting can be suppressed from increasing, and the insulator can be prevented from being damaged.

Incidentally, to provide the spark plug with a small diameter, it is possible to realize the provision of the small diameter by changing the form of holding the insulator by the main metal fitting as described above, but it is additionally presumed that the small diameter is realized more easily by making the main metal fitting thinner. Therefore, it is beneficial to provide the material of the main metal fitting with higher strength.

As means therefore, as the material for the main metal fitting, one may use a material such as Inconel (brand name), SUS or the like, namely, a material having Fe or Ni as a main component and a Cr content of 11.5 to 26 mass %. The main metal fitting formed of such a material is generally highly reliable, but the present inventors have studied in detail to find that a stress corrosion crack or the like might be caused under severe conditions.

To solve the above problems, the main metal fitting is formed of a material having Fe or Ni as a main component and a Cr content of 11.5 to 26 mass %, and an oxide film having a thickness of 5 nm or more is formed on at least a part of the surface.

Where the main metal fitting is formed of a material having Fe or Ni as a main component and a Cr content of 11.5 to 26 mass %, a natural oxide film having a thickness of about 1 nm or less is formed on its surface. For example, when the above main metal fitting on which the natural oxide film is formed is used for a spark plug which is configured to support an insulator in a metal fitting-side fitting portion by press fitting, the tool engagement portion or the like adjacent to the metal fitting-side fitting portion occasionally has a crack by performing, for example, a test to cool with water after heating up to 150° C. for about 100 cycles. Its cause is presumed to be a stress corrosion crack caused by corrosion due to a reaction between carbon and Cr of the main metal fitting base material because of exposure to a high temperature under application of a stress. In other words, it is presumed that a brittle reaction layer is formed by a reaction between carbon and Cr though the base material itself has corrosion resistance by virtue of the natural oxide film of Cr. This reaction produces a deficiency of Cr to disable the growth of a natural oxide film, and corrosion progresses to produce a crack. Such a phenomenon seems to be caused by carbon contained in a lubricating material, which is used when the insulator is press-fitted into the main metal fitting. But, even if the spark plug is mounted on the engine without using the lubricating material, the same phenomenon seems to be caused by carbon or the like contained in the combustion gas.

Accordingly, where an oxide film having a thickness of 5 nm or more, e.g., 30 nm, was formed on the main metal fitting, it was confirmed that a crack was not produced by performing a test of cooling with water after heating to 150° C. for 500 cycles. Thus, the formation of the oxide film having a thickness of 5 nm or more allows to suppress the production of a stress corrosion crack or the like in the main metal fitting and can improve the reliability furthermore in comparison with the prior art. The oxide film may be formed on the entire surface of the main metal fitting or selectively formed on a portion where a crack tends to be caused.

For example, where the metal fitting-side fitting portion which holds the insulator by tightly fitting is provided on the rear end side of the tool engagement portion of the main metal fitting, it is desired to form the oxide film on the inside part of the main metal fitting and on the tip end part adjacent to the metal fitting-side fitting portion. This is because there is a possibility of causing a crack or the like on the tip end part adjacent to the metal fitting-side fitting portion due to the application of stress involved during the fitting. For example, when a lubricant is used for fitting, corrosion tends to be caused by carbon contained in the residue lubricant on the tip end part adjacent to the metal fitting-side fitting portion, and a possibility of causing a crack or the like is further enhanced.

Besides, when it is configured to keep airtightness by the metal fitting-side fitting portion of the main metal fitting, a portion closer to the tip end side with respect to the metal fitting-side fitting portion is exposed to a high-temperature combustion gas, the adhesion of carbon contained in the combustion gas facilitates the occurrence of corrosion, and a possibility of occurrence of a crack or the like becomes higher. Therefore, it is desirable to form an oxide film on that portion.

The above-described oxide film can be formed by, for example, a heat treatment. The heat treatment conditions include, for example, a temperature of 350° C. in the atmosphere and a time of about one hour.

As described above, when the insulator is held in a tightly fitted state on the rear end side with respect to the tool engagement portion of the main metal fitting, it can be configured to allow the combustion gas to reach a portion adjacent to the tip end side of the metal fitting-side fitting portion. A stress corrosion crack or the like could be produced on the pertinent portion, and especially for a stress, damage to the main metal fitting by the stress can be suppressed or reduced by adopting the following structure.

In other words, it is configured such that thickness T of the metal fitting-side fitting portion and thickness t between the metal fitting-side fitting portion and the tool engagement portion satisfy a relationship of $t<T$.

Where a spark plug having a small diameter is realized by configuring as described above, a problem of insufficient airtightness between the engine and the spark plug might become conspicuous. Even if the gasket is used as in Patent Reference 1 or a taper sheet is formed as in Patent Reference 2, there is a possibility that sufficient airtightness can not be held because the outer diameter of the main metal fitting is small.

The main metal fitting is provided with a metal fitting middle body portion which has on the tip end side with respect to at least the tool engagement portion a bearing surface for keeping airtightness in direct contact with an engine when mounted on the engine and in an inclined form with the outer circumference side positioned on the tip end side from the inner circumference side.

In the above case, the insulator is held in a tightly fitted state by the metal fitting-side fitting portion of the main metal fitting. Thus, the insulator is not required to have a flange-shaped portion with a large diameter for engagement of the caulking portion of the main metal fitting as in the prior art, and the maximum diameter of the spark plug can be made small, but even if the diameter is decreased without disposing the flange-shaped large-diameter portion of the insulator, the diameter reduction effect is cut in half when the bearing surface is disposed for sealing airtight with the engine like the conventional spark plug. Accordingly, the metal fitting middle body portion is formed to have a bearing surface having an inclined form (for example, a reverse tapered form) formed so to position the outer circumference side on the tip end side with respect to the inner circumference side, thereby it is made possible to hold airtightness by direct contact with the engine without interposing a gasket. Accordingly, the outer diameter of the metal fitting middle body portion can be made small, and additional downsizing can be made. And, the direct contact of the above-configured bearing surface to the engine provides tightening torque even if there is adhesion of a lubricant such as oil or the like, and a possibility of occurrence of twist-off of the main metal fitting due to excessive tightening is not increased.

For the shape of the bearing surface, it is desirable that an included angle which is formed by a line segment connecting an inner circumference-side base point and an outer circumference-side base point of the bearing surface with respect to a linear line perpendicular to the axial direction is 10 to 15° in view of a cross section of the bearing surface including the axis line running along the axial direction. Thus, the maximum surface pressure is increased, and airtightness can be enhanced.

For the outer diameter of the above-described spark plug, the threaded portion has an outer diameter of 8 mm or less, the metal fitting middle body portion has an outer diameter which is larger than the threaded portion, and the tool engagement portion has a minimum outer diameter which is 11 mm or less and which is larger than the outer diameter of the metal fitting middle body portion. Thus, the outer diameter of the tool engagement portion becomes substantially the maximum diameter of the main metal fitting and the maximum diameter of the spark plug as a whole. Accordingly, the spark plug as a whole can be made small.

As described above, in order to hold the insulator, it is desirable to adopt the press fitting structure for the metal fitting-side fitting portion, but for the press fitting, it is desirable that at least the metal fitting-side fitting portion of the main metal fitting has a Vickers hardness in a range of 180 to 500.

The spark plug of the invention has the insulator held by the metal fitting-side fitting portion of the main metal fitting by press fitting. Thus, the insulator is not required to have a large-diameter portion for engagement of the caulking portion of the main metal fitting like the prior art, and the maximum diameter of the spark plug can be made small, but it is desirable that at least the metal fitting-side fitting portion of the main metal fitting has a Vickers hardness in a range of 180 to 500. Thus, it becomes possible to secure sufficient pull-out load and airtightness.

The minimum thickness of the metal fitting-side fitting portion of the main metal fitting is desirably 0.25 mm or more. If the thickness is smaller than the above value, productivity becomes poor. It is desirable that the insulator, at a fitting part with the metal fitting-side fitting portion of the main metal fitting, has a thickness of 1 mm or more. This is because the insulator made of a brittle material has a possibility of being broken by an action of a tightening force caused by fitting. Such a breakage can be prevented from occurring by having the thickness of 1 mm or more.

When it is assumed that the outer diameter of the insulator is d1 and the inner diameter of the metal fitting-side fitting portion is d2 after the insulator is pulled out from the metal fitting-side fitting portion of the main metal fitting, a value of d1-d2 (fitting allowance after pull-out) is desirably in a range of 6 to 200 μm. Generally, the insulator is formed of alumina and has thermal expansion of 6 to $8\times10^{-6}$/° C. The main metal fitting is formed of an alloy having Fe as a main component and its thermal expansion is 10 to $17\times10^{-6}$/° C. A fitting diameter is 3.5 to 15 mm, and the metal fitting-side fitting portion has a maximum temperature of about 250° C. Among general combinations, the necessary fitting allowance becomes minimum when alumina has $8\times10^{-6}$/° C., the main metal fitting has $10\times10^{-6}$/° C., and the fitting diameter is 3.5 mm, and a necessary fitting allowance is 2 μm when the maximum temperature is 250° C. And, the necessary fitting allowance becomes maximum when alumina has $6\times10^{-6}$/° C., the main metal fitting has $17\times10^{-6}$/° C., and the fitting diameter is 15 mm, and a necessary fitting allowance is 41 μm when a maximum temperature is 250° C. It is a necessity minimum value, and when it is assumed that a factor of safety is 3, the minimum fitting allowance is 6 μm, and the maximum fitting allowance is 123 μm. Even if the fitting allowance is 123 μm or more, there is no problem because the factor of safety increases, but if it is greater than, for example, 200 μm, the insulator is under strain. Therefore, the value of d1-d2 (fitting allowance after pull-out) is desirably in a range of 6 to 200 μm.

According to the method for manufacturing the spark plug described above, when it is assumed that the outer diameter of the insulator is D1 and the inner diameter of the metal fitting-side fitting portion is D2 before the insulator is press-fitted into the metal fitting-side fitting portion of the main metal fitting, a value of D1-D2 is in a range of 6 to 300 μm. The necessary minimum fitting allowance is 6 μm as described above. And, if the initial fitting allowance exceeds 300 μm, the press-fitting load becomes high, and the insulator might be cracked. Therefore, the value of D1-D2 (initial fitting allowance) is desirably in a range of 6 to 300 μm.

Where the present invention is configured to hold the insulator by a stress in the radial direction of the metal fitting-side fitting portion at the rear end portion of the main metal fitting, it is hard for the conventional spark plug to keep airtightness at the portion for keeping airtightness in the same manner as described above. It is because the force to push the tip end-facing end surface of the insulator to the engagement portion of the main metal fitting is small, and it is not maintained. Therefore, sufficient thermal conductivity to the main metal fitting of the insulator at the pertinent part cannot be expected.

Accordingly, at least two heat release paths for indirect release of heat from the insulator to the main metal fitting via a different member configured as a part different from the insulator and the main metal fitting are formed between a tip end of the main metal fitting and a bearing surface of the main metal fitting which forms an airtight sealing surface with an engine when the spark plug is mounted on the engine, and the at least two heat release paths are formed at separated from each other in the axial direction on a longitudinal cross section of the insulator.

Thus, at least two heat release paths for indirect heat radiation from the insulator to the main metal fitting via the different member on at least two positions separated from each other in the axial direction on a longitudinal cross section of the insulator are formed, so that the heat release can be controlled with high precision. Accordingly, it is also possible to provide a wide range without involving degradation in anti-fouling property.

Especially, a spark plug using the center electrode having a copper core and a spark plug having the resistor sealed therein have a temperature increased in the vicinity of a collar portion which is a connected portion of the resistor and the center electrode because of heat conduction from the ignition portion at the tip end through the copper core. Therefore, a heat treatment in the vicinity of the collar portion is significant. And, if the insulator in the vicinity of the ignition portion also has an excessively high temperature, preignition occurs, and normal ignition cannot be obtained. Therefore, a heat treatment of the insulator in the vicinity of the ignition portion is also significant. In other words, the vicinity of the connected portion of the resistor and the center electrode, and the tip end of the insulator on the side of the ignition portion are desirably cooled so as to meet a desired thermal value. The spark plug of the invention has one of the two heat release paths disposed next to the collar portion of the center electrode for connecting the center electrode and the resistor disposed within the insulator, and the other heat release path disposed on the tip end side, so that it is possible to control the vicinity of the connected portion of the resistor and the center electrode and the tip end of the insulator on the side of the ignition portion to conform to individual desired thermal values.

In the above-described spark plug, the heat release paths can be formed by a ring shaped member interposed between the main metal fitting and the insulator. And, the ring shaped member is configured to elastically contact to the inner surface of the main metal fitting and the outer surface of the insulator, and the heat conductance can be improved. The ring shaped member can be fitted easily because it is configured to deform in the circumferential direction by an assembling axial force when the insulator is fitted to the main metal fitting. For example, it can be configured that a metal fitting-side step portion is disposed on the inside portion of the main metal fitting to project inward and an insulator-side step portion is disposed on the outside portion of the insulator to project outward to support the ring shaped member in a pushed state by the metal fitting-side step portion and the insulator-side step portion.

By configuring as described above, downsizing can be made in comparison with the prior art, and a spark plug with sufficient reliability of the vibration resistance and the connected portion and secure airtightness can be provided. But, the structure of a conventional spark plug, namely the structure that a large-diameter portion of the insulator having a diameter larger than the rear end opening diameter of the main metal fitting is housed within the main metal fitting, is common, so that if an excessive combustion pressure is produced, it seems that the structure of the present invention has a possibility that the insulator is slipped out of the main metal fitting.

In view of the above concerns, a gas release portion is formed by partly cutting out a cylindrical insulator in the axial direction at a part of the outer circumference of the insulator, the gas release portion is normally positioned within the main metal fitting, and when the insulator is moved in a direction to come out of the metal fitting-side fitting portion, the gas release portion is exposed to the outside of the main metal fitting to communicate the inside of the main metal fitting with the outside.

The spark plug of the invention has the insulator retained in a tightly fitted state by the metal fitting-side fitting portion on the rear end side from the tool engagement portion of the main metal fitting. Thus, the maximum diameter of the spark plug can be made small without necessity of providing the insulator with a large-diameter part for engagement of the caulking portion of the main metal fitting like the prior art. And, when a tool is engaged with the tool engagement portion to tighten the spark plug to the engine block, application of a twisting torque and an axial force to the metal fitting-side fitting portion can be prevented, and reliability of fitting retention at the metal fitting-side fitting portion can be improved. And, the insulator is supported by the rear end side of the main metal fitting, so that when the insulator is vibrated, a resonance frequency can be enhanced, and vibration resistance can be improved. Besides, the gas release portion, which is formed by partly cutting out a substantially cylindrical insulator in the axial direction, is formed in a part of the insulator in the circumferential direction. The gas release portion is normally positioned within the main metal fitting, and when the insulator is moved in a direction to come out of the metal fitting-side fitting portion, the gas release portion is exposed to the outside of the main metal fitting to communicate the inside of the main metal fitting with the outside to release the pressure from the gas release portion to the outside. Therefore, even if the engine, which operates with the spark plug of the invention mounted, has an excessive combustion pressure or even if the fitting state of the metal fitting-side fitting portion becomes loose, a situation that the insulator is completely popped out of the main metal fitting due to the pressure from the inside can be prevented.

The gas release portion is desirably formed to have a curved boundary portion between the gas release portion and the circumference of the gas release portion. Thus, when press fitting or the like is performed, the airtightness or supporting force can be prevented from lowering due to the generation of burrs or the like.

As another means, an annular inwardly projected portion is formed on a rear end side from the metal fitting-side fitting portion formed on the main metal fitting to project inward in the radial direction via a thin wall portion, which is thinner than the metal fitting-side fitting portion, and an insulator rear end-facing end surface having a diameter larger than the bore diameter of the inwardly projected portion may be formed on a tip end side in the axial direction of the inwardly projected portion.

By forming the inwardly projected portion as described above, the insulator can be prevented from completely coming out of the main metal fitting and can function as a pull-out preventive mechanism in a case of the same unexpected situation as the above-described configuration. It is a so-called fail-safe mechanism. The "inwardly projected portion" means that the inner diameter is smaller than the inner diameter of the main metal fitting adjacent to the tip end side of the projected portion.

As an embodiment of the pull-out preventive mechanism, it is desirably configured by caulking inward in the radial direction the rear end portion of the main metal fitting, which is formed to have an obtuse angle θ2 formed by a tip end-facing end surface of the inwardly projected portion with respect to the axial direction larger than an obtuse angle θ1 formed by the insulator rear end-facing end surface with respect to the axial direction and to have the inside diameter of the inwardly projected portion increased backward.

By having the obtuse angle θ2 before caulking greater than the obtuse angle θ1 as described above, the obtuse angle θ2 after caulking can be made substantially equal to the obtuse angle θ1. And, an inside diameter of the inwardly projected portion is formed such that its diameter increases backward to exert an action as a release for lowering a caulking load.

Besides, the pull-out preventive mechanism has a groove formed along the entire circumference in the axial position where the thin wall portion is located on the outer circumferential surface of the main metal fitting. By forming the groove in this way, distortion applied to the main metal fitting when the inwardly projected portion is caulked inward in the radial direction can be suppressed or prevented from reaching the metal fitting-side fitting portion. Therefore, it becomes possible to decrease the causes possibly acting on the holding force for holding the main metal fitting.

The spark plug of the invention is configured to have the metal fitting-side fitting portion for maintaining airtightness between the insulator and the main metal fitting on the rear end part of the main metal fitting, so that the spark plug having a combustion pressure detecting function can be realized easily with high detection accuracy. In other words, it is configured to have a pressure detection sensor, which is disposed on the main metal fitting on the tip end side from the metal fitting-side fitting portion, that measures a deformation amount of the main metal fitting generated depending on a combustion pressure of the internal combustion engine and detects the combustion pressure according to the deformation amount.

In this configuration, the pressure detection sensor for detecting the combustion pressure from the deformation of the main metal fitting produced depending on the combustion pressure of the internal combustion engine is disposed on the main metal fitting at a portion on the tip end side from the metal fitting-side fitting portion for maintaining airtightness between the insulator and the main metal fitting. Therefore, the main metal fitting is deformed by the combustion pressure applied to the inside part of the main metal fitting, and the combustion pressure can be measured directly from the deformation. And, there is no application of noise resulting from oscillation or the like of the insulator due to the vibration of the internal combustion engine. Thus, the generation of noise when the combustion pressure is measured can be reduced in comparison with the prior art, and the accuracy of combustion pressure measurement can be improved by enhancing an S/N ratio.

In this configuration, the pressure detection sensor can be disposed on, for example, the rear end side from the bearing surface for mounting the main metal fitting which is contacted to the internal combustion engine when mounted on the internal combustion engine and, for example, the pressure detection sensor can be disposed on the tool engagement portion. By configuring in this way, an influence of a stress applied when the spark plug is mounted on the internal combustion engine can be prevented from being applied to the pressure detection sensor. And, the pressure detection sensor can be mounted easily on the tool engagement portion because it has a flat portion. Besides, the combustion pressure can be detected with higher sensitivity by disposing a pressure detection sensor placement position where the thickness of the tool engagement portion in the radial direction is partly thinner than the other portion of the tool engagement portion and disposing the pressure detection sensor on at least a part of the pressure sensor placement position.

According to an embodiment of the spark plug of the invention, the direction of measuring the deformation amount of the main metal fitting of the pressure detection sensor can be determined to be the radial direction. Thus, there is no influence of the deformation in the axial direction, for example, an axial force at the time of mounting the spark plug on the internal combustion engine, so that initial variation due to mounting can be decreased. Besides, a vibrational component (noise component), when the internal combustion engine is operated, is mainly in the axial direction, so that a pressure sensor which is resistant to noise can be obtained by measuring deformation in a direction perpendicular to the axial direction.

According to one embodiment of the spark plug of the invention, the main metal fitting on the tip end side in view of the pressure detection sensor placement position has therein a heat release part which is in contact with the inner circumferential surface of the main metal fitting and the outer circumferential surface of the insulator, and the heat release part has a communicating portion for communications between the tip end side and the rear end side in the axial direction. Thus, the disturbance of the propagation of the combustion pressure by the heat release members can be prevented while keeping the heat radiation, and the combustion pressure can be measured with high sensitivity and precision.

BEST MODE FOR IMPLEMENTING THE INVENTION

Figure 1:
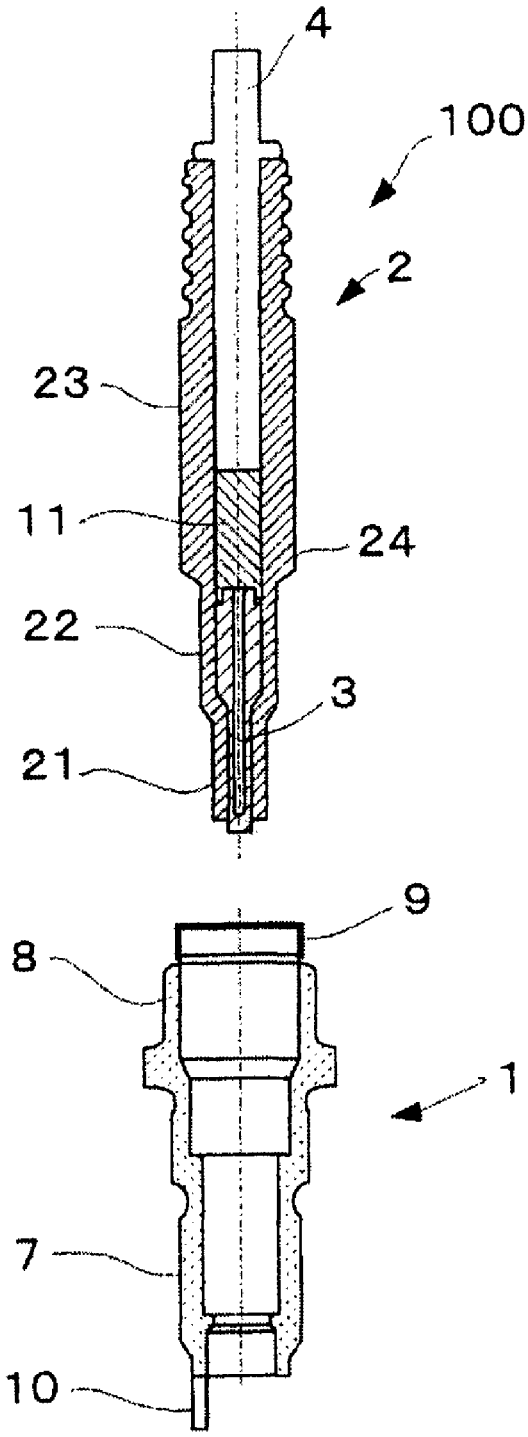
FIG. 1 is a diagram showing a state of the spark plug before press fitting according to an embodiment of the invention.
Figure 2:
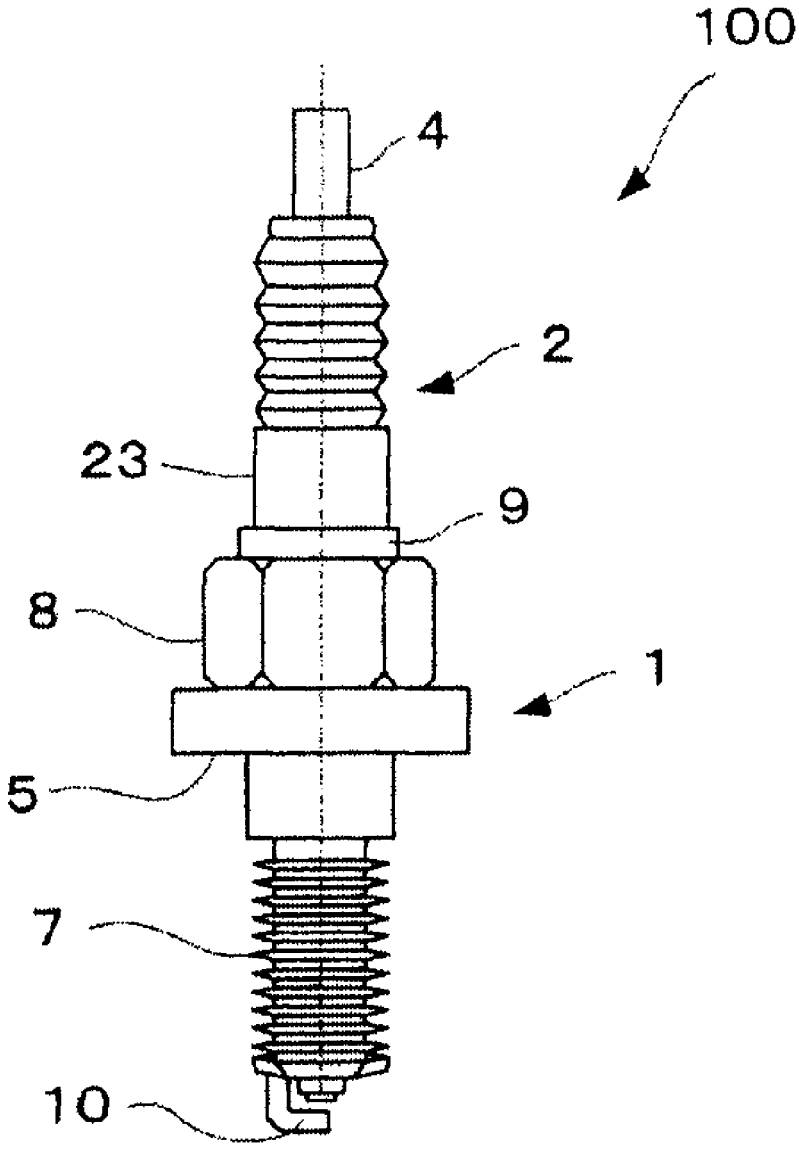
FIG. 2 is a diagram showing a state of the spark plug of FIG. 1 after press fitting.

Embodiments of the invention will be described with reference to the drawings. FIG. 1 shows a state of an insulator before fixing in a main metal fitting, and FIG. 2 shows a fixed state of the spark plug according to an embodiment of the invention. A spark plug 100 has a substantially cylindrical main metal fitting 1 and a substantially cylindrical insulator 2 which is fitted into the main metal fitting 1 with its tip end portion projected from it. A center electrode 3 is disposed in the center part within the insulator 2 along its axial direction, and the tip end portion of the center electrode 3 is in a state projected from the insulator 2. And, a ground electrode 10 is disposed to face the tip end portion of the center electrode 3. The ground electrode 10 has its one end connected to the main metal fitting 1, and a spark discharge gap having a prescribed space is formed between the ground electrode 10 and the center electrode 3.

The insulator 2 is constituted of a ceramic sintered body such as alumina to have a substantially cylindrical shape and has a through hole in it for insertion of the center electrode 3 along its axial direction. A terminal metal fitting 4 is inserted and fixed in one end side of the through hole, and the center electrode 3 is also inserted and fixed in the other end side. And, a resistor 11 is disposed between the terminal metal fitting 4 and the center electrode 3 in the through hole. Both end portions of the resistor 11 are electrically connected to the center electrode 3 and the terminal metal fitting 4 via a conductive glass seal layer.

The main metal fitting 1 is formed of a metal such as carbon steel or stainless steel, for example, S35C, S45C, SUS430 or SUS630, to have a cylindrical shape so to configure a housing for the spark plug 100, and a threaded portion 7 for attachment of the spark plug 100 to an not-shown engine block is formed on the outer circumferential surface of its tip end side (lower side of the drawing). A tool engagement portion 8 for engagement of a tool such as a spanner or a wrench to attach the main metal fitting 1 to the engine block is disposed on the outer circumference of a rear end side with respect to the threaded portion 7. And, a metal fitting-side fitting portion 9 is disposed on the rear end side with respect to the tool engagement portion 8.

The metal fitting-side fitting portion 9 is used to fit and hold the insulator 2, and the metal fitting-side fitting portion 9 of this embodiment serves to fit and hold in the radial direction by press fitting the insulator 2. Thus, the metal fitting-side fitting portion 9 is disposed on the rear end side with respect to the tool engagement portion 8, so that when a tool is engaged with the tool engagement portion 8 to tighten the spark plug 100 to the engine block, application of a twisting torque or an axial force to the metal fitting-side fitting portion 9 can be prevented, and reliability of the connected part (fitting retention) at the metal fitting-side fitting portion 9 can be improved. Specifically, even if mounting and removal of the spark plug 100 to and from the engine block are repeated many times, the twisting torque and axial force are not applied to the metal fitting-side fitting portion 9, and the state connected with the insulator 2 is not loosened. Further, the insulator 2 is supported by the rear end side of the main metal fitting 1, so that a resonance frequency can be enhanced when the insulator 2 is vibrated, and vibration resistance can be improved.

Figure 6:
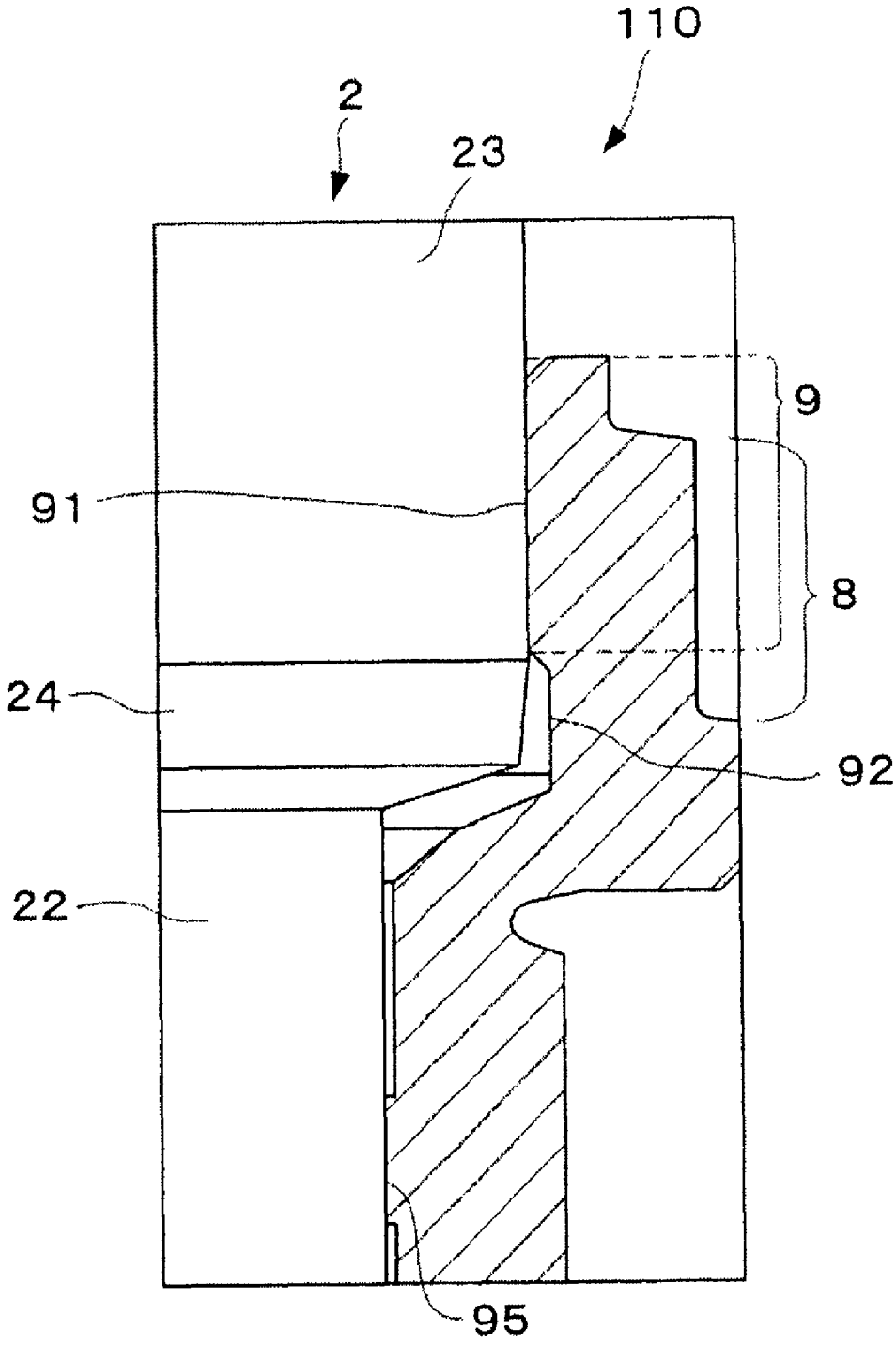
FIG. 6 is a diagram showing the structure of a main portion of the spark plug according to an embodiment.

For example, assuming arguendo, that the above-described metal fitting-side fitting portion 9 is disposed on the threaded portion 7 as shown in FIG. 6, the press fitting of the insulator 2 has a possibility of swelling the threaded portion 7 to deteriorate thread accuracy, but such a problem can be prevented from occurring by disposing on the rear end side from the tool engagement portion 8 as in this embodiment. Besides, the metal fitting-side fitting portion 9 can be fitted on the side of a large-diameter portion 23 of the insulator 2 by disposing on the rear end side opposite the tip end side. Since the large-diameter portion is thick, the breaking load of the insulator 2 is higher than those of the small/middle diameter portions, so that a load upon the insulator 2 can be decreased even if the fitting force is designed high. Further, when used in an engine, it is convenient because its temperature becomes relatively low.

Figure 3:
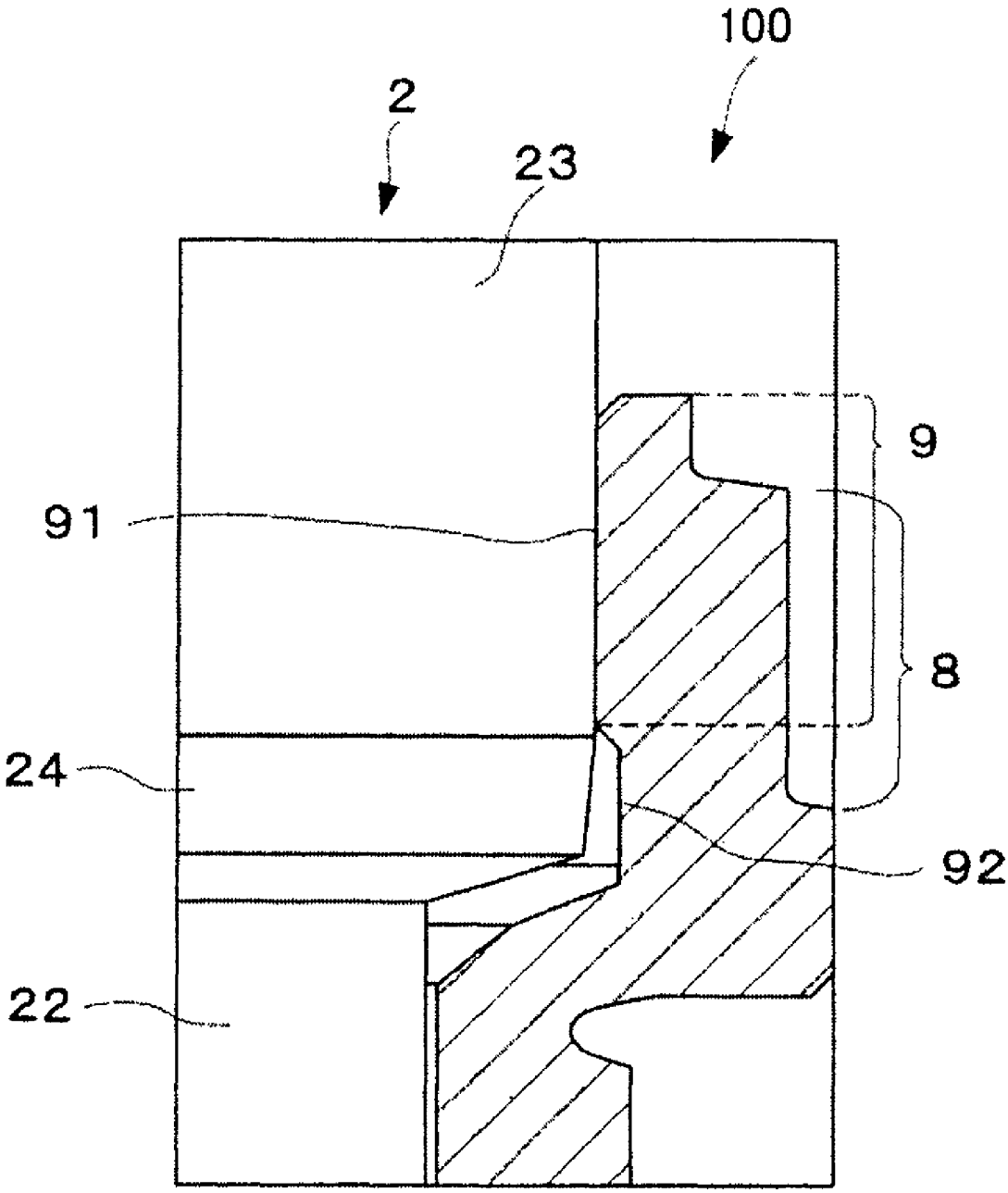
FIG. 3 is a diagram showing in a magnified fashion the structure of a main portion of the spark plug of FIG. 1.

Meanwhile, the insulator 2 has a small-diameter portion 21, a middle-diameter portion 22 and the large-diameter portion 23 sequentially from its tip end side. And, the end portion of the large-diameter portion 23 on the side of the middle-diameter portion 22 is tapered at a prescribed angle to form a introductory part for press-fitting 24 when press fitting into the metal fitting-side fitting portion 9 of the main metal fitting 1 as shown in FIG. 3 (showing the pertinent portion in a magnified fashion). The introductory part for press-fitting 24 has preferably a taper angle of about 1 to 5°, and more preferably about 2 to 4°. This taper angle may be beneficial for the following reasons.

Figure 4:
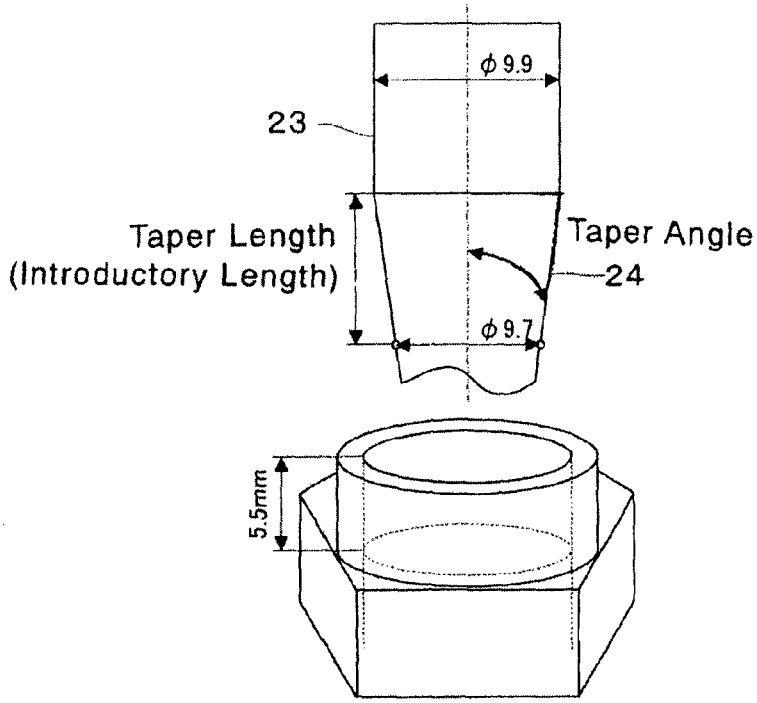
FIG. 4 is a diagram illustrating a relationship between a taper angle and a taper length of an introductory part.
Figure 5:
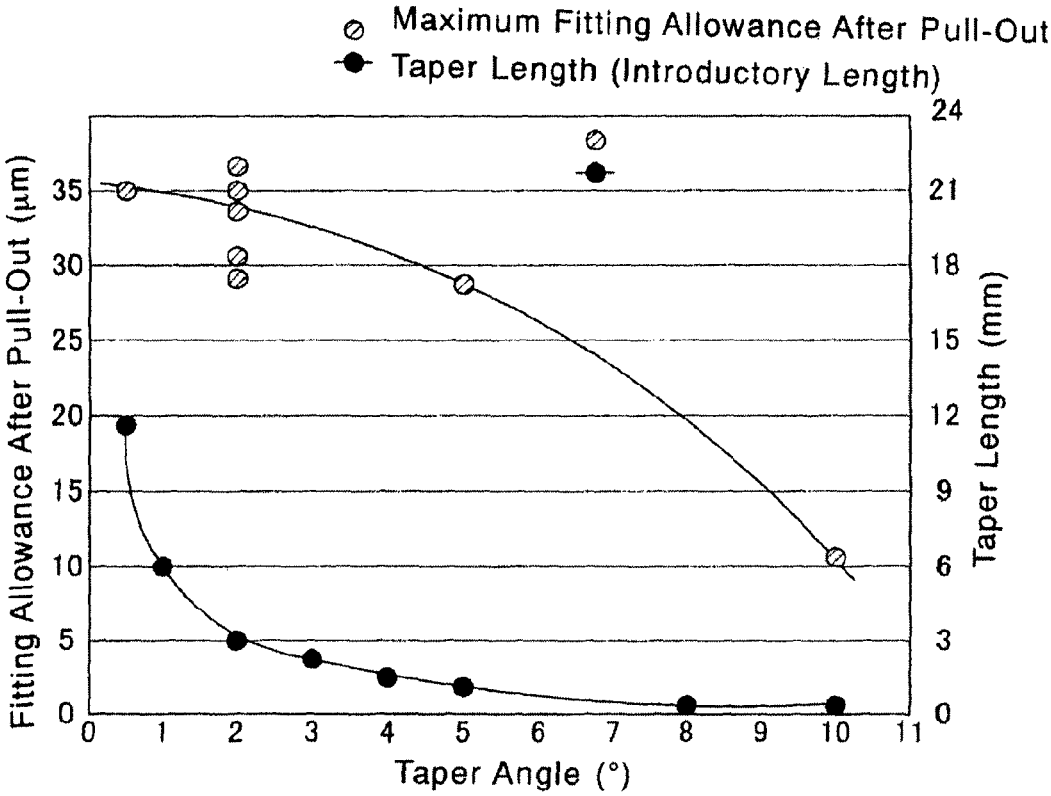
FIG. 5 is a graph showing a relationship among a taper angle, a taper length and a fitting allowance after pull-out.

Specifically, for example, when it is assumed that the large-diameter portion 23 of the insulator 2 has a diameter of 9.9 mm, the tip end portion of the large-diameter portion 23 has a diameter of 9.7 mm, and a diameter difference between them is 200 μm as shown in FIG. 4, a taper length (length of the introductory part for press-fitting) changes depending on the taper angle. FIG. 5 shows a relationship between the taper length represented on the vertical axis and the taper angle represented on the horizontal axis. As indicated by the curve shown at a lower part of the drawing, when the taper angle becomes less than one degree, the taper length becomes longer. Therefore, the taper angle is preferably one degree or more, and more preferably 2° or more.

And, the vertical axis of FIG. 5 is assumed as a fitting allowance after pull-out, and the curve at the upper part of the drawing indicates a relationship between the fitting allowance after pull-out and the taper angle. The fitting allowance after pull-out indicates a diameter difference (D2−D1) between an outer diameter (D1) of the insulator 2 when it is press-fitted and then pulled out and an inner diameter (D2) of the metal fitting-side fitting portion 9, and it is required to have a prescribed size in order to obtain a sufficient fitting strength (a pull-out load of a prescribed level or higher). To secure this fitting allowance after pull-out, the taper angle is preferably 5° or less and more preferably 4° or less. Accordingly, the taper angle is preferably about 1 to 5° and more preferably about 2 to 4°.

As described above, by press fitting the insulator 2 into the metal fitting-side fitting portion 9 in this embodiment, it is not necessary to dispose a large-diameter portion on the insulator 2 for engagement of the caulking portion of the main metal fitting as in the prior art, and the maximum diameter of the spark plug 100 can be decreased. Thus, the diameter of a hole for mounting the spark plug 100 to be formed in the engine block can be made small, and a degree of design freedom of the engine can be enhanced. The insulator 2 may be fitted into the metal fitting-side fitting portion 9 by shrink fitting, cold fitting or a combination of them in addition to the press fitting.

The spark plug 100 of this embodiment enhances the reliability of the metal fitting-side fitting portion 9, namely a pull-out load, but the higher the pull-out load is increased, the higher the press-fitting load increases. Therefore, the use of a lubricating material when press fitting can reduce a press-fitting load while keeping the reliability of the metal fitting-side fitting portion 9 high. In this case, the pull-out load is increased by performing the heat treatment after the press fitting. It is because of two effects that a lubricating effect is eliminated because of decomposition of the lubricating material by the heat treatment and the above-described point contact is changed to surface contact. As the lubricating material, for example, PASKIN M30 (brand name), SELOSOL (brand name) or the like can be used.

For example, the heat treatment is preferably performed at a temperature of 300° C. for about 15 minutes. If the heat treatment is not performed after the press fitting, the press-fitting load and the pull-out load become substantially equal. But, according to an example of data obtained by actually measuring with use of, for example, a spark plug having a metal fitting-side fitting portion with a diameter (the outer diameter of the insulator) of 10 mm by performing the above-described heat treatment, a press-fitting load was 150 Kg, a pull-out load was 610 Kg at room temperature, and a pull-out load was 520 Kg at 200° C. And, according to an example of data obtained by actually measuring with use of a spark plug having a metal fitting-side fitting portion with a diameter (the outer diameter of the insulator) of 8 mm, a press-fitting load was 157 Kg, a pull-out load was 357 Kg at room temperature, and a pull-out load was 276 Kg at 200° C. At the time of the press fitting, the bearing surface of the main metal fitting is supported to perform the press fitting of the insulator. The ground electrode 10 is connected to the tip end of the main metal fitting by a known method (see FIG. 1), so that it is preferable to perform the press fitting with the bearing surface supported to perform the press fitting without deforming the ground electrode 10.

FIG. 3 shows, in a magnified fashion, a sectional structure of the metal fitting-side fitting portion 9 of the main metal fitting 1, the metal fitting-side fitting portion 9 has on its inner wall a contact portion 91, which is kept in contact with the insulator 2 in a state completely press-fitted into the insulator 2, and a pull-out portion 92, which is disposed on a tip end side of the contact portion 91, has an inner diameter determined to be larger than that of the contact portion 91 and is kept in a noncontact state with the insulator 2 when completely press-fitted into the insulator 2. By forming the pull-out portion 92 as described above, an introductory-side tip end portion (mainly the introductory part for press-fitting 24) of the insulator 2 reaches the pull-out portion 92 at the end of the press fitting process to fall in the non-contact state with the main metal fitting 1. Thus, a press-fitting load required for the press fitting of the insulator 2 into the metal fitting-side fitting portion 9 can be reduced.

In other words, the introductory-side tip end portion (mainly the introductory part for press-fitting 24) of the insulator 2 is a portion to which a frictional force is largely applied at the time of press fitting and has a rough surface because of friction so to be a part having large friction in comparison with the other part. And, at the final stage of the press fitting process where the press-fitting load is high, the part having large friction is disposed adjacent to the pull-out portion 92 to reduce the increase of the press-fitting load.

Figure 7:
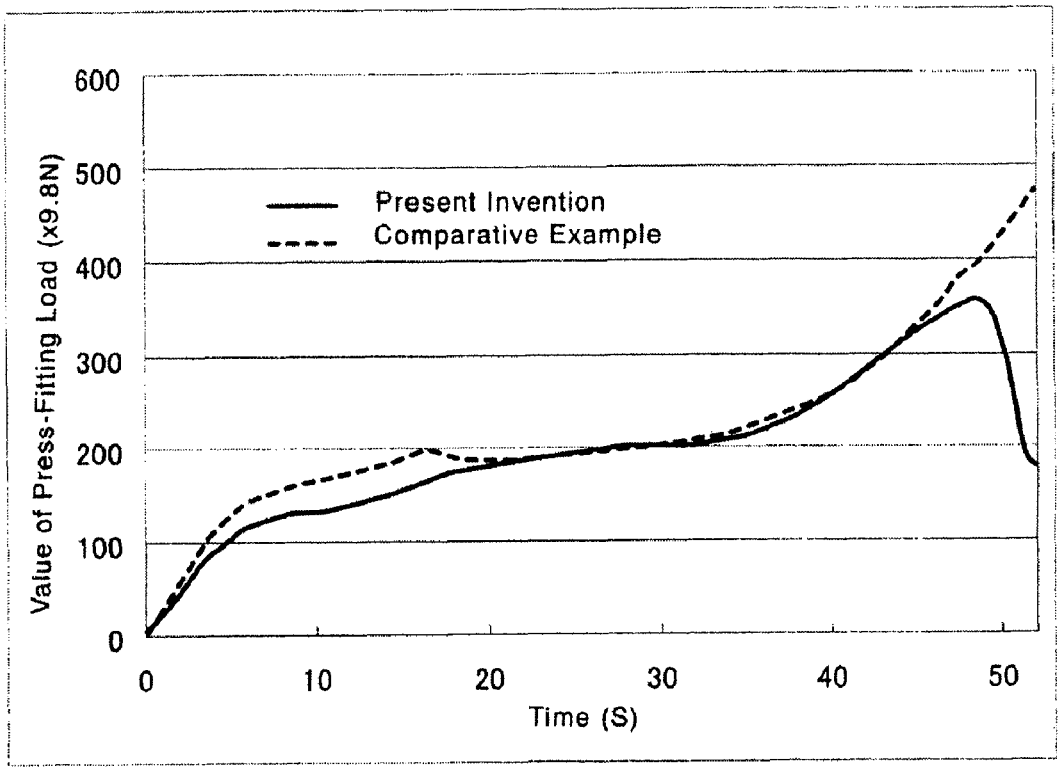
FIG. 7 is a graph showing a relationship between time for press fitting and a load for press fitting.
Figure 8:
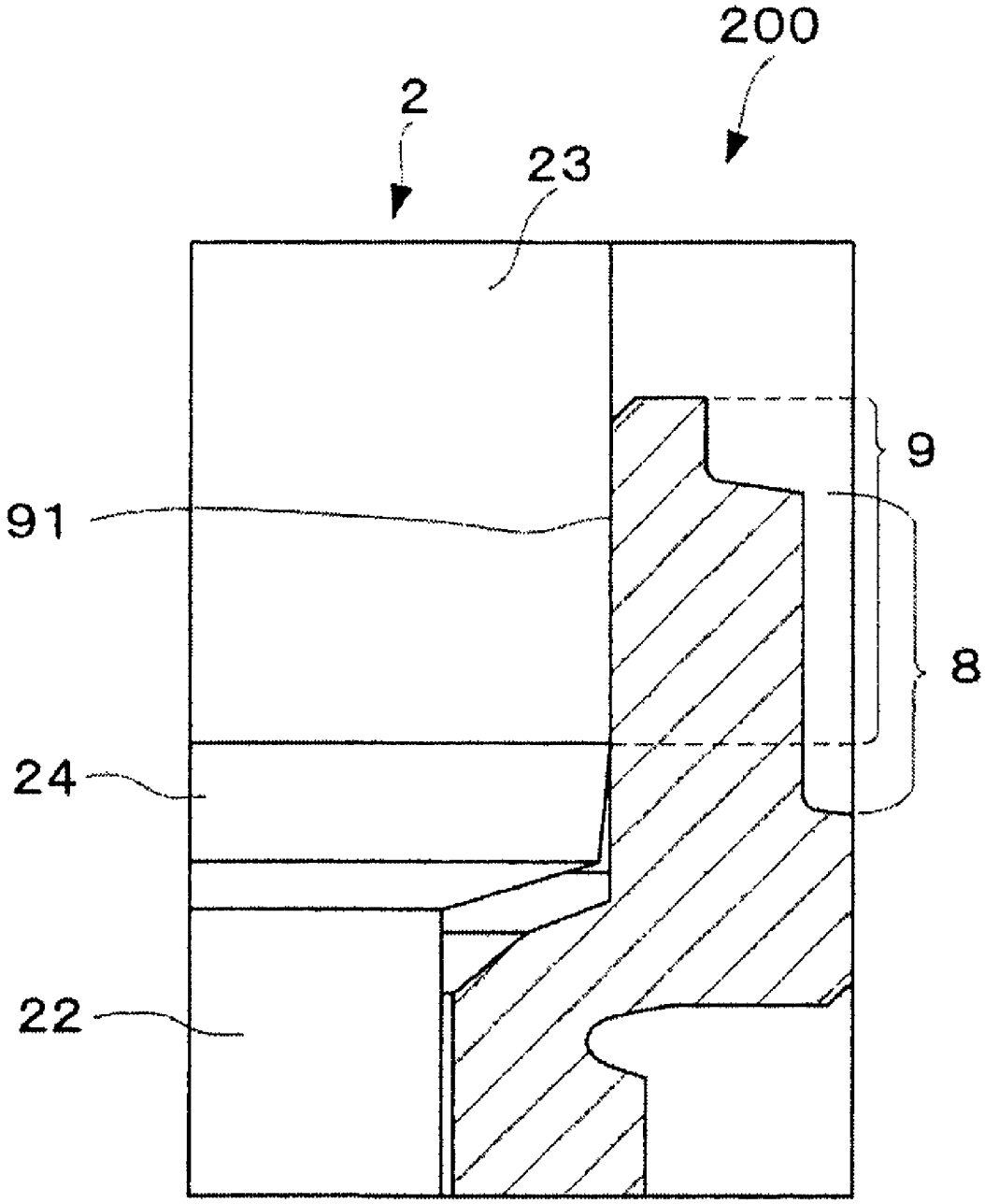
FIG. 8 is a diagram showing in a magnified fashion the structure of a main portion of the spark plug of a comparative example.

To verify the above effects, comparative tests were performed. There were used the spark plug of the invention having the pull-out portion 92 shown in FIG. 3, and as a comparative example a spark plug not having the pull-out portion 92 shown in FIG. 8, but having a main metal fitting with the contact portion 91 extended. FIG. 7 shows a graph comparing the time required for press fitting (indicating a degree of press fitting) represented on the horizontal axis and the load required for press fitting represented on the vertical axis. As shown in FIG. 7, it is seen that the spark plug of the invention provided with the pull-out portion 92 has an effect to reduce the increase of a press-fitting load at the final stage of completing the press fitting.

Besides, the contact portion 91 is designed to be able to secure airtightness required between the contact portion 91 and the outside of the insulator 2. A pressure of 1.55 MPa was applied from inside with the spark plug 100 attached to measure airtightness, and it was found that a leakage amount was about zero ml/min at normal temperature and about 1 ml/min at 200° C., indicating the secure airtightness at the same or higher level as that of a caulked spark plug generally available on the market. Thus, the spark plug 100 according to this embodiment secures airtightness by the metal fitting-side fitting portion 9, so that conventional talc powder or the like which serves as a seal for securing airtightness is not required to be filled, and the structure can be simplified.

FIG. 6 shows the structure of a main portion of a spark plug 110 according to another embodiment, and this spark plug 110 is provided with a second metal fitting-side fitting portion 95 other than the metal fitting-side fitting portion 9, and the insulator 2 is held in the main metal fitting 1 by means of the metal fitting-side fitting portions 9, 95 at two positions. Thus, the insulator 2 is held by the metal fitting-side fitting portions at plural positions, so that when the insulator 2 is vibrated within the main metal fitting 1, a resonance frequency can be further enhanced, and vibration resistance can be further improved. The second metal fitting-side fitting portion 95 is preferably disposed at a portion other than the threaded portion 7, which is for mounting on an engine, of the main metal fitting 1. Thus, thread accuracy can be prevented from being degraded during the fitting. In other words, where the second metal fitting-side fitting portion 95 is disposed, it is desirable not to form a screw thread on its outer circumferential surface in view of the thread accuracy, but the second metal fitting-side fitting portion 95 or the like may be disposed if there is no adverse effect when mounted on the engine.

Figure 9A:
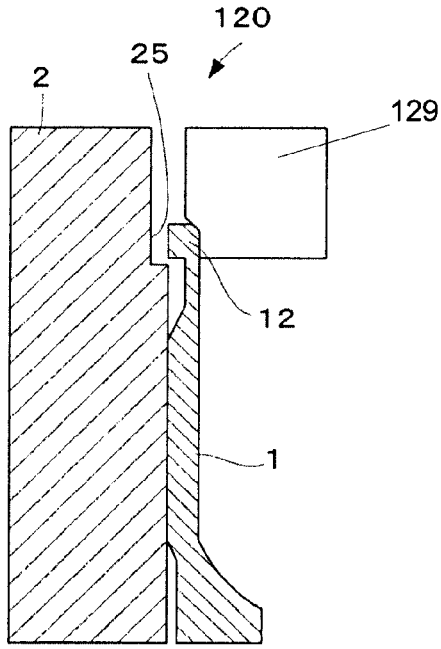
FIG. 9 is a diagram showing in a magnified fashion the structure of a main portion of the spark plug having a pull-out preventive mechanism.
Figure 9B:
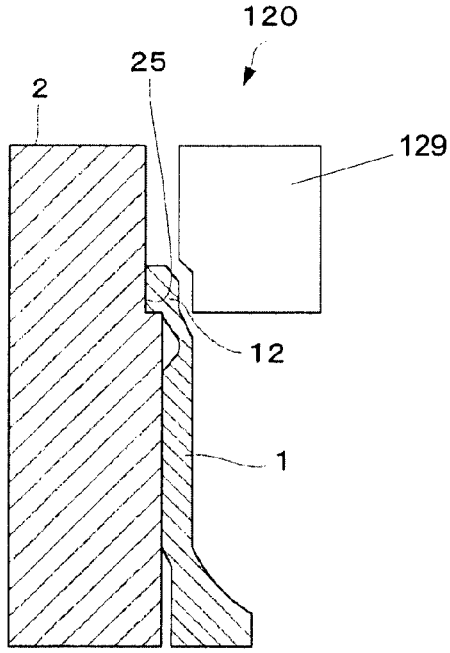

FIGS. 9A and 9B show the structure of a main portion of a spark plug 120 of another embodiment. The spark plug 120 has an engagement portion 25, which is a stepped portion or recessed portion and has a rear end-facing end surface, disposed at a part of the insulator 2 in the circumferential direction. And, the main metal fitting 1 is provided with a pull-out preventive mechanism 12 which is formed of a projected portion (inwardly projected portion) projected inward according to the engagement portion 25. And, the insulator 2 which is in the state shown in FIG. 9A is press-fitted into the main metal fitting 1, the pull-out preventive mechanism 12 is plastically deformed by pressing, using pressing portion 129, to the engagement portion 25, and the projected portion of the pull-out preventive mechanism 12 has a state engaged with the engagement portion 25 as the state shown in FIG. 9B. Thus, even if the fitting force of the metal fitting-side fitting portion 9 decreases, the insulator 2 can be prevented from popping out of the main metal fitting 1 due to the pressure from the inside. The stepped portion or the recessed portion of the engagement portion 25 preferably has a depth of about 0.1 to 1.0 mm. If the depth is less than 0.1 mm, the projected portion of the pull-out preventive mechanism 10 is hard to catch, and a sufficient pull-out preventive effect cannot be obtained. Meanwhile, if the depth is larger than 1.0 mm, the insulator cannot be made to have a small diameter. In view of the provision of a small diameter, it is more desirable that the stepped portion or the recessed portion of the engagement portion 25 has a depth of about 0.1 to 0.5 mm.

Figure 10:
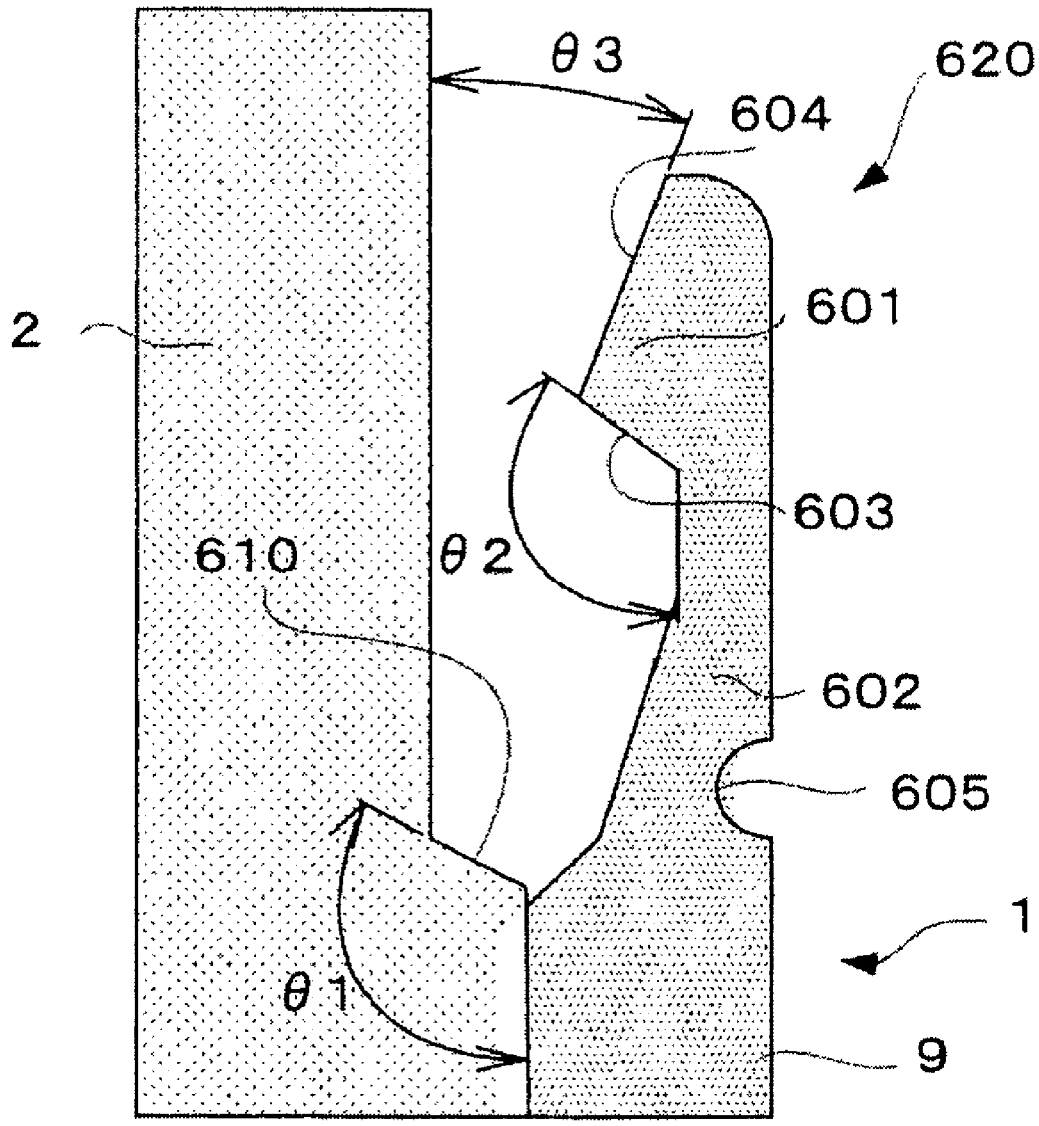
FIG. 10 is a diagram showing in a magnified fashion the structure of a main portion of the spark plug having another pull-out preventive mechanism.
Figure 11A:
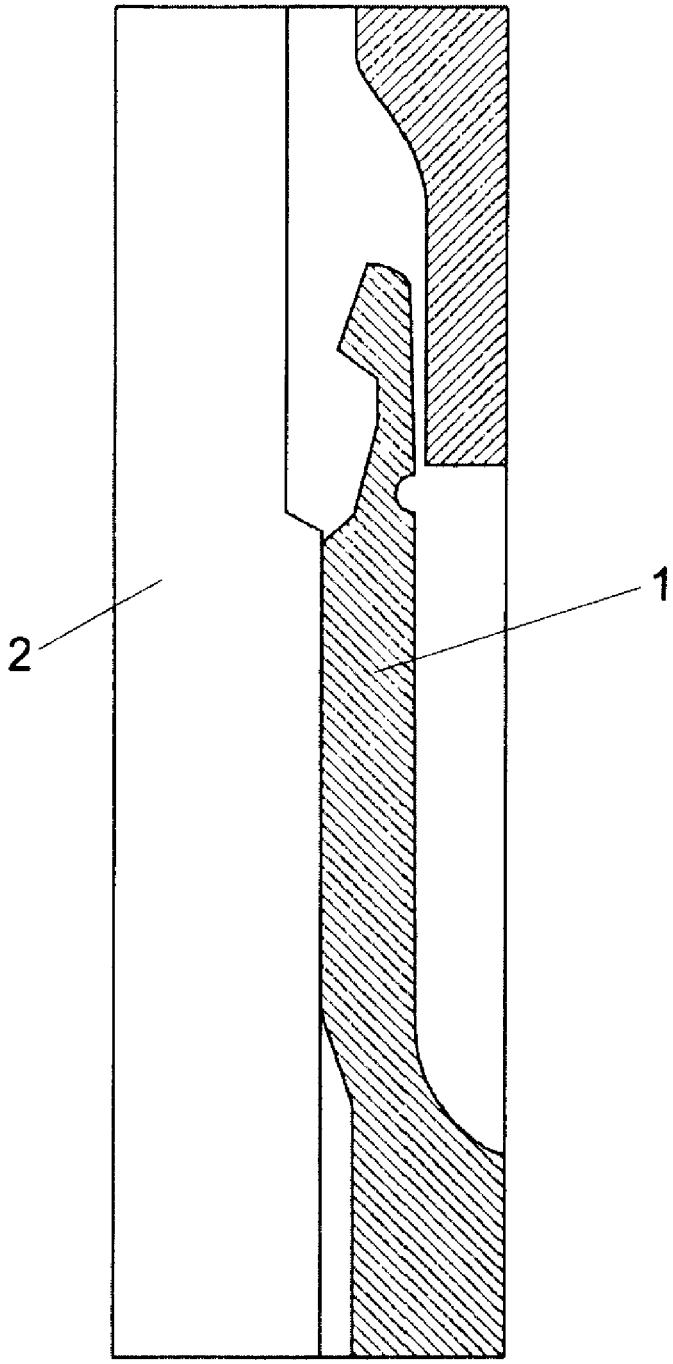
FIG. 11 is a diagram illustrating a production process of the spark plug of FIG. 10.
Figure 11B:
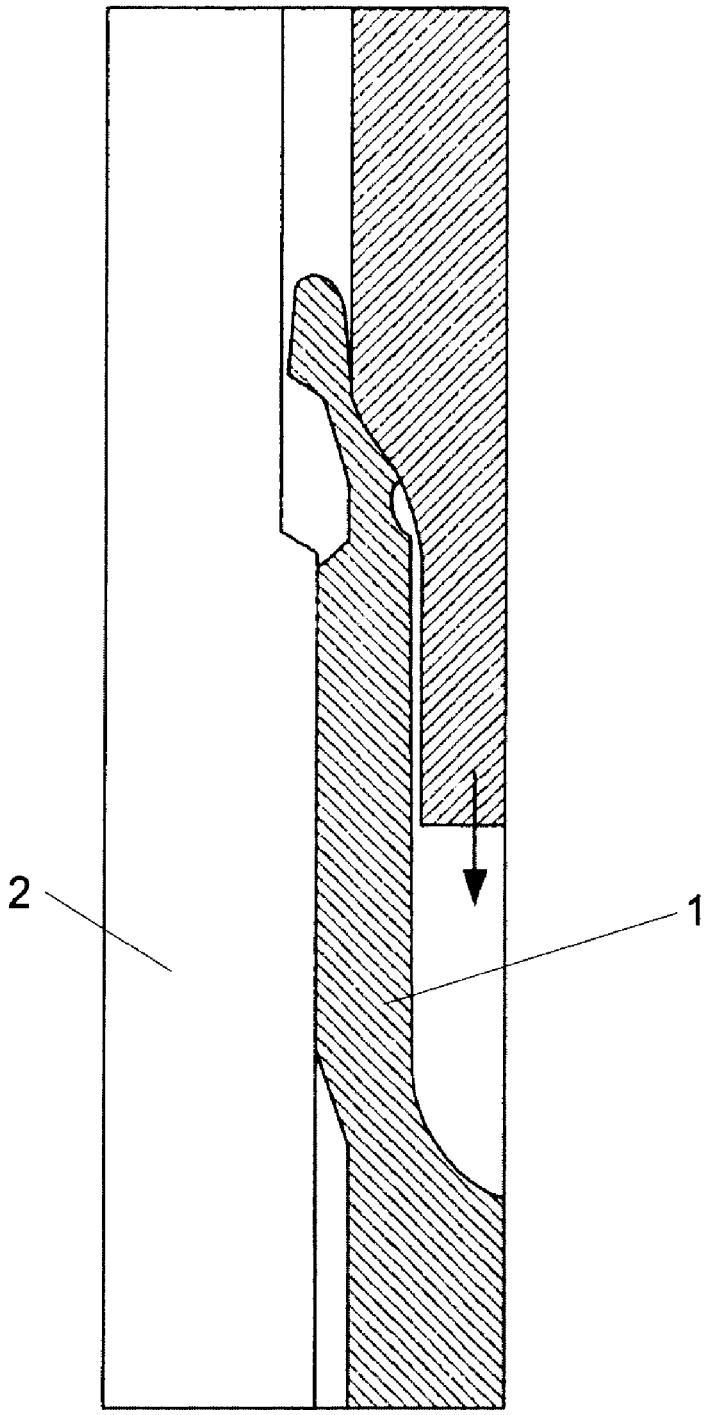
Figure 11C:
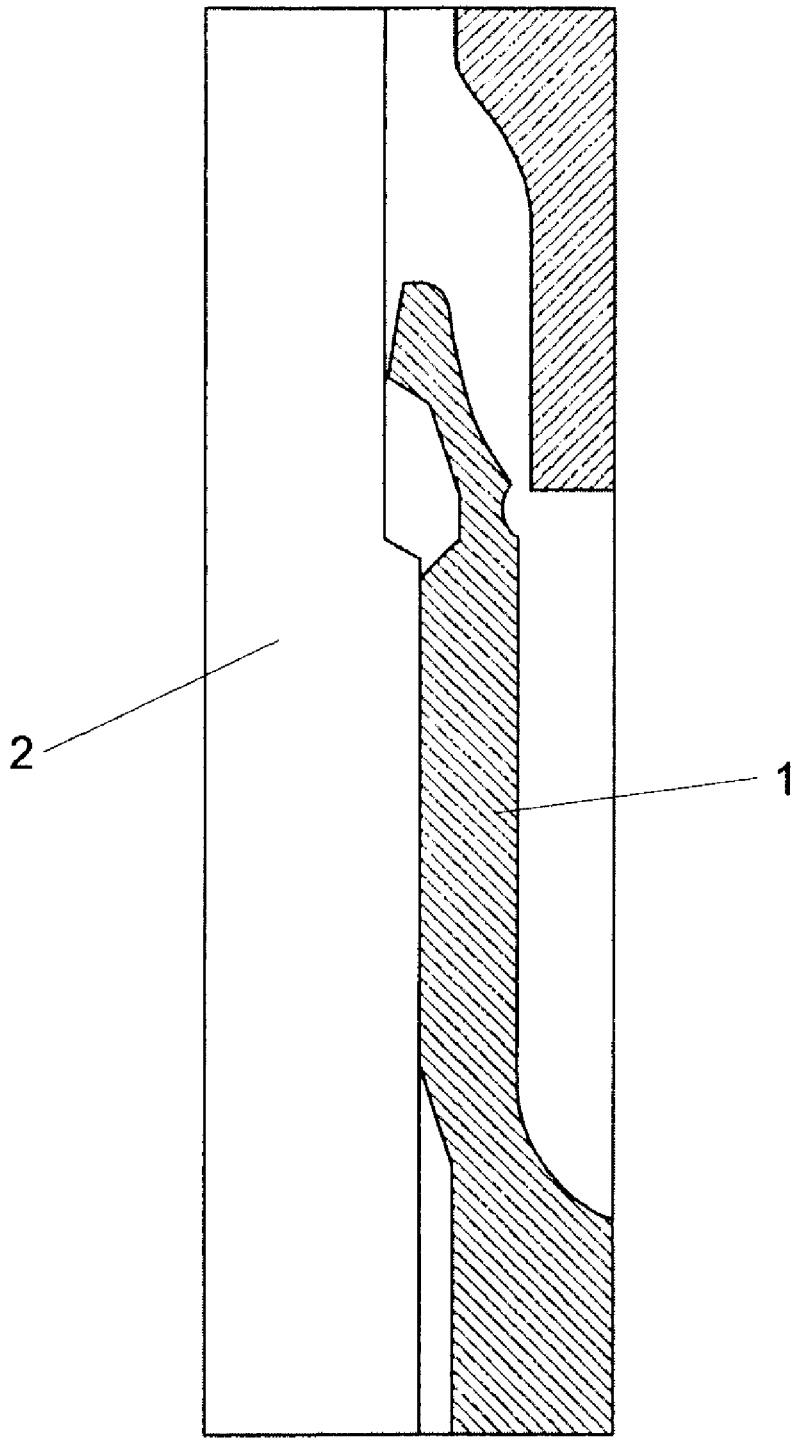

FIG. 10 shows another example of the pull-out preventive mechanism. As shown in the drawing, an inwardly projected portion 601, which is projected inward, and a thin wall portion 602, which connects the inwardly projected portion 601 and the body portion of the main metal fitting 1, are formed on the rear end side of the main metal fitting 1. And, it is configured such that an obtuse angle θ2 (e.g., 130°) formed by a tip end-facing end surface 603 of the inwardly projected portion 601 with respect to the axial direction becomes larger than an obtuse angle θ1 (e.g., 120°) formed by a rear end-facing end surface 610 configuring the engagement portion formed on the insulator 2 with respect to the axial direction. Besides, an inner circumference 604 of the inwardly projected portion 601 is formed such that its diameter increases backward (an angle θ3 formed by the inner circumferential surface with respect to the axial direction is, for example, 20°). And, when the insulator 2 is press-fitted into the main metal fitting 1 the rear end portion of the main metal fitting 1 is plastically deformed from the state shown in FIG. 11A by caulking inward in the radial direction as shown in FIG. 11B to configure a pull-out preventive mechanism 620 in the state as shown in FIG. 11C.

As described above, the obtuse angle θ2 before the caulking is determined to be larger than the obtuse angle θ1, so that the angle formed by the tip end-facing end surface 603 with respect to the axial direction can be made to be substantially equal to the obtuse angle θ1 after the caulking. And, since the inner circumference 604 of the inwardly projected portion 601 is formed to have the diameter which increases toward the rear end side, the inwardly projected portion comes into contact with the insulator when caulking, and a possibility of damaging the insulator can be lowered.

As shown in FIG. 10, a groove 605 is formed along the entire circumference at an axial position where the thin wall portion 602 is located on the outer circumferential surface of the main metal fitting 1. Thus, an influence of distortion due to the caulking can be reduced from being transmitted to the metal fitting-side fitting portion 9.

Figure 12:
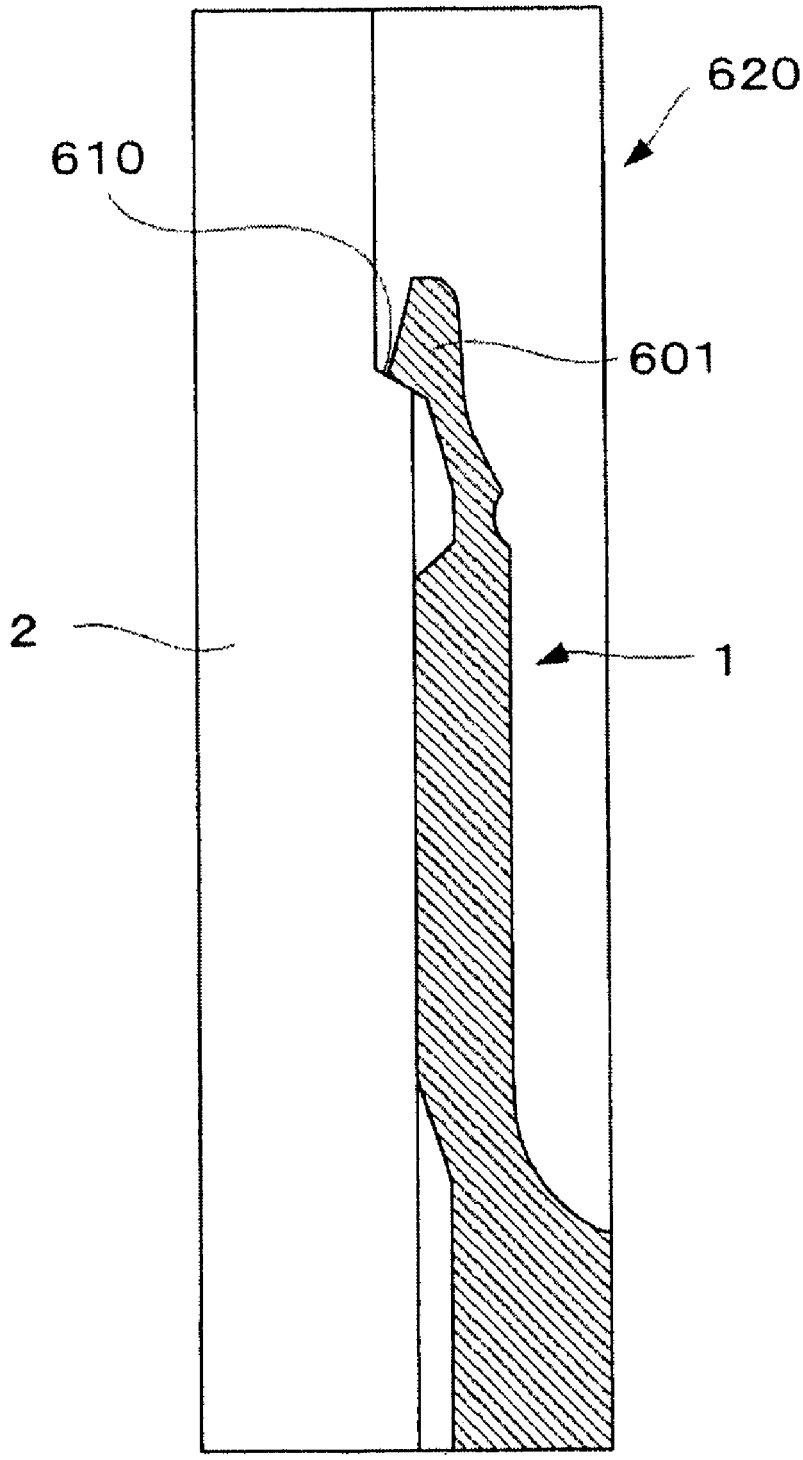
FIG. 12 is a diagram illustrating an operation of the pull-out preventive mechanism of the spark plug of FIG. 10.

If the insulator 2 seems to come off from the main metal fitting 1, the rear end-facing end surface 610 of the insulator 2 is locked by the inwardly projected portion 601 as shown in FIG. 12, and the pull-out preventive mechanism 620 can prevent the insulator 2 from being disconnected completely from the main metal fitting 1.

Incidentally, the metal fitting-side fitting portion 9 may have only a portion on the rear end side from the tool engagement portion 8 of the main metal fitting 1 to hold the insulator 2, and the metal fitting-side fitting portion 9 may be extended to overlap the tool engagement portion 8 in a range that the fitting of the insulator 2 is not disengaged or not loosened by a twisting torque when the spark plug is mounted on the engine. And, it is desirable that a portion, which is in contact with the insulator 2 of the metal fitting-side fitting portion 9, has a length of 1 mm or more. But, if it is excessively long, an excessive press-fitting load is required, so that it is desirable in view of manufacturing that the inner diameter of the metal fitting-side fitting portion 9 is an upper limit.

Figure 13:
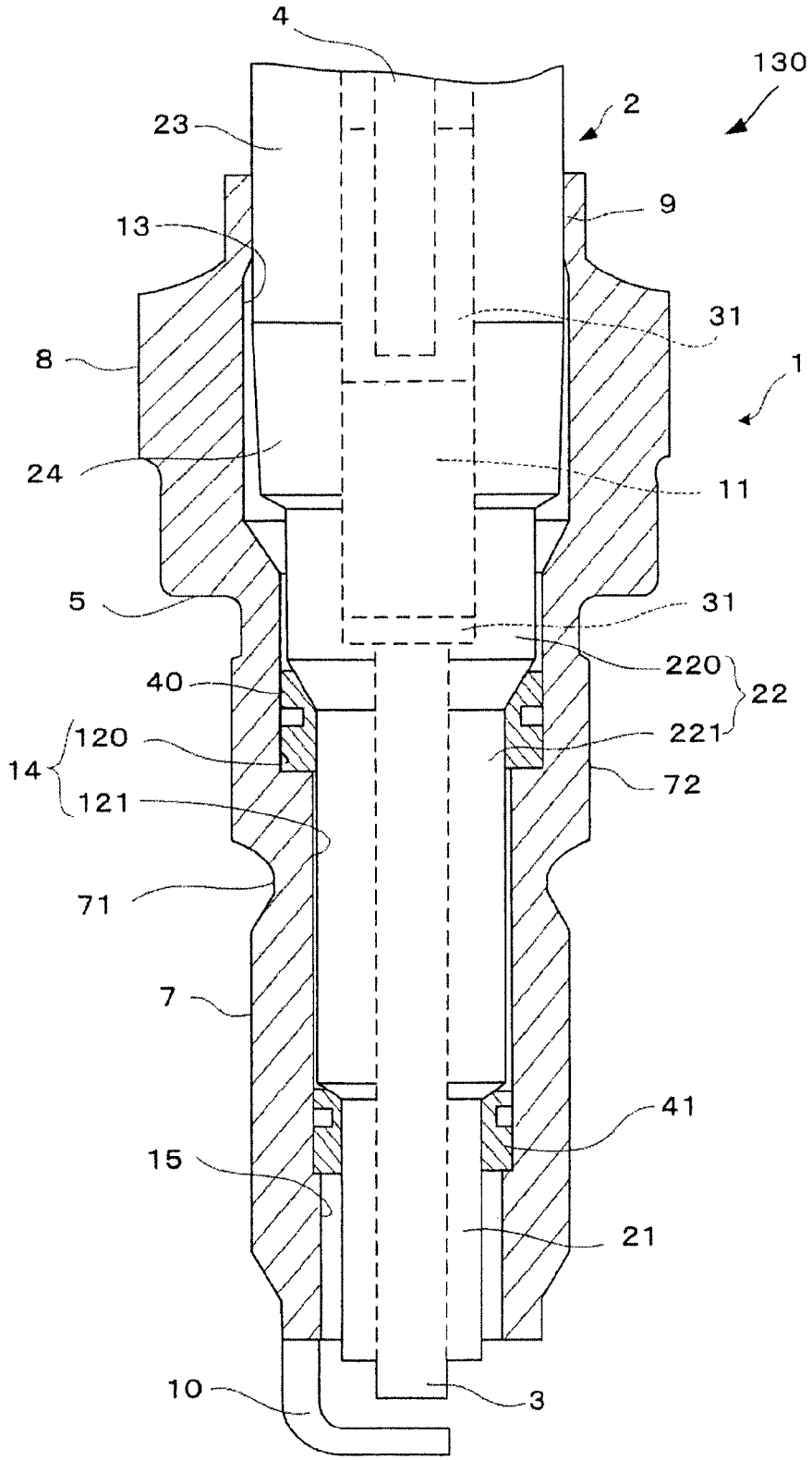
FIG. 13 is a diagram showing in a magnified fashion the structure of a main portion of the spark plug according to a second embodiment of the invention.
Figure 14:
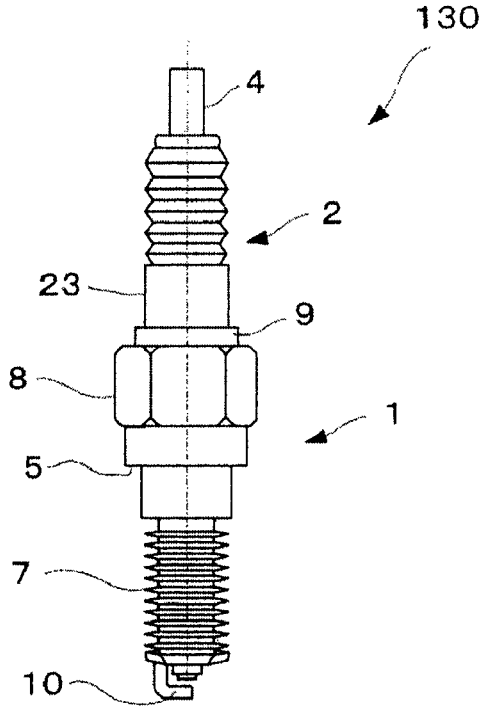
FIG. 14 is a diagram showing an appearance structure of the spark plug of FIG.

A second embodiment of the invention will be described with reference to the drawings. FIG. 13 shows, in a magnified fashion, a cross section of the structure of a main portion of a spark plug 130 according to the embodiment of the invention, and FIG. 14 shows the entire appearance of the spark plug 130. The spark plug 130 is provided with the substantially cylindrical main metal fitting 1 and the substantially cylindrical insulator 2, which is fitted into the main metal fitting 1 so to project the tip end portion. As indicated by a dotted line in FIG. 13, the center electrode 3, having a copper core therein, is disposed at the center portion of the tip end side in the insulator 2 along its axial direction, and the tip end portion of the center electrode 3 is projected from the tip end surface of the insulator 2. And, the ground electrode 10 is disposed to face the tip end portion of the center electrode 3. The ground electrode 10 has one end connected to the main metal fitting 1, and a spark discharge gap with a prescribed distance is formed between the ground electrode 10 and the center electrode 3.

The insulator 2 is constituted of a ceramic sintered body such as alumina to have a substantially cylindrical shape. As indicated by a dotted line in FIG. 13, a through hole is formed within the insulator 2 along the axial direction for insertion of the center electrode 3, the terminal metal fitting 4 is inserted and fixed to its rear end side, and the center electrode 3 is inserted and fixed within the tip end portion. The terminal metal fitting 4 and the center electrode 3 are electrically connected via the resistor 11 and a conductive glass seal layer 31 within the through hole of the insulator 2. And, the insulator 2 has a large-diameter portion 23 which includes a portion exposed from the main metal fitting 1 at a portion close to the rear end of the main metal fitting 1 or the rear end side of the main metal fitting 1, a middle-diameter portion 22, which has a diameter smaller than that of the large-diameter portion 23, on the tip end side of the large-diameter portion 23, and a small-diameter portion (insulator leg length portion) 21, which has a diameter smaller than that of the middle-diameter portion 22, on the tip end side of the middle-diameter portion 22 and is exposed to a combustion gas when mounted on an internal combustion engine such as an engine. In this embodiment, the middle-diameter portion 22 is comprised of a rear end-side middle-diameter portion 220 positioned on a rear end side and having a large diameter and a tip end-side middle-diameter portion 221 positioned on a tip end side and having a small diameter.

The main metal fitting 1 is formed of a material (Inconel (brand name) or SUS) having Fe or Ni as a main component and a Cr content of 11.5 to 26 mass % to have a cylindrical shape so to configure a housing for the spark plug 130, and a threaded portion 7 for attachment of the spark plug 130 to a plug mounting hole of an engine is formed on the outer circumferential surface of its tip end side (lower side of the drawing). A tool engagement portion 8 for engagement of a tool, such as a spanner or a wrench, to attach the main metal fitting 1 to the engine is disposed on the outer circumference on a rear end side with respect to the threaded portion 7. And, a metal fitting-side fitting portion 9 is disposed on the rear end side with respect to the tool engagement portion 8.

The metal fitting-side fitting portion 9 is used to fit and hold the insulator 2, and the metal fitting-side fitting portion 9 of this embodiment serves to fit and hold the insulator 2 in the radial direction by press fitting it. Thus, the same effect as in the previous embodiment can be provided. In FIGS. 13 and 14, reference numeral 5 denotes a bearing surface, which forms an airtight sealing surface in contact with an engine when the spark plug 130 is mounted on the engine. For example, a ring-shaped seal member (gasket) for airtight sealing may be disposed between the bearing surface 5 and the contact surface of the engine.

The inner circumferential surface of the main metal fitting 1 has a large opening portion 13 which is faced to the large-diameter portion 23 of the insulator 2, a middle opening portion 14 which is faced to the middle-diameter portion 22, and a small opening portion 15 which is faced to the small-diameter portion 21. The middle opening portion 14 is comprised of a large-diameter rear end-side middle opening portion 120, which mainly faces the rear end-side middle-diameter portion 220, and a small-diameter tip end-side middle opening portion 121, which mainly faces the tip end-side middle-diameter portion 221.

In this embodiment, the above-configured main metal fitting 1 has an oxide film having a thickness of 5 nm or more formed entirely on both the inner and outer circumferential surfaces. This oxide film can be formed by, for example, a heat treatment. As conditions for the heat treatment, for example, conditions including the atmosphere, a temperature of about 350° C., and a duration of about one hour can be adopted. The oxide film formed under the above conditions was measured for its thickness to find that it was about 30 nm. And, the oxide film formed under the above conditions was analyzed for its components to find that oxygen and Cr were contained, and Fe was slightly contained in its surface but substantially not contained within the oxide film.

Ring-shaped heat release members 40, 41 are disposed between the insulator 2 and the main metal fitting 1. The heat release members 40, 41 are made of a metal similar to that of, for example, the main metal fitting 1, to form a heat release path between the insulator 2 and the main metal fitting 1.

As shown in FIG. 13, the end portion of the large-diameter portion 23 of the insulator 2 on the side of the middle-diameter portion 22 is tapered at a prescribed angle to determine a introductory part for press-fitting 24 for press fitting into the metal fitting-side fitting portion 9 of the main metal fitting 1. The taper angle of the introductory part for press-fitting 24 is the same as in the previous embodiment.

As described above, in this embodiment, it is configured to fit and hold the insulator 2 in the metal fitting-side fitting portion 9 by press fitting it, and airtightness is secured by the metal fitting-side fitting portion 9. Therefore, a large-diameter collar portion for engagement of the caulking portion of the main metal fitting 1 is not required to be disposed on the insulator 2 in the same manner as the prior art, and the maximum diameter of the spark plug 100 can be decreased. In addition to the press fitting, the insulator 2 may be fitted into the metal fitting-side fitting portion 9 by shrink fitting, cold fitting or a combination thereof. And, for the press fitting, it is desirable to use a lubricant and to perform the heat treatment after the press fitting in the same manner as in the previous embodiment.

In the spark plug 130 of this embodiment, where it is configured to support the insulator 2 by press fitting the metal fitting-side fitting portion 9 of the main metal fitting 1, a stress is applied to, for example, the tool engagement portion 8 and the like adjacent to the metal fitting-side fitting portion 9. When a main metal fitting not having an oxide film on the surface, namely a main metal fitting having only a natural oxide film, was used to test, for example, a spark plug by a heat cycle of cooling with water after heating it to 150° C. for about 100 cycles, the tool engagement portion or the like was occasionally cracked. Its cause is presumed to due to a stress corrosion crack that occurs by corrosion due to a reaction between carbon and Cr of the main metal fitting base material because the spark plug is exposed to a high temperature and quenching with a stress applied as described above.

Meanwhile, where the main metal fitting 1 having an oxide film with a thickness of 5 nm or more, e.g., 30 nm, was used for the main metal fitting of the spark plug 130 of this embodiment, it was confirmed that no crack was caused even if the above-described heat cycle test of cooling with water after heating to 150° C. was performed for 500 cycles. Thus, the spark plug 130 of the embodiment forms an oxide film having a thickness of 5 nm or more, and the oxide film can serve as a protective layer to prevent a stress corrosion crack or the like from occurring in the main metal fitting 1. Accordingly, the reliability can be improved furthermore in comparison with the prior art.

Figure 15:
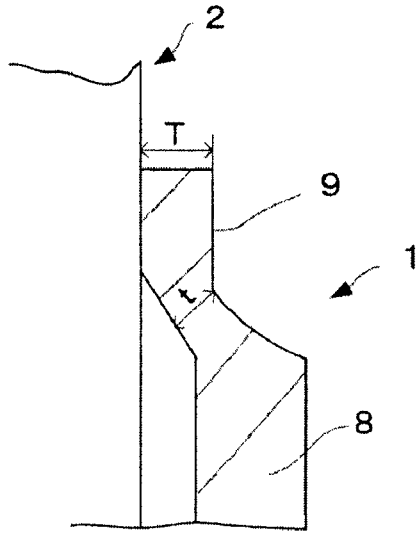
FIG. 15 is a diagram showing in a magnified fashion the structure of the main portion of the spark plug

The oxide film having a thickness of 5 nm or more is not essentially required to be formed on the entire surface of the main metal fitting 1 and may be formed on only a portion which tends to suffer from a stress corrosion crack due to the application of a stress. In such a case, the spark plug having a structure to support the insulator 2 by press fitting, as in this embodiment, may form the above-described oxide film on the portion on the tip end side adjacent to the metal fitting-side fitting portion 9. Namely, the inside surface or the like ranging from the metal fitting-side fitting portion 9 to the tool engagement portion 8. It is because a stress is applied to the above portion, which is also exposed to the high-temperature combustion gas and, when the lubricant is used at the time of press fitting as described above, the carbon component of the lubricant remains. And, to prevent the occurrence of a crack in the above-described tool engagement portion 8, the thickness t of the portion, between the metal fitting-side fitting portion 9 and the tool engagement portion 8, with respect to the thickness T of the portion of the metal fitting-side fitting portion 9, is desirably $t<T$ as shown in FIG. 15. Thus, the stress applied to the tool engagement portion 8 can be decreased, and the possibility of occurrence of a crack or the like can be decreased.

For example, where the spark plug 130 is mounted on an engine, a stress is applied to a portion on the rear end side adjacent to the threaded portion 7 shown in FIG. 13, namely a so-called screw neck section 71. And the inside part of the screw neck section 71 is exposed to a high-temperature combustion gas. Therefore, the above-described oxide film may be formed on the outside surface of the screw neck section 71. A stress is similarly applied to the above-described screw neck section 71 when it is not a spark plug having a structure to support by press fitting the insulator into the main metal fitting as in this embodiment, but a spark plug having a structure to support the insulator by caulking. Therefore, it can also be applied to a spark plug having a structure to support the insulator by caulking. The spark plug 130 shown in FIG. 13 is a so-called half-thread type having a cylindrical part 72 of which surface is free from a thread between the threaded portion 7 and the bearing surface 5 but can also be applied similarly to a spark plug of a type that a thread is formed from a portion closest to the tip end side of the bearing surface 5.

Figure 16:
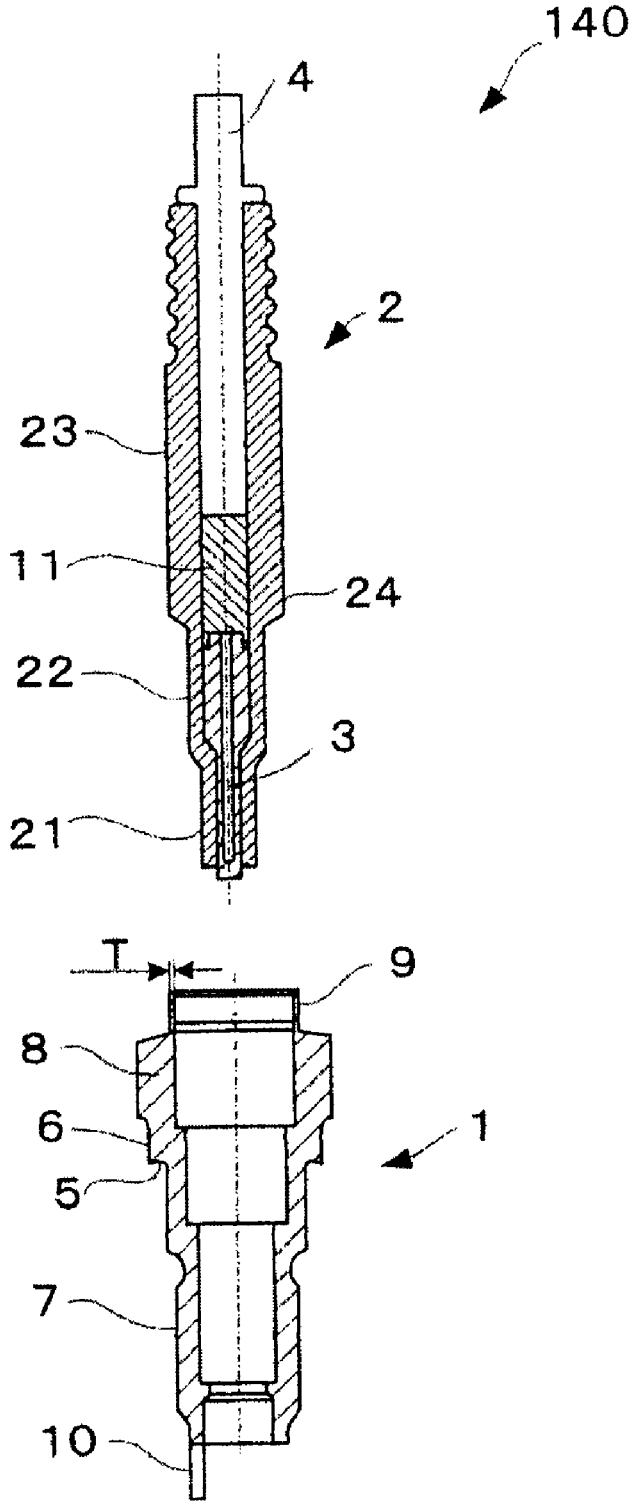
FIG. 16 is a diagram showing a state of the spark plug before press fitting according to a third embodiment of the invention.
Figure 17:
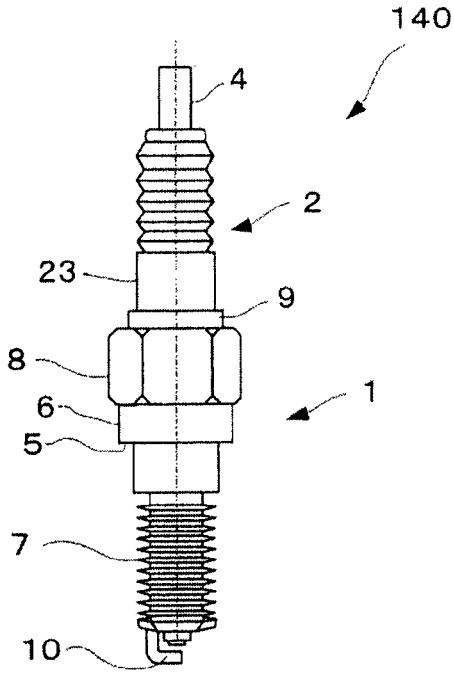
FIG. 17 is a diagram showing a state of the spark plug of FIG. 16 after press fitting.
Figure 18:
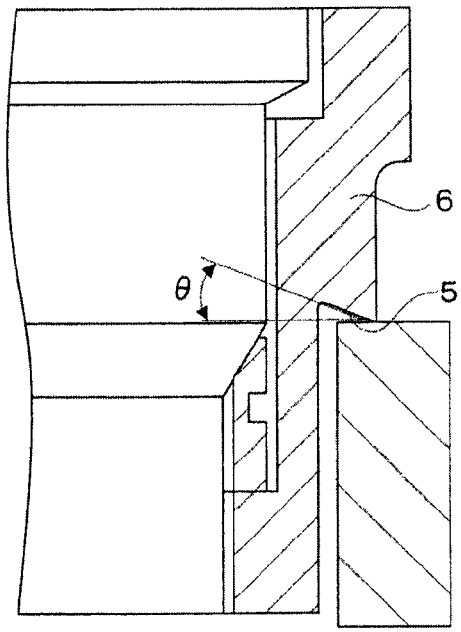
FIG. 18 is a diagram showing in a magnified fashion the structure of a main portion of the spark plug of FIG. 16.

Then, a third embodiment will be described with reference to FIGS. 16 to 19. FIG. 16 shows a state that the insulator is in a state before its attachment to the main metal fitting, and FIG. 17 shows an attached spark plug 140, where like component parts corresponding to those of the previous embodiment are denoted by like reference numerals, and overlapped descriptions will be omitted.

The main metal fitting 1 is formed of metal, for example, SUS630 (Vickers hardness of 455) or the like to have a cylindrical shape so to configure a housing for the spark plug 140, and a threaded portion 7 for attachment of the spark plug 140 to a not-shown engine block is formed on the outer circumferential surface of its tip end side (lower side of the drawing). A tool engagement portion 8 for engagement of a tool such as a spanner or a wrench to attach the main metal fitting 1 to the engine block is disposed on the outer circumference on a rear end side with respect to the threaded portion 7.

Figure 19:
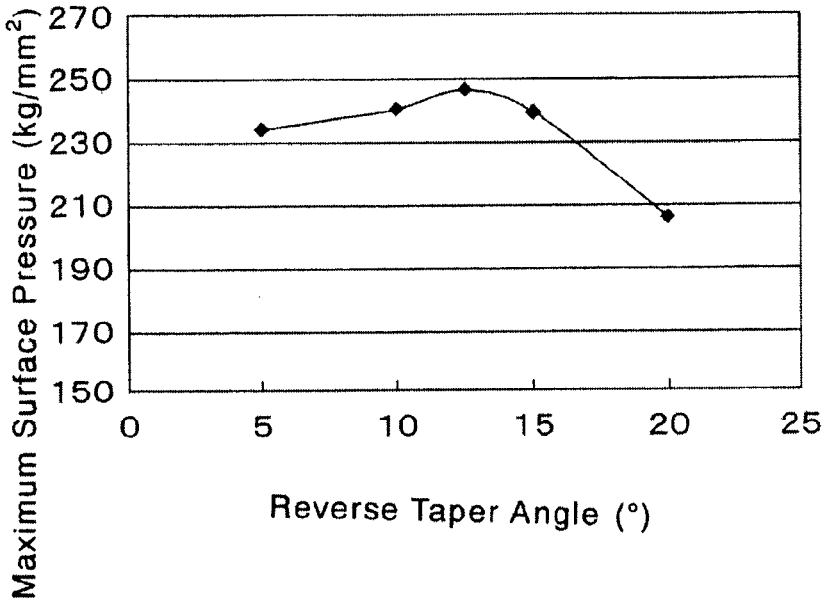
FIG. 19 is a graph showing a relationship between a reverse taper angle and a maximum surface pressure.
Figure 20:
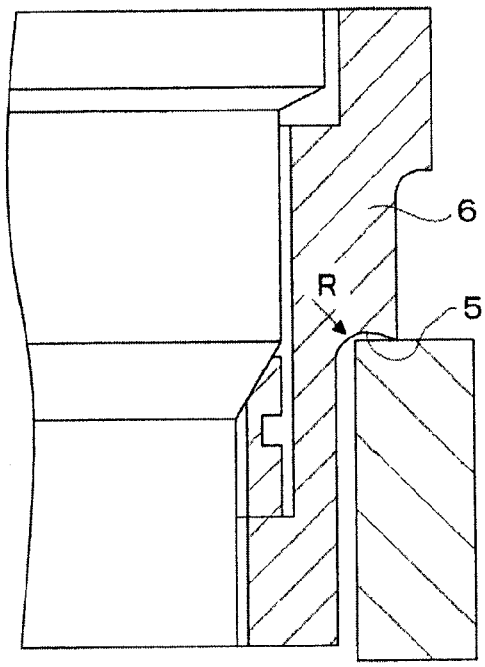
FIG. 20 is a diagram showing in a magnified fashion the structure of a main portion of a modified example.
Figure 21:
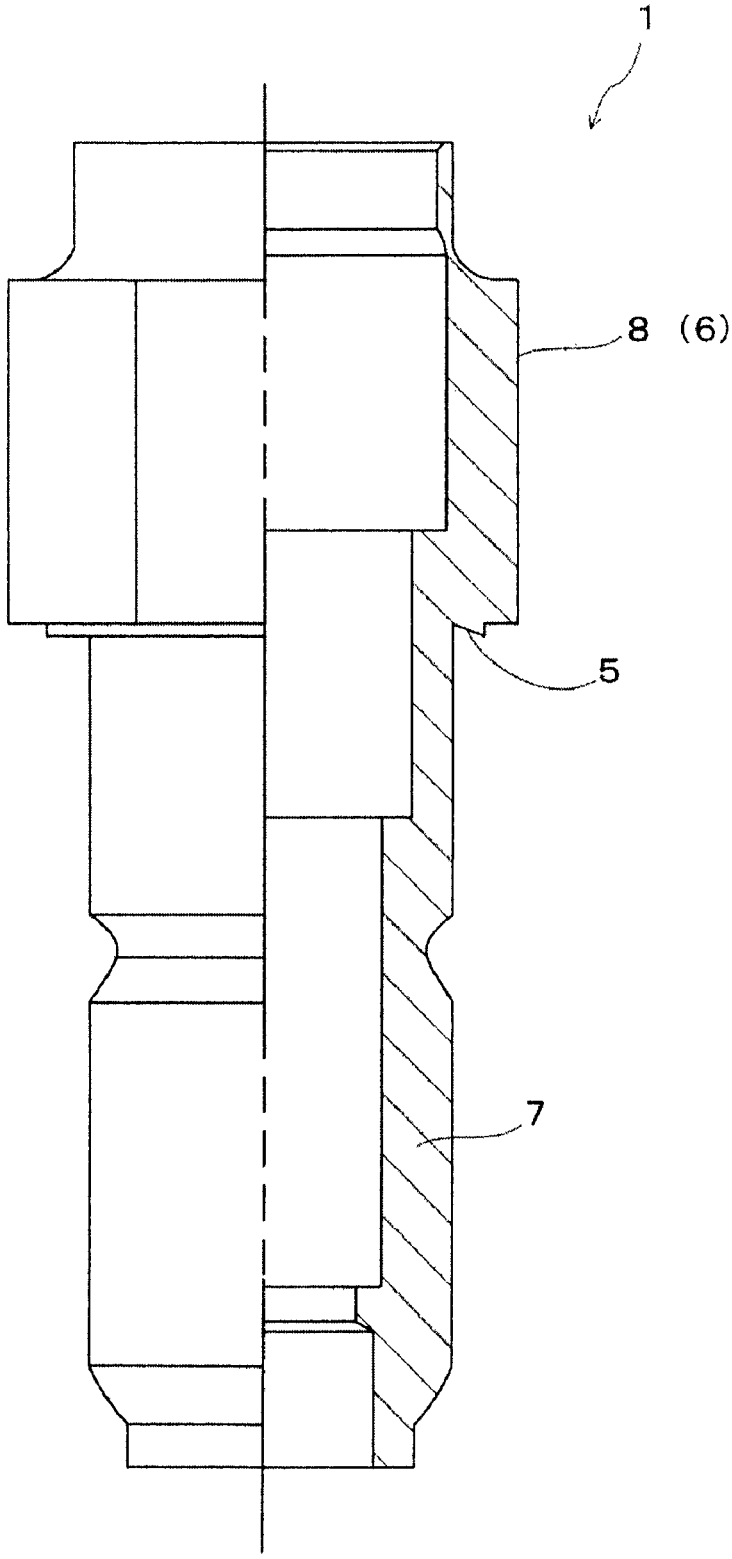
FIG. 21 is a diagram showing in a magnified fashion the structure of a main portion of another modified example.

A metal fitting middle body portion 6 is disposed on a rear end side of the threaded portion 7 and a tip end side of the tool engagement portion 8, namely between the threaded portion 7 and the tool engagement portion 8. The surface of the tip end side (lower side of the drawing) of the metal fitting middle body portion 6 is determined as a bearing surface 5, which is directly contacted with an engine to keep airtightness when mounted on the engine. The bearing surface 5 is determined to have the outer circumference side as an inclined surface (reverse tapered surface) located on the tip end side from the inner circumference side as indicated in a magnified fashion in FIG. 18. A reverse taper angle, an included angle (angle θ shown in FIG. 18), which is formed by a line segment connecting an inner circumference-side base point and an outer circumference-side base point of the bearing surface 5 with respect to a linear line perpendicular to the axial direction in view of a cross section of the bearing surface 5 including the axis line) of the bearing surface 5 affects a surface pressure when the spark plug 140 is mounted on the engine. Such a relationship is shown in FIG. 19 with the maximum surface pressure represented on the vertical axis and the reverse taper angle represented on the horizontal axis. As shown in FIG. 19, when the reverse taper angle is in a range of 10 to 15°, the maximum surface pressure becomes high in comparison with a case that the reverse taper angle is in the above range. Therefore, when the bearing surface 5 is determined to be a reverse tapered surface, the reverse taper angle is desirably in a range of 10 to 15° in view of enhancing airtightness by increasing the surface pressure. The above-described bearing surface 5 is not limited to the reverse tapered surface but may be an inclined surface so that the outer circumference side is positioned on the tip end side with respect to the inner circumference side. For example, it may be a curved R-surface which is recessed toward the tip end as shown in FIG. 20. As shown in FIG. 21, it may be configured that the bearing surface 5 is on the tip end side (lower side in the drawing) from the tool engagement portion 8, and the metal fitting middle body portion 6, which is disposed independent of the tool engagement portion 8, is not provided. In this case, the tool engagement portion 8 can be substantially determined as a metal fitting middle body portion, and there is no problem even if the metal fitting middle body portion 6 is not provided independent of the tool engagement portion 8 as shown in FIG. 16. In other words, the bearing surface 5 is appropriate when the outer circumference side is positioned on the tip end side of the inner circumference side, and as shown in FIG. 21, it is allowed when the metal fitting middle body portion forming the bearing surface 5 is positioned on the inner side of the minimum diameter portion of the tool engagement portion 8.

Meanwhile, the metal fitting-side fitting portion 9 is disposed on the rear end side from the tool engagement portion 8. The metal fitting-side fitting portion 9 serves to fit and hold the insulator 2, and the metal fitting-side fitting portion 9 of this embodiment is configured to fit and hold the insulator 2 by press fitting it. Thus, the insulator 2 is not required to have a large-diameter portion for engaging the caulking portion of the main metal fitting as the prior art does, and the maximum diameter of the spark plug 140 can be reduced. In addition to the press fitting, the insulator 2 may be fitted into the metal fitting-side fitting portion 9 by shrink fitting, cold fitting or a combination of them.

Figure 23:
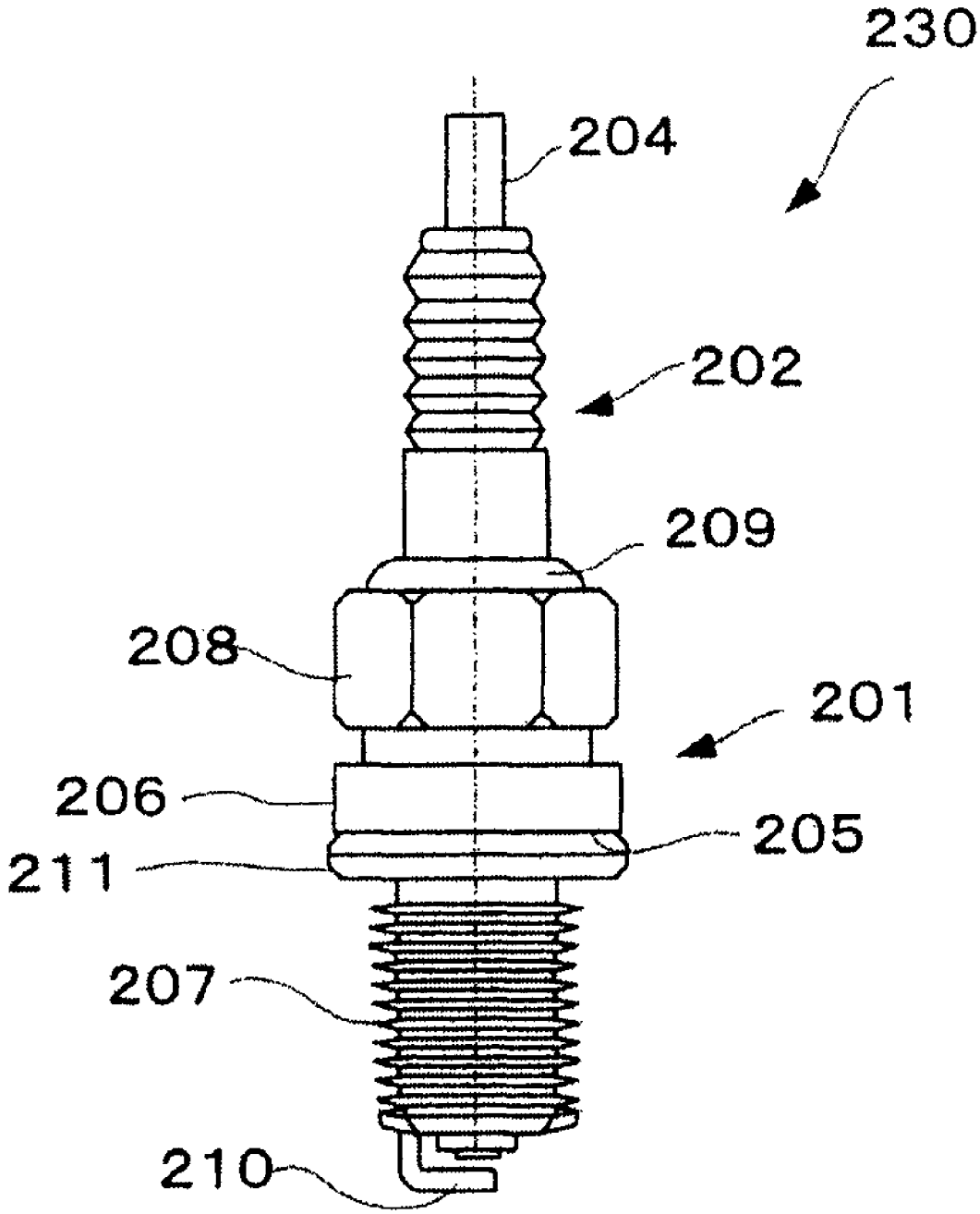
FIG. 23 is a diagram showing the whole structure of a comparative example.

According to this embodiment described above, the outer circumference side which is formed on the metal fitting middle body portion 6 causes to directly contact the bearing surface 5 having an inclined surface, which is positioned on the tip end side of the inner circumference side, to the engine to hold airtightness, so that it is not necessary to dispose a large-diameter portion for pushing with a gasket or the like interposed, and the outer diameter of the metal fitting middle body portion 6 can be made small. Thus, additional downsizing can be made. Direct contact of the above-configured bearing surface to the engine provides tightening torque even if there is adhesion of a lubricant such as oil or the like, and a possibility of occurrence of twist-off due to excessive tightening is not increased. For comparison, FIG. 23 shows a structure of a conventional spark plug 230. The spark plug 230 has an insulator 202 supported by caulking by a caulking portion 209 at the rear end portion of the main metal fitting 201 and a gasket 211 disposed on the side of a bearing surface 205 disposed on the tip end side of a metal fitting middle body portion 206. Since airtightness is formed by pressing with the gasket 211 interposed between the bearing surface 205 and the contact surface of the engine, the metal fitting middle body portion 206 is formed to have a large diameter. In FIG. 23, 204 is a terminal metal fitting, 207 is a threaded portion, 208 is a tool engagement portion, and 210 is a ground electrode.

In this embodiment, the threaded portion 7 has an outer diameter of 8 mm, the outer diameter of the metal fitting middle body portion 6 is larger than that of the threaded portion 7, and the tool engagement portion 8 has a minimum outer diameter of 11 mm which is larger than the outer diameter of the metal fitting middle body portion 6. Thus, the outer diameter of the tool engagement portion 8 becomes substantially the maximum diameter of the main metal fitting 1 and becomes the maximum diameter of the spark plug as the whole. And, the maximum diameter of the spark plug 140 can be made small, and downsizing can be made. Accordingly, the hole for mounting the spark plug 140 formed in the engine block can be made to have a small diameter, and the degree of design freedom of the engine can be enhanced.

When the hardness is high, as described above, workability becomes difficult. Therefore, machining is performed in a relatively workable state (low hardness) to finish into a rough size (maybe a complete size), the hardness is adjusted by hardening, tempering or precipitation hardening, and then finishing is performed to have a formal size. Thus, efficiency is improved. And, where the main metal fitting 1 is produced by plastic working such as cold forging, there is also an efficient method that a material before the cold forging is subjected to the plastic working in a state of low hardness into a certain shape and, at the same time, its work hardening is used to adjust the shape and hardness at the completion of the cold forging.

Where the insulator 2 is press-fitted into the main metal fitting 1, it is desirable to use a lubricating material in the same manner as in the previous embodiment, and it is desirable to perform the heat treatment after the press fitting. And, the spark plug 140 of this embodiment is configured to secure necessary airtightness by the metal fitting-side fitting portion 9.

Figure 22:
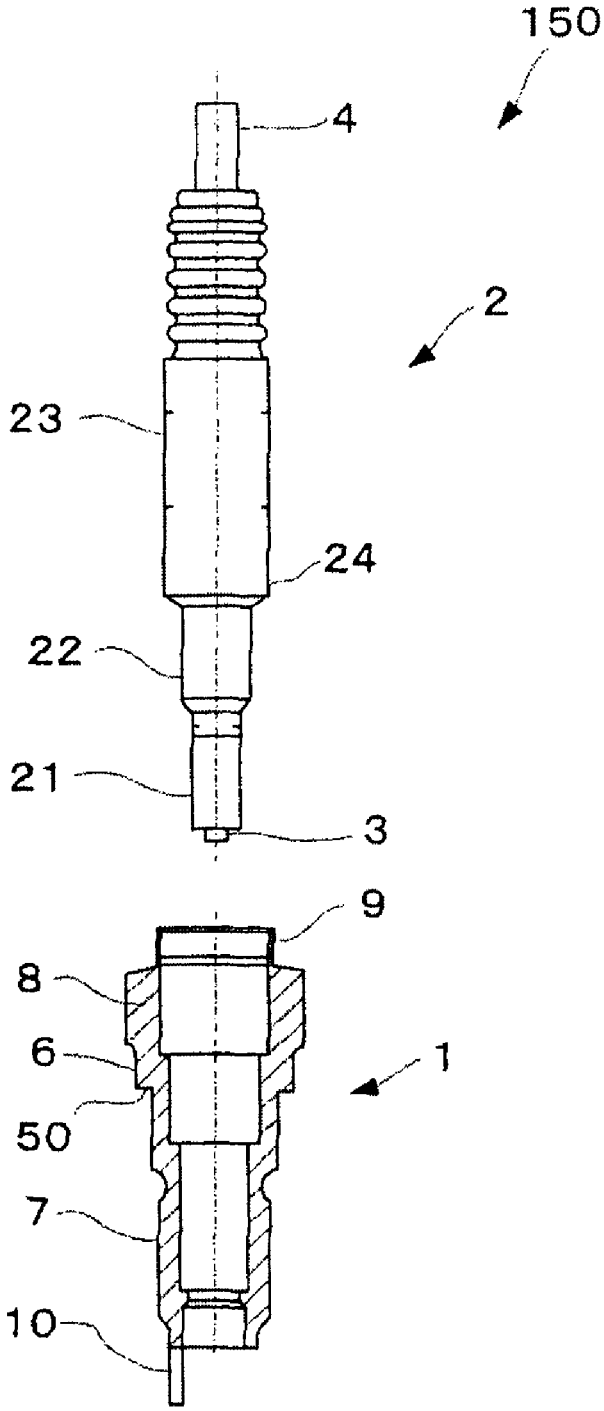
FIG. 22 is a diagram showing the structure of another modified example.

FIG. 22 shows the structure of a spark plug 150 of a modified example. This spark plug 150 has a bearing surface 50 of the metal fitting middle body portion 6 formed to have a plane state which is perpendicular to the axial direction, so that when the spark plug 150 is mounted on an engine, the engine and the plane bearing surface 50 are directly contacted to maintain airtightness. And, in the spark plug 150, the threaded portion 7 has an outer diameter of 8 mm or less, the metal fitting middle body portion 6 has an outer diameter which is larger than the threaded portion 7, and the tool engagement portion 8 has a minimum outer diameter which is larger than the outer diameter of the metal fitting middle body portion 6 and 11 mm or less.

According to the spark plug 150 configured as described above, the same effects as those of the previous embodiment can be obtained, and the bearing surface 50 having a plane surface can be machined relatively easily, and the production process can be simplified.

Figure 24:
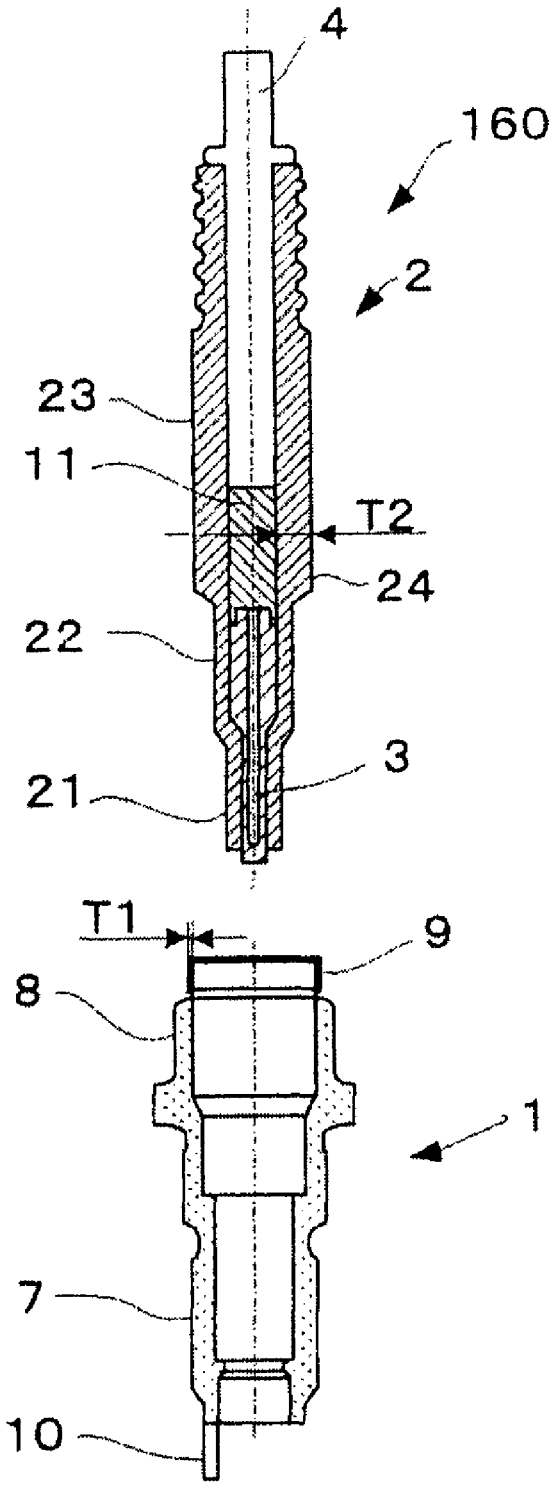
FIG. 24 is a diagram showing a state of the spark plug before press fitting according to a fourth embodiment of the invention.
Figure 25:
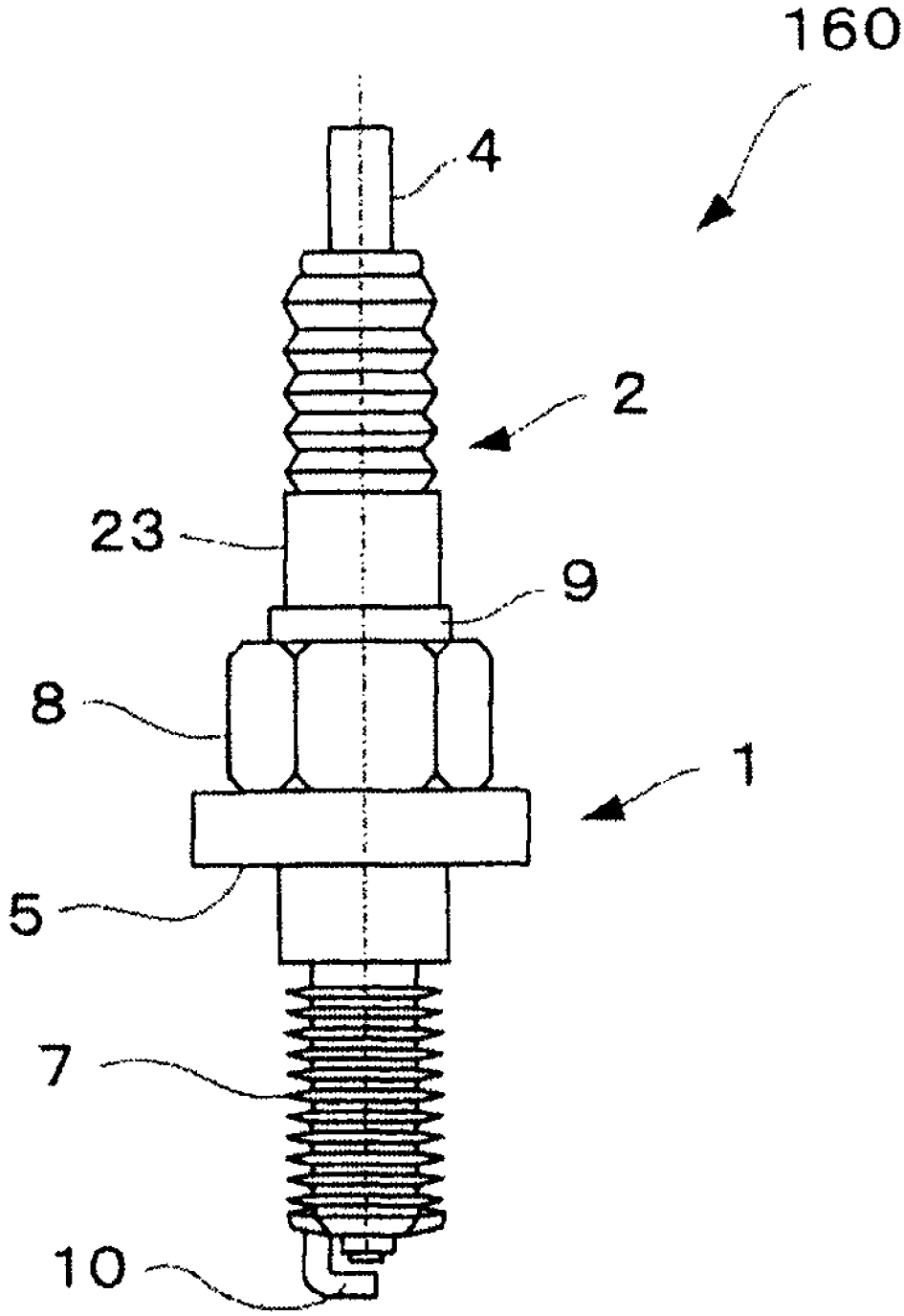
FIG. 25 is a diagram showing a state of the spark plug of FIG. 24 after press fitting.

Then, a fourth embodiment will be described. FIG. 24 shows a state that the insulator is in a state before its attachment to the main metal fitting, and FIG. 25 shows the attached spark plug 160, where like component parts corresponding to those of the previous embodiment are denoted by like reference numerals, and overlapped descriptions will be omitted.

The main metal fitting 1 is formed of metal having a Vickers hardness (a value measured under a load of 10N according to a method specified in JIS 22244 (1988)) in a range of 180 to 500, such as metal of SUS430, SUS630, S45C, S35C, SNCM439 or the like so to have a cylindrical shape. The Vickers hardness indicates a value obtained when the spark plug 160 is completed, and processing such as quenching, annealing or the like may be performed for adjustment after the work hardening or forming in the production process of the main metal fitting 1. The hardness may be measured with the spark plug 160 disassembled.

The metal fitting-side fitting portion 9 is for fitting and holding the insulator 2. The metal fitting-side fitting portion 9 of this embodiment is configured to fit and hold in the radial direction by press fitting the insulator 2. Thus, the same effects as those in the previous embodiment can be obtained.

In this embodiment, the main metal fitting 1 as a whole, including the metal fitting-side fitting portion 9, is made of the metal having a Vickers hardness in a range of 180 to 500 as described above. Thus, a sufficient pull-out load and airtightness can be secured. Specifically, the main metal fittings 1 were configured of metals having different Vickers hardness, and the insulator 2 was press-fitted and pulled out to measure a pull-out load, airtightness and maximum fitting allowance (fitting allowance after pull-out). When the Vickers hardness was less than 180 (Vickers hardness of 155) as shown in Table 1, the pull-out load and airtightness became considerably low, and a sufficient pull-out load and airtightness required for the spark plug could not be secured. Meanwhile, when the Vickers hardness was 500 or more (Vickers hardness of 528), the main metal fitting 1 was cracked by press fitting the insulator 2, and the production of the spark plug became difficult. And, when the main metal fitting 1 was configured of metal having a Vickers hardness in a range of 180 to 500, a sufficient pull-out load and airtightness could be secured. In a case where at least the metal fitting-side fitting portion 9 is determined to have a Vickers hardness in a range of 180 to 500, other parts of the main metal fitting 1 may have a different Vickers hardness. And, the spark plug 160 according to this embodiment is configured to secure airtightness by the metal fitting-side fitting portion 9, so that conventional talc powder or the like which serves as a seal for securing airtightness is not required to be filled, and the structure can be simplified.

TABLE 1

| | | Material | | | | | | |
|---|---|---|---|---|---|---|---|---|
| | | S25C | S35C | SUS 430 | S45C | SUS 630 | SNCM 439 | SNCM 439 |
| | | Hardness HV | | | | | | |
| | | 155 | 180 | 205 | 232 | 455 | 484 | 528 |
| Type 1 | Pull-out load (kg) | 59 | 173 | 251 | | | 480 | Crack in metal fitting |
| | Airtightness (ml/min) | 118 | 15 | 4 | | | 0.1 | |
| | Maximum fitting allowance (μm) | 6 | 20 | 31 | | | 52 | |
| Type 2 | Pull-out load (kg) | | | 625 | 435 | | | |
| | Airtightness (ml/min) | | | 0.1 | 0.1 | | | |
| | Maximum fitting allowance (μm) | | | 32 | 36 | | | |
| Type 3 | Pull-out load (kg) | | | | | 190 | | |
| | Airtightness (ml/min) | | | | | 0.1 | | |
| | Maximum fitting allowance (μm) | | | | | 50 | | |

Figure 26A:
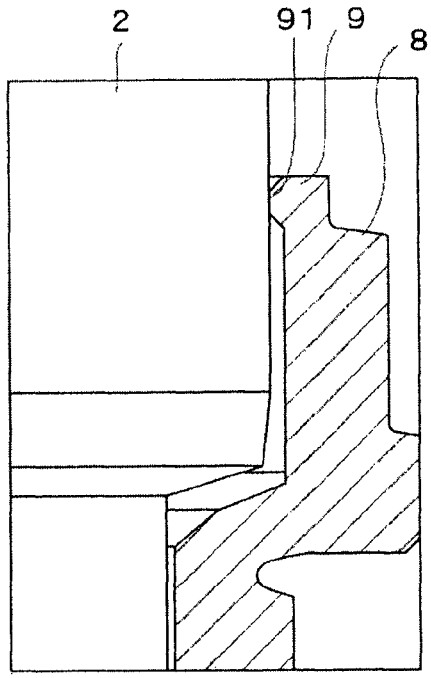
FIG. 26 is a diagram showing a structure example of a metal fitting-side fitting portion.
Figure 26B:
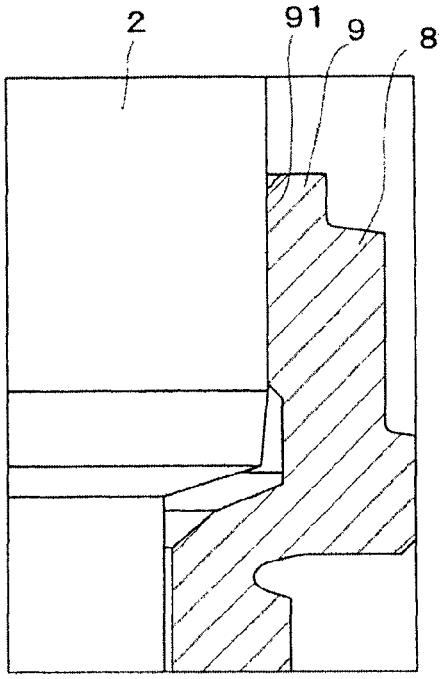
Figure 26C:
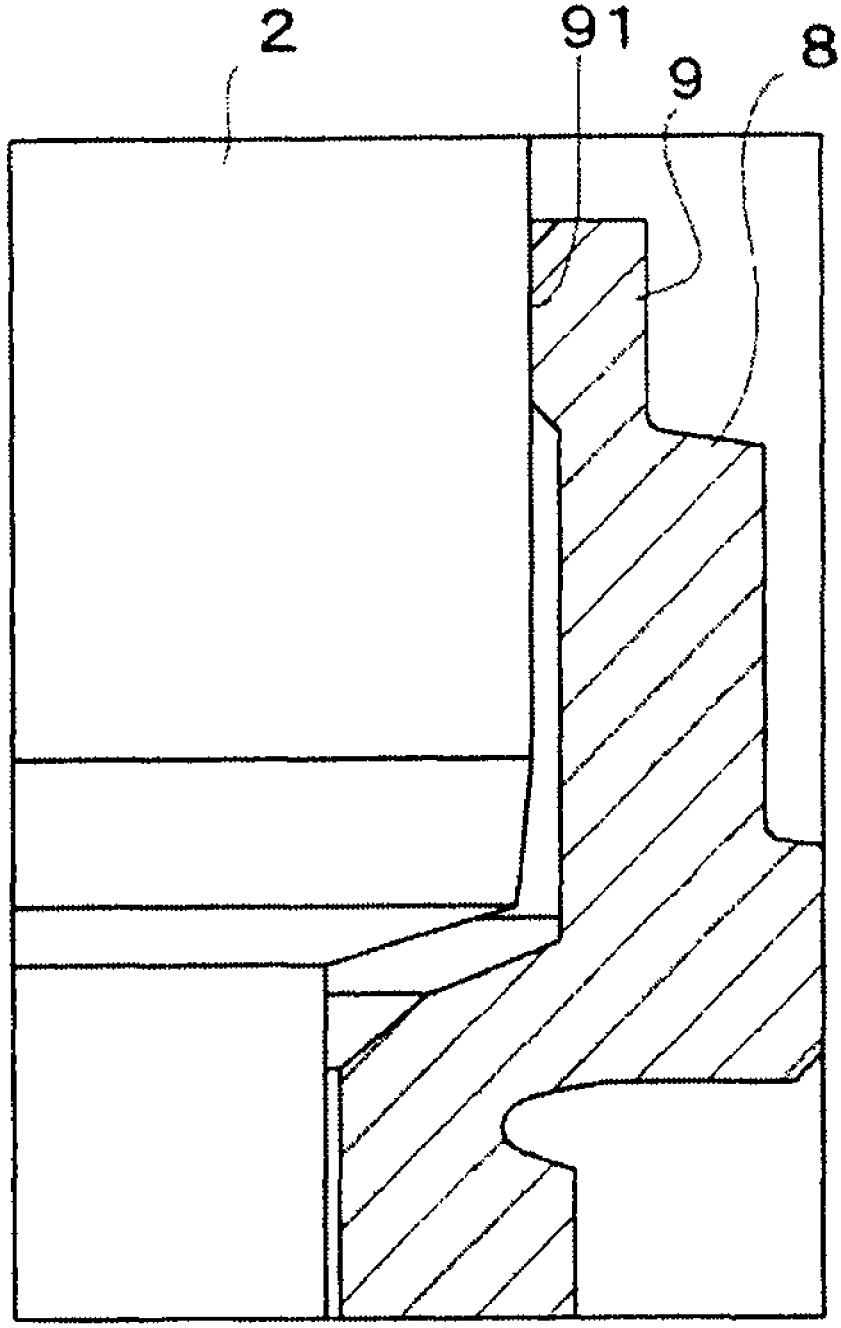

The above measurements were performed on three types such as type 1, type 2 and type 3 of the main metal fitting 1. The type 1 is a type (type (a) shown in FIG. 26) having a metal fitting-side fitting portion inner diameter (substantially equal to the outer diameter of the insulator) of 10 mm and a contact portion 91 in contact with the insulator 2 in the metal fitting-side fitting portion 9 having a length of 1 mm, the type 2 is a type (type (b) shown in FIG. 26) having a metal fitting-side fitting portion inner diameter of 10 mm and a contact portion 91 in contact with the insulator 2 in the metal fitting-side fitting portion 9 having a length of 6 mm, and the type 3 is a type (type (c) shown in FIG. 26) having a metal fitting-side fitting portion inner diameter of 8 mm and the contact portion 91 in contact with the insulator 2 in the metal fitting-side fitting portion 9 having a length of 3 mm. And, for SNCM439, hardness was adjusted with a tempering temperature varied using a quenched and tempered material.

As shown in Table 1, when the metal fitting-side fitting portion has a Vickers hardness of less than 180, a pull-out load is small, and airtightness is poor. Meanwhile, if the Vickers hardness exceeds 500, the main metal fitting is cracked. Therefore, the metal fitting-side fitting portion of the invention is determined to have a Vickers hardness of 180 or more and 500 or less.

As shown in Table 1, when the metal fitting-side fitting portion has a Vickers hardness of 180 or more and 500 or less, a good spark plug can be provided without deterioration of airtightness due to an insufficient pull-out load even if the metal fitting-side fitting portion becomes long and the metal fitting-side fitting portion has an inner diameter of 8 mm. It is desirable that the metal fitting-side fitting portion has a length in the axial direction determined to be a lower limit of 1 mm and an upper limit of nearly equal to that of the metal fitting-side fitting portion inner diameter (namely, 10 mm for the type 1).

It is desirable that the metal fitting-side fitting portion 9 of the main metal fitting 1 has a minimum thickness (T1 shown in FIG. 24) of 0.25 mm or more. If the thickness is smaller than the above level, productivity becomes poor. And, the insulator 2 which is fitted into the metal fitting-side fitting portion 9 of the main metal fitting 1 by press fitting preferably has a thickness (T2 shown in FIG. 24) of 1 mm or more at the fitted portion. It is because the insulator 2, which is made a brittle material, is possibly broken by an action of a tightening force caused by fitting. Such a breakage can be prevented from occurring by having the thickness of 1 mm or more.

When it is assumed that the outer diameter of the insulator 2 is d1 and the inner diameter of the metal fitting-side fitting portion 9 is d2 after the insulator 2 is pulled out from the metal fitting-side fitting portion 9 of the main metal fitting 1, a value of d1-d2 (fitting allowance after pull-out) is desirably in a range of 6 μm to 200 μm. Reasons thereof are as follows.

Generally, the insulator 2 is formed of alumina and has thermal expansion of 6 to $8\times10^{-6}$/° C. The main metal fitting 1 is formed of an alloy having Fe as a main component and its thermal expansion is 10 to $17\times10^{-6}$/° C. A fitting diameter is 3.5 to 15 mm, and the metal fitting-side fitting portion has a maximum temperature of about 250° C. Among general combinations, the necessary fitting allowance becomes minimum when alumina has $8\times10^{-6}$/° C., the main metal fitting has $10\times10^{-6}$/° C. and the fitting diameter is 3.5 mm, and a necessary fitting allowance is 2 μm when the maximum temperature is 250° C. And, the necessary fitting allowance becomes maximum when alumina has $6\times10^{-6}$/° C., the main metal fitting has $17\times10^{-6}$/° C. and the fitting diameter is 15 mm, and a necessary fitting allowance is 41 μm when the maximum temperature is 250° C. It is a necessity minimum value, and when it is assumed that a safe rate is 3, the minimum fitting allowance is 6 μm, and the maximum fitting allowance is 123 μm. Even if the fitting allowance is 123 μm or more, there is no problem because the safe rate increases, but if it is greater than, for example, 200 μm, the insulator 2 is under strain. Therefore, the value of d1-d2 (fitting allowance after pull-out) is desirably in a range of 6 to 200 μm.

To produce the spark plug 160, it is assumed that the outer diameter of the insulator 2 before the insulator 2 is press fitted into the metal fitting-side fitting portion 9 of the main metal fitting 1 is D1, and the inner diameter of the metal fitting-side fitting portion 9 is D2, a value of D1-D2 (initial fitting allowance) is preferably in a range of 6 to 300 μm. In other words, a necessary minimum fitting allowance is 6 μm as described above. It is because if the initial fitting allowance exceeds 300 μm, the press-fitting load becomes high, and there is a possibility that the insulator 2 is cracked.

Where the insulator 2 is press fitted into the main metal fitting 1, the lubricating material is desirably used in the same manner as in the previous embodiment, and it is desirable to perform a heat treatment after the press fitting.

Figure 27:
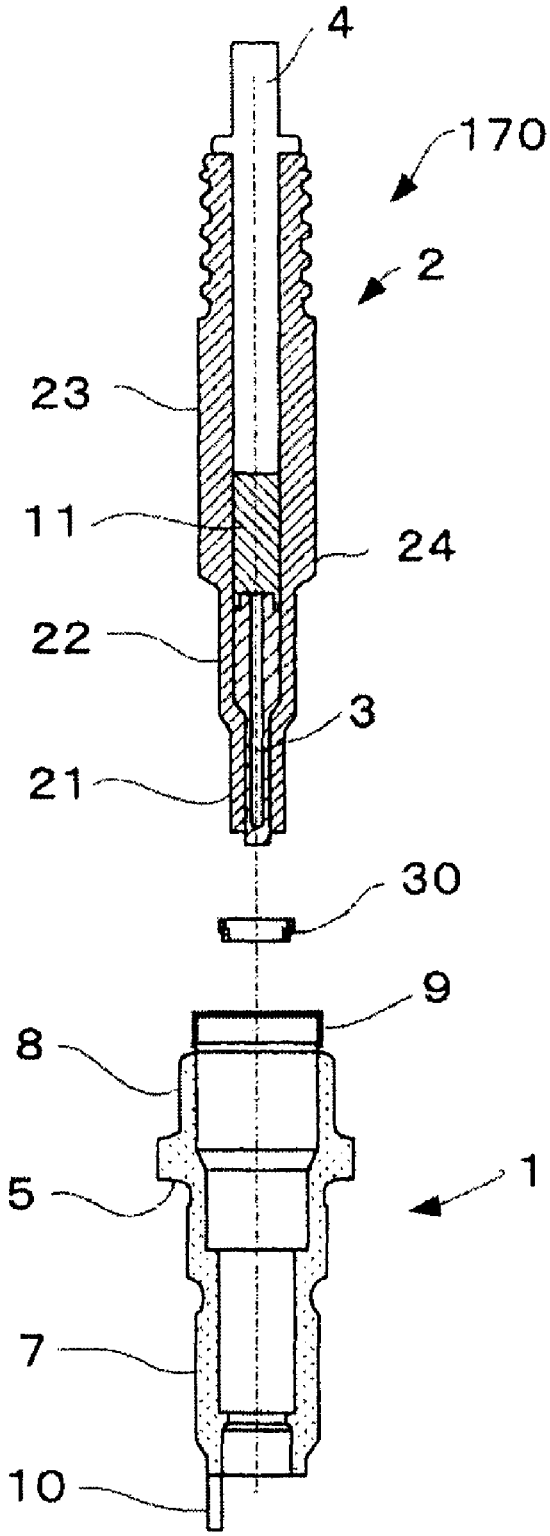
FIG. 27 is a diagram showing a state of the spark plug before press fitting according to a fifth embodiment of the invention.

Then, a fifth embodiment will be described. FIG. 27 shows a state that the insulator is in a state before its attachment into the main metal fitting, and like component parts corresponding to those of the previous embodiment are denoted by like reference numerals, and overlapped descriptions will be omitted. The spark plug 170 is provided with a substantially cylindrical main metal fitting 1, a substantially cylindrical insulator 2 which is fitted into the main metal fitting 1 such that its tip end portion is projected, and a ring shaped member 30 which is interposed between them.

Figure 28:
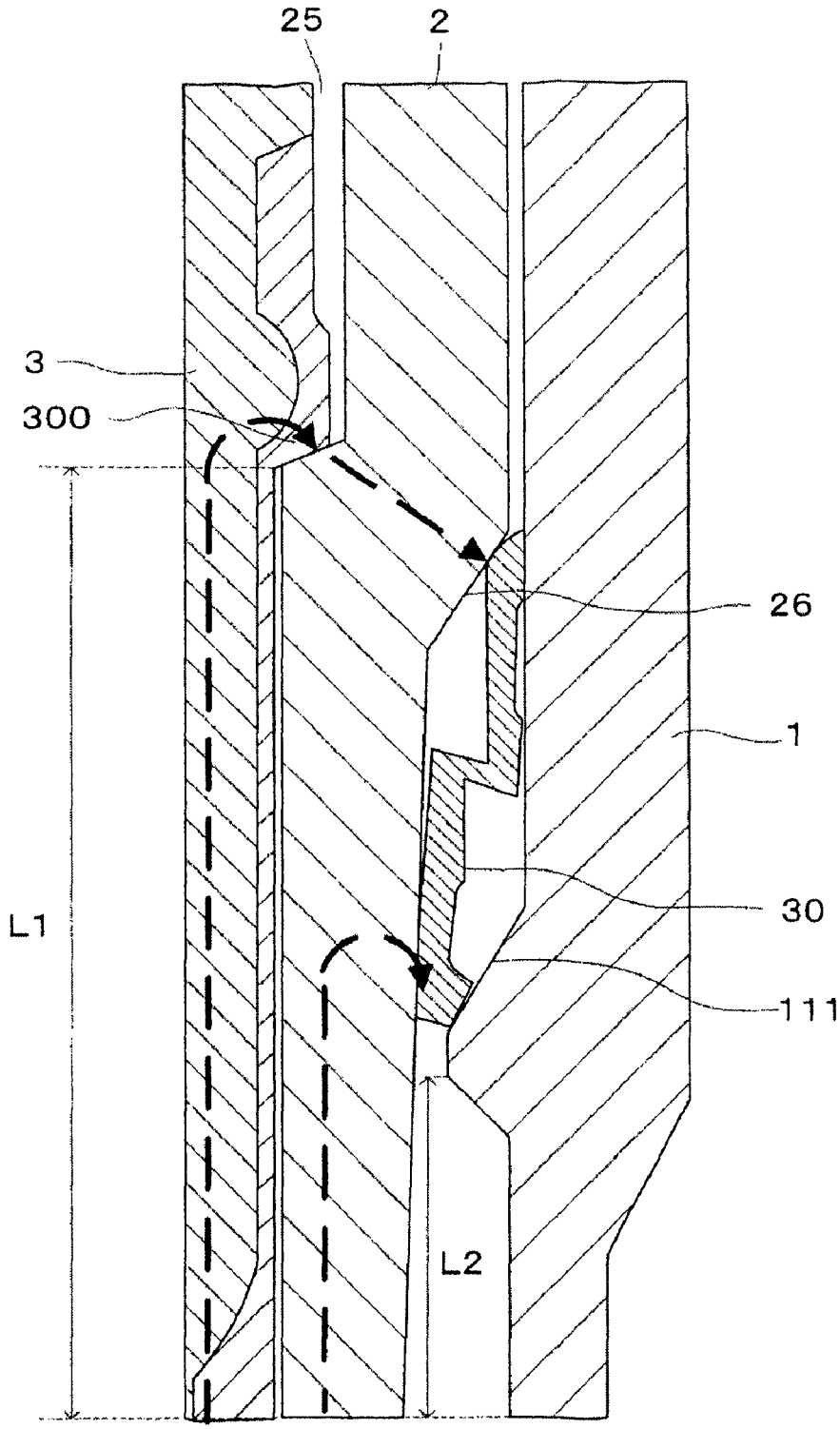
FIG. 28 is a diagram showing in a magnified fashion the structure of a main portion of the spark plug of FIG. 27.

As shown in FIG. 28, a through hole 25 for fitting of the center electrode 3 is formed in the insulator 2 along its axial direction. And, the terminal metal fitting 4 is inserted and fixed in one of end sides of the through hole 25, and the center electrode 3 is also inserted and fixed in the other end side.

The metal fitting-side fitting portion 9 is for fitting and holding the insulator 2, and the metal fitting-side fitting portion 9 of this embodiment fits and holds the insulator 2 in the radial direction by press fitting it. Thus, the above-described effects can be obtained. When press fitting, it is desired to use a lubricating material, and it is desired to perform a heat treatment after the press fitting.

The ring shaped member 30 is formed of a highly heat conductive metal, for example, copper, aluminum or the like, and interposed between the main metal fitting 1 and the insulator 2 as shown in FIG. 28. The disposed position of the ring shaped member 30 in the axial direction is between the bearing surface 5 of the main metal fitting 1 and the tip end of the main metal fitting 1 shown in FIG. 27. And, the ring shaped member 30 forms a heat release path for heat radiation from the insulator 2 to the main metal fitting 1 as indicated by arrows with dotted lines in the drawing at plural positions (two in FIG. 28) of the insulator 2 separated in the axial direction as shown in FIG. 28.

Thus, there is formed the heat release path for indirect heat radiation from the insulator 2 to the main metal fitting 1 via the ring shaped member 30 at not less than two positions separated in the axial direction in a longitudinal cross section of the insulator 2 between the bearing surface 5 of the main metal fitting 1 and the tip end of the main metal fitting 1. Therefore, heat radiation can be controlled with high accuracy, and a wide range can be realized without deteriorating an antifouling property. Specifically, the heat release path at a lower side (the tip end side) in FIG. 28 mainly radiates heat from the tip end portion of the insulator 2 to the main metal fitting 1 as indicated by a broken lined arrow in the drawing. And, the heat release path at the upper part in FIG. 28 is disposed adjacent to a collar portion 300 of the center electrode 3 to connect the center electrode 3 and the resistor and mainly radiates heat from the center electrode 3 containing a highly heat conductive copper core to the main metal fitting 1 as indicated by a broken lined arrow. Thus, the temperatures of the above portions can be controlled to desired temperatures in accordance with desired thermal values, and a wide range can be realized with the occurrence of preignition or the like prevented. And, since it is not necessary to decrease the length of a gas pocket, an antifouling property such as smoldering or the like is not deteriorated.

When the insulator 2 is press fitted into the main metal fitting 1, the ring shaped member 30 is interposed between them. As shown in FIG. 28, a metal fitting-side step portion 111 is disposed on the inside part of the main metal fitting 1 to project inward so to catch the ring shaped member 30. An insulator-side step portion 26 is disposed on the outside part of the insulator 2 to project outwardly. And, the ring shaped member 30 is held between the metal fitting-side step portion 111 and the insulator-side step portion 26. Since the insulator 2 is pushed in the axial direction by a pressing force, the ring shaped member 30 is deformed to expand in the radial direction to come into close contact elastically with the outside of the insulator 2 and the inside of the main metal fitting 1. Thus, the ring shaped member 30, the main metal fitting 1 and the insulator 2 are contacted airtight to secure good heat conductance. As described above, this embodiment secures airtightness by the metal fitting-side fitting portion 9. Therefore, even if the ring shaped member 30 is disposed between the insulator 2 and the main metal fitting 1 to elastically push them, airtightness is not deteriorated.

A verification test was performed to compare the spark plug 170 of this embodiment shown in FIG. 27 and a conventional spark plug in a state of thermal conductivity. The test was performed with a glow plug (about 50 W: 12V application) disposed as a heater at a position to face the tip end of the plug electrode with a space of 0.5 mm therebetween by measuring a temperature with a thermocouple contacted to a portion to be measured (insulator tip end portion and ignition portion). Neighborhood of the tip end of the plug was heated with the heater, and a saturation temperature was measured because the saturation temperature was different depending on a difference in heat radiation property of the received heat quantity to determine whether the heat radiation property was good or not.

For comparison under the same conditions, the used insulator 2 and main metal fitting 1 were assembled so that a distance L1 from the tip end of the insulator 2 to a portion supporting the collar portion of the center electrode 3 was 11.4 mm, and a distance L2 from the tip end of the main metal fitting 1 to the inside projected part was 5.4 mm as shown in FIG. 28. The assembled plug was mounted on an aluminum block, which was assumed as an engine to perform the test. As a result, the conventional insulator tip end portion had a temperature of 229° C., while the present embodiment had a temperature of 221° C. For the temperature of the center electrode tip end portion (ignition portion), the conventional product was 158° C., while the present embodiment was 114° C. Thus, improvement of the heat radiation property was confirmed.

Figure 29:
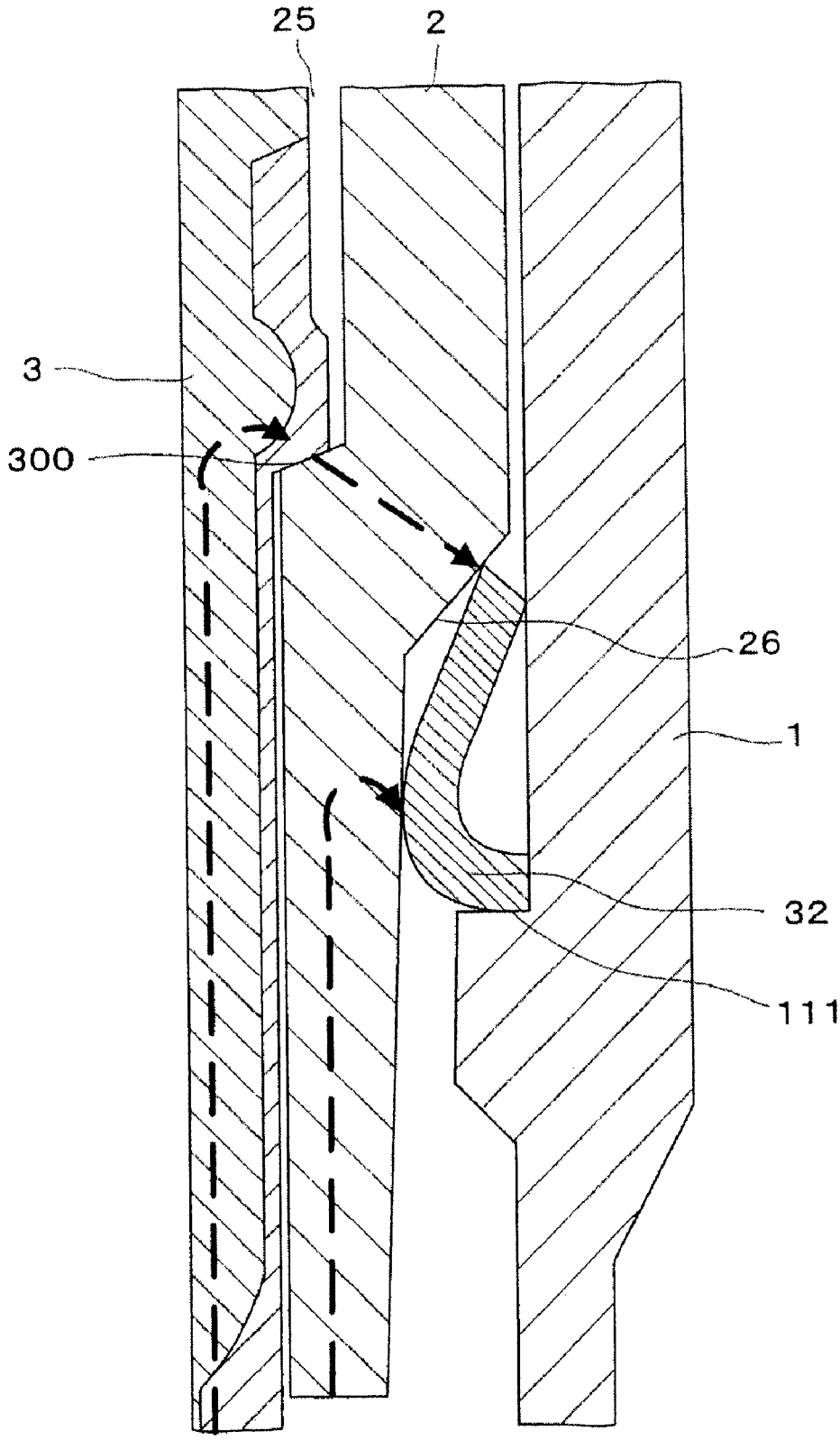
FIG. 29 is a diagram showing in a magnified fashion the structure of a main portion of a modified example.
Figure 30:
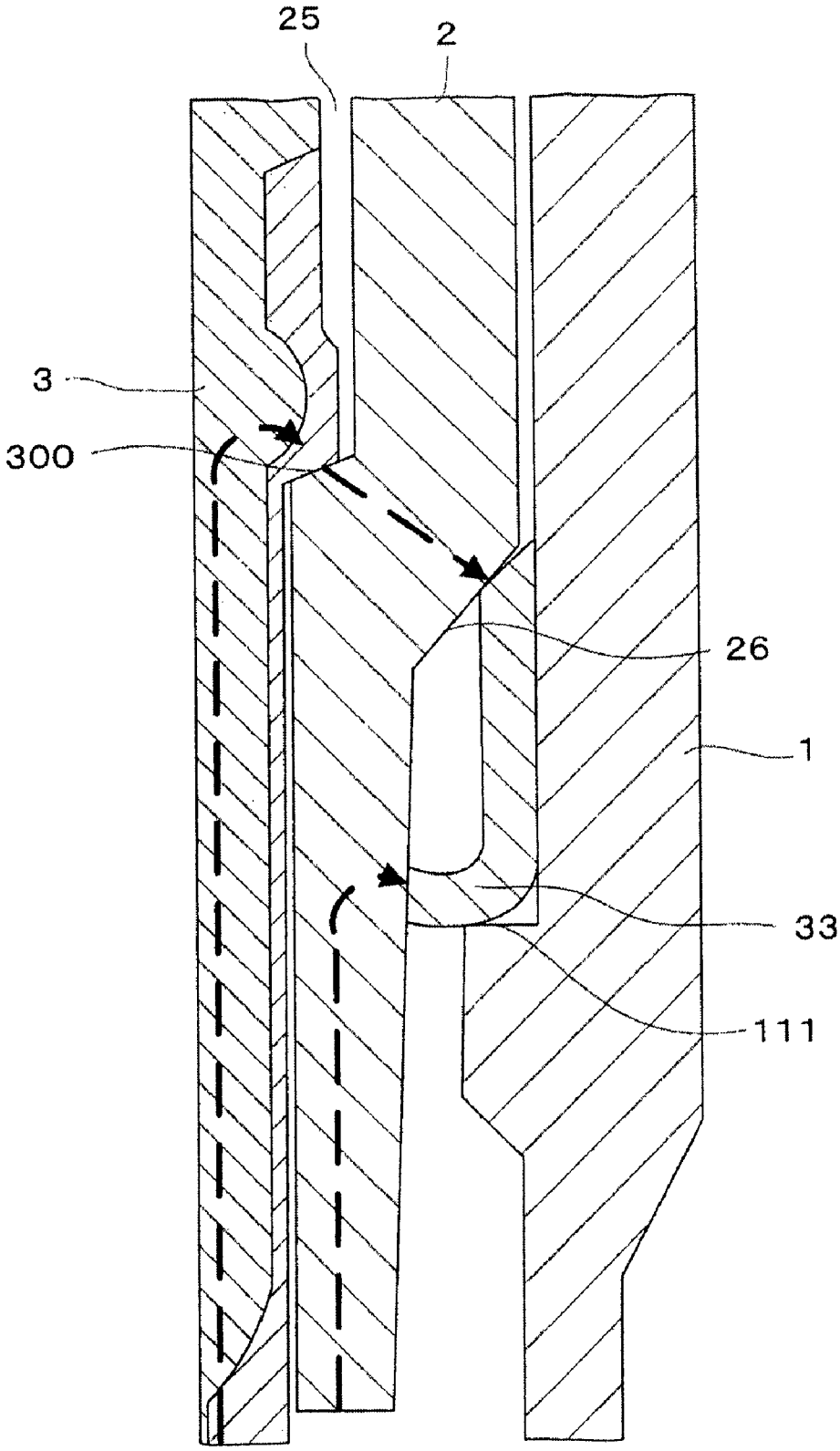
FIG. 30 is a diagram showing in a magnified fashion the structure of a main portion of a modified example.
Figure 31:
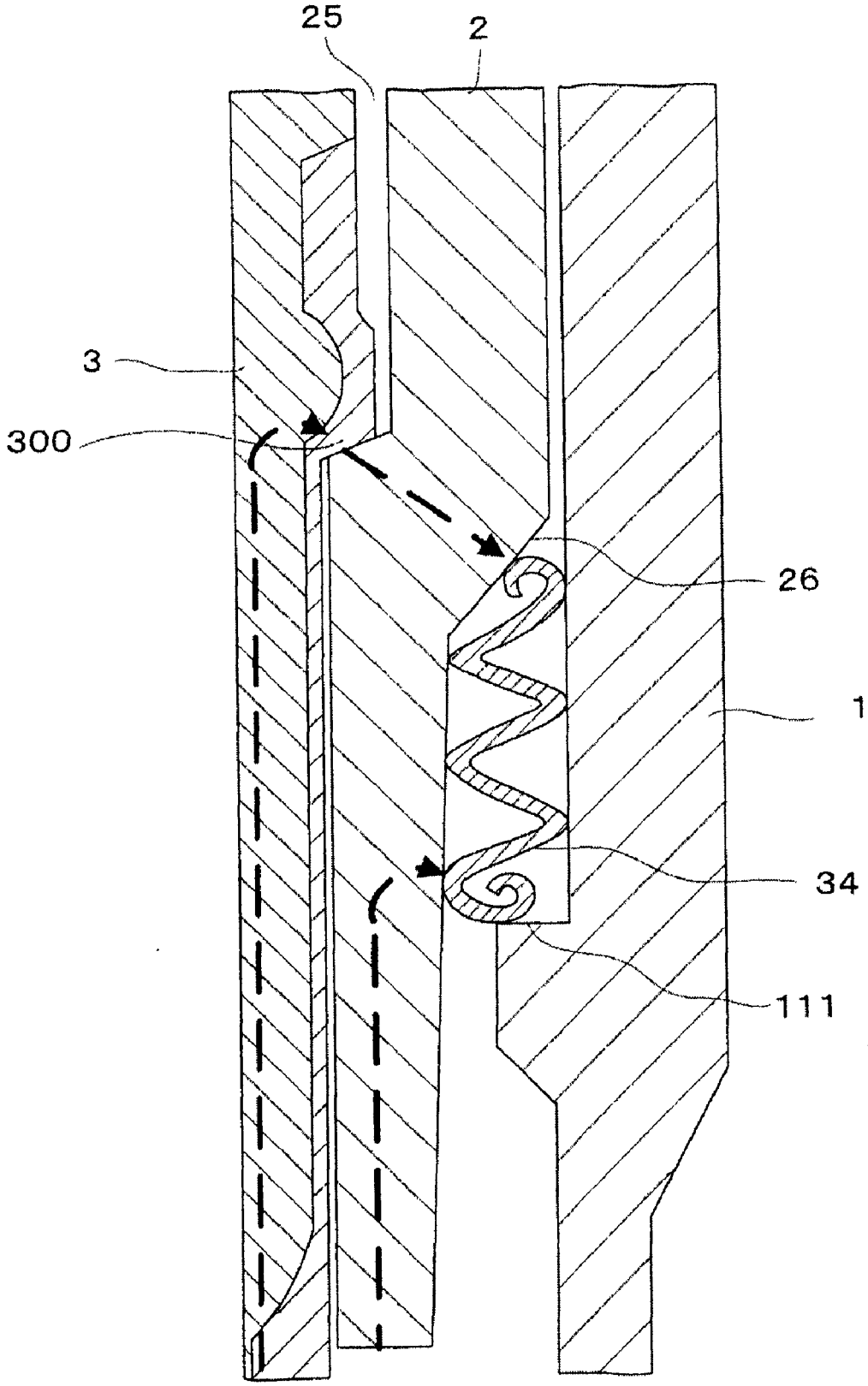
FIG. 31 is a diagram showing in a magnified fashion the structure of a main portion of a modified example.
Figure 32:
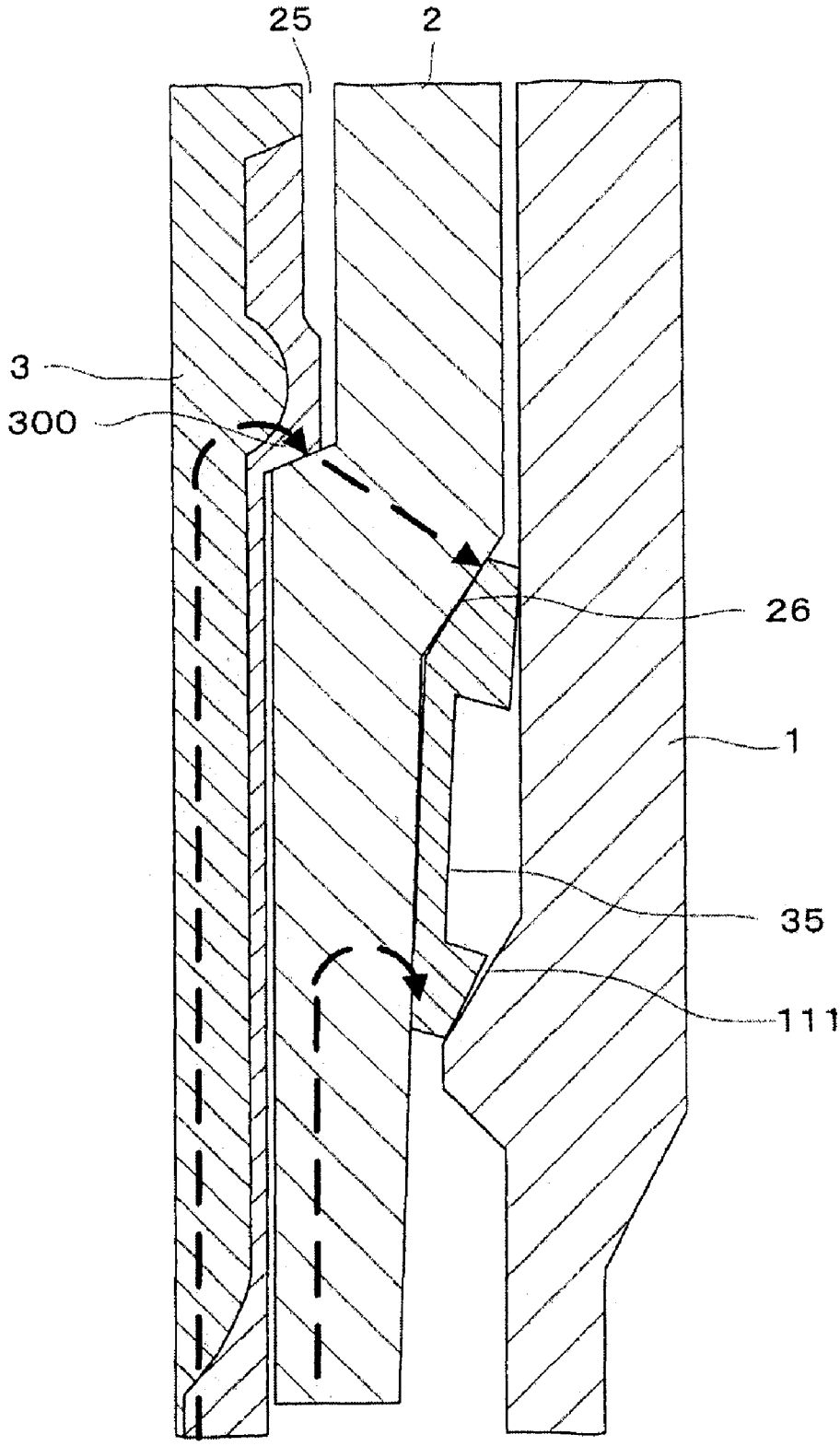
FIG. 32 is a diagram showing in a magnified fashion the structure of a main portion of a modified example.
Figure 33:
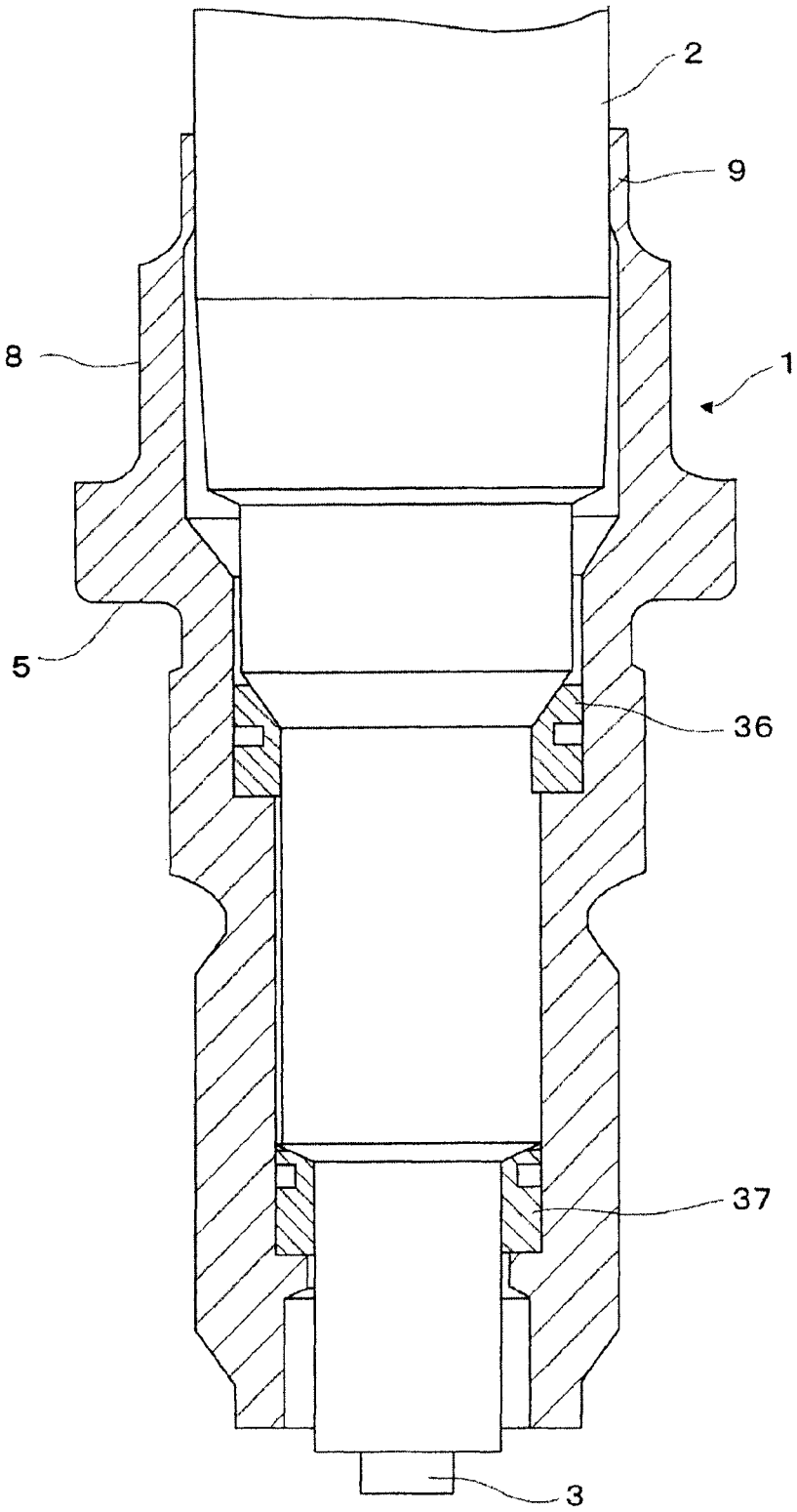
FIG. 33 is a diagram showing in a magnified fashion the structure of a main portion of a modified example.

FIGS. 29, 30, 31 and 32 show examples of using ring shaped members 32, 33, 34 and 35 having a shape different from the ring shaped member 30 shown in FIG. 28. The ring shaped member 32 shown in FIG. 29 is formed to have a substantially C-shaped cross section, namely shaped to project inward in the radial direction and to recess outward in the radial direction. The ring shaped member 33 shown in FIG. 30 is formed to have a substantially J-shaped cross section, namely shaped to recess inward in the radial direction and to project outward in the radial direction as if the ring shaped member 30 shown in FIG. 29 is reversed. The ring shaped member 34 shown in FIG. 31 is formed to have a zigzag cross section so to provide a heat release path at three or more positions (four in FIG. 31), which are separated in the axial direction. And, the cross sectional shape may be a substantially square C-shaped form as indicated by the ring shaped member 35 shown in FIG. 32. Besides, the ring shaped member can be varied to have various shapes in addition to the above-described shapes. For example, as shown in FIG. 33, individual heat release paths separated in the axial direction may be formed by plural (two in FIG. 33) ring shaped members 36, 37 which are separately disposed at positions with a space therebetween in the axial direction of the insulator 2.

The embodiments of FIGS. 30 and 31 have the ring shaped member with an arch middle portion in contact with the insulator and the main metal fitting, but the end portion of the ring shaped member may be chamfered to have an arch shape. In other words, the ring shaped member may be changed appropriately so that a possibility of breaking the insulator is decreased and its shape becomes advantageous for thermal conductivity.

Figure 34:
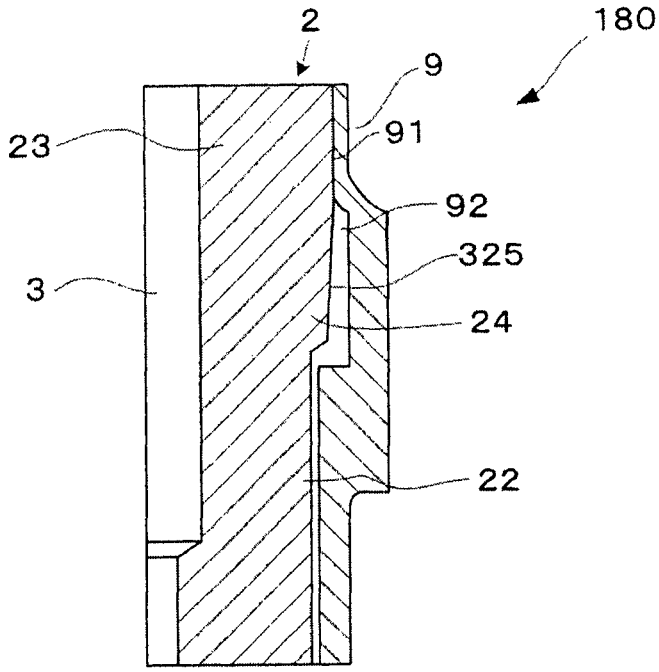
FIG. 34 is a diagram showing in a magnified fashion the structure of a main portion of the spark plug according to a sixth embodiment of the invention.
Figure 35:
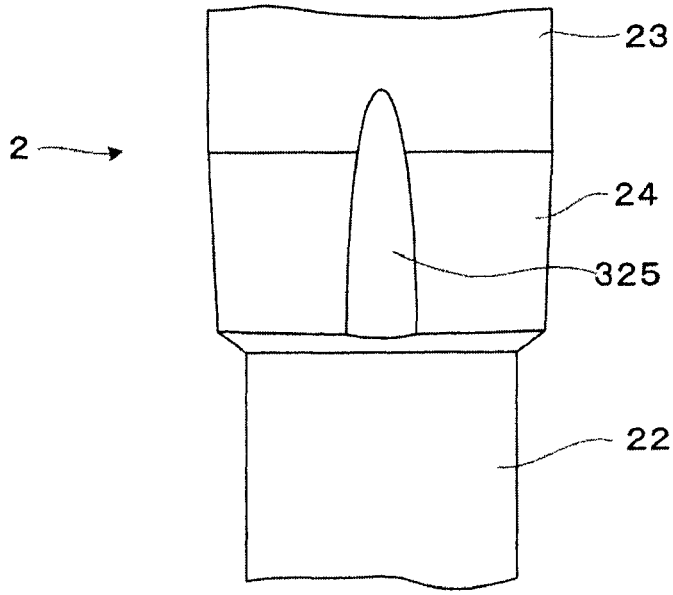
FIG. 35 is a diagram showing in a magnified fashion the structure of a gas release portion of the spark plug of FIG. 34.

Then, a sixth embodiment with a gas release portion provided will be described with reference to FIGS. 34 and 35. Like component parts corresponding to those of the previous embodiment are denoted by like reference numerals, and overlapped descriptions will be omitted. A spark plug 180 of this embodiment has a gas release portion 325 which is formed in a part of the substantially cylindrical insulator 2 in the circumferential direction by cutting the insulator 2 in the axial direction as shown in FIGS. 34 and 35. The gas release portion 325 is formed in the introductory part for press-fitting 24 and a part of the large-diameter portion 23 on the rear end side of the introductory part for press-fitting 24. The gas release portion 325 is configured so that it is normally located below the metal fitting-side fitting portion 9, and when the insulator 2 is moved to almost come out of the metal fitting-side fitting portion 9 by a pressure or the like from the inside of the engine, the section of the gas release portion 325 is projected to the upper side of the metal fitting-side fitting portion 9 to communicate the interior of the spark plug 180 with the outside so to release the pressure to the outside. Thus, a situation that the insulator 2 is completely removed from the main metal fitting 1 by the pressure from the inside can be prevented.

As shown in FIG. 35, the gas release portion 325 and its boundary portion with the circumference are formed to have a curved shape. Thus, when the insulator 2 is press-fitted into the main metal fitting 1, burrs or the like can be prevented from generating, and airtightness or a supporting force can be prevented from decreasing due to the generation of burrs or the like. When both the pull-out preventive mechanisms shown in FIG. 9 and FIG. 10 and the gas release portion 325 are disposed, the insulator 2 can be prevented more securely from being popped out.

Figure 36:
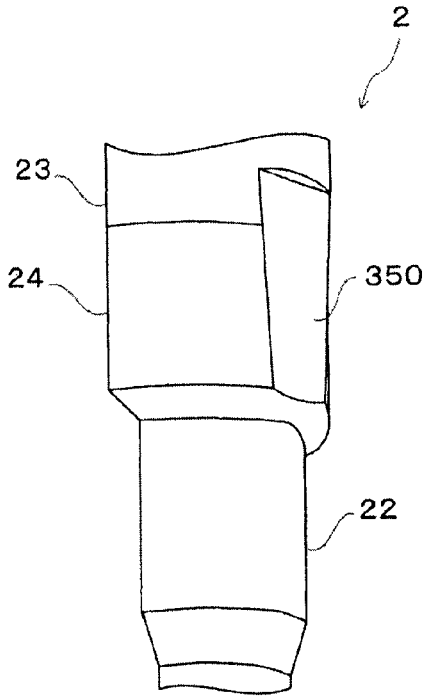
FIG. 36 is a perspective view showing in a magnified fashion the structure of a modified example of the gas release portion.
Figure 37:
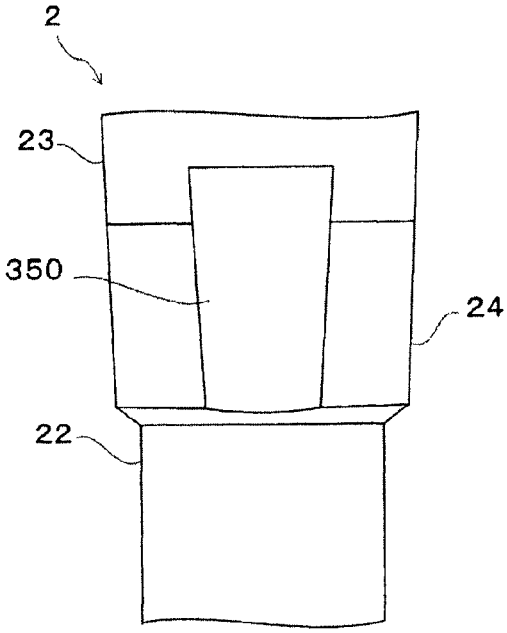
FIG. 37 is a front view of the gas release portion of FIG. 36.

The shape of the gas release portion 325 is not limited to the one shown in FIG. 35, but it may be a gas release portion 350 having the shape shown in FIGS. 36 and 37.

Figure 38:
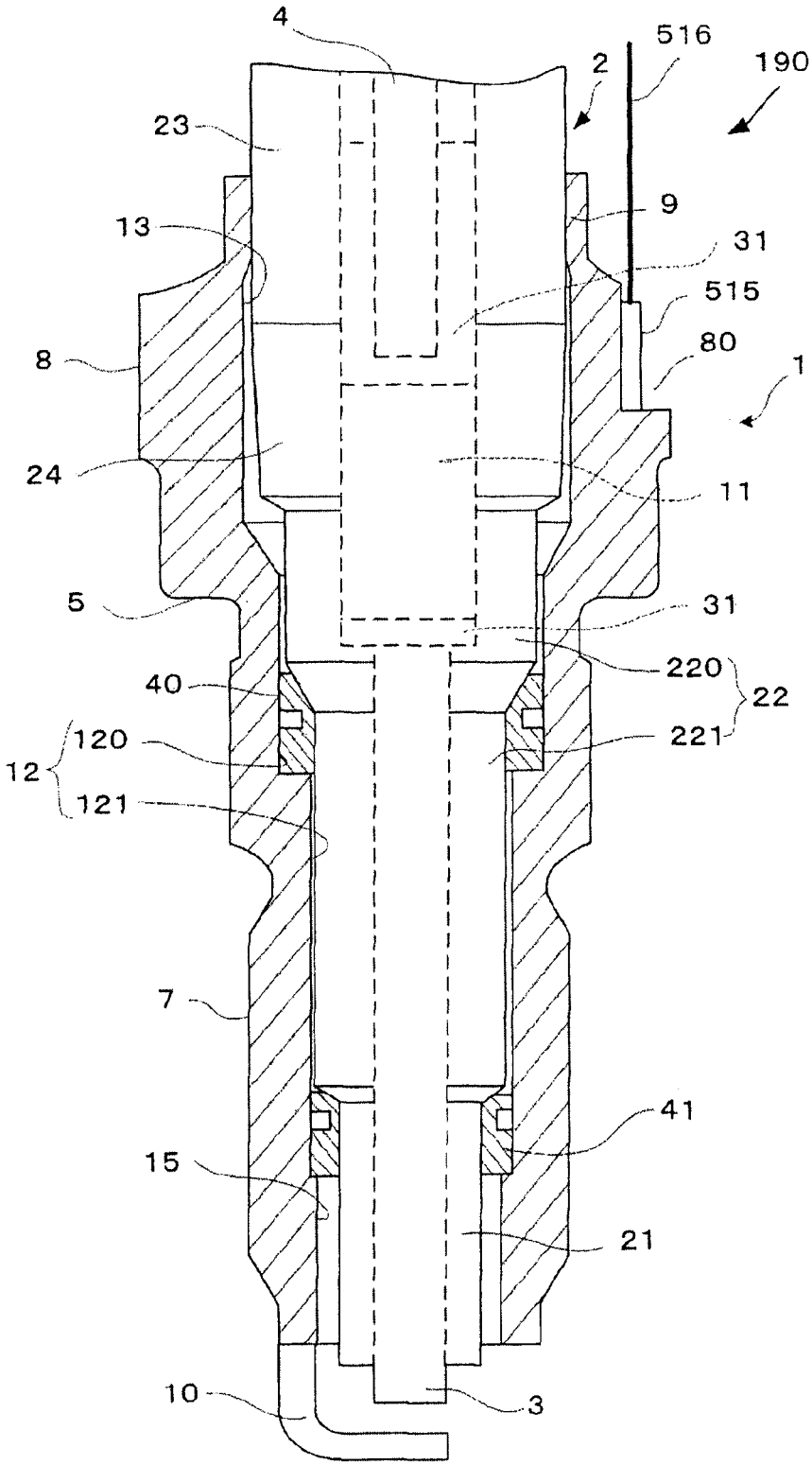
FIG. 38 is a diagram showing in a magnified fashion the structure of a main portion of the spark plug according to a seventh embodiment of the invention.
Figure 39:
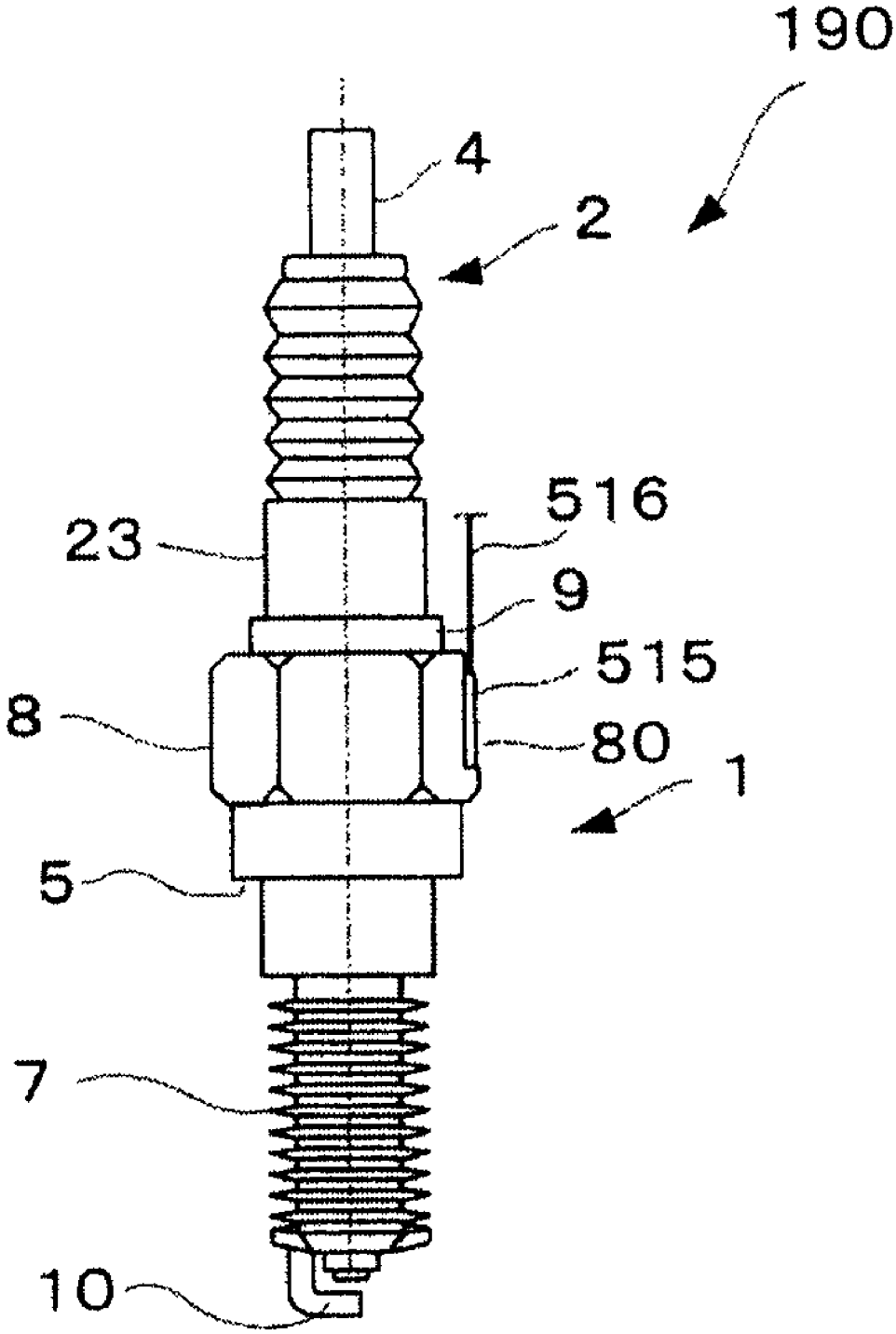
FIG. 39 is a diagram showing the whole structure of the spark plug of FIG. 38.

A seventh embodiment of the invention will be described. FIG. 38 shows in a magnified fashion the sectional structure of the main portion of a spark plug 190 according to this embodiment, and FIG. 39 shows the whole outside view of the spark plug 190. Like component parts corresponding to those of the previous embodiment are denoted by like reference numerals, and overlapped descriptions will be omitted.

The metal fitting-side fitting portion 9 is to fit and hold the insulator 2, and the metal fitting-side fitting portion 9 of this embodiment is configured to fit and hold the insulator 2 in the radial direction by press fitting it. The metal fitting-side fitting portion 9 configures a sealing part of the invention, and airtightness between the main metal fitting 1 and the insulator 2 is retained by the metal fitting-side fitting portion 9.

Figure 40:
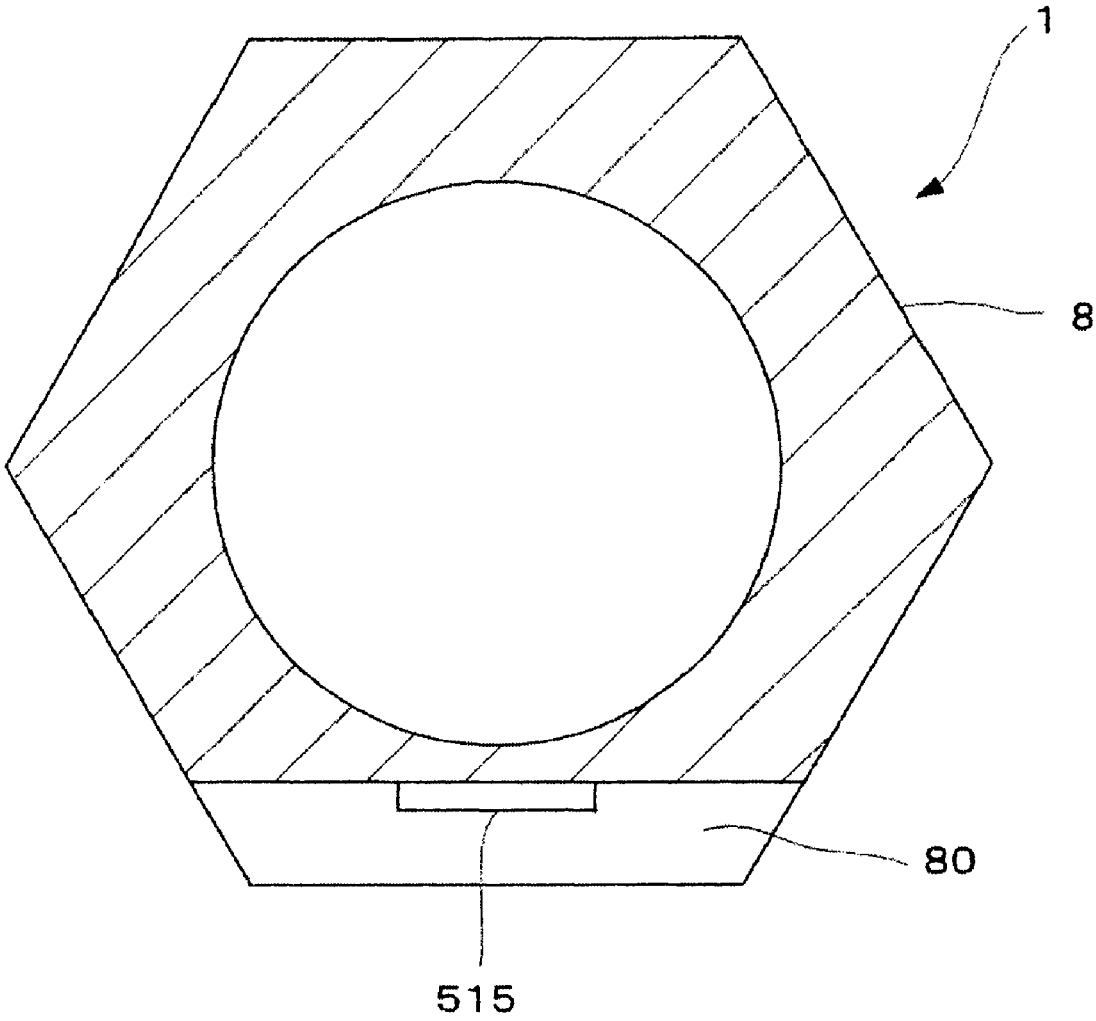
FIG. 40 is a diagram showing in a magnified fashion the structure of the main portion of the spark plug of FIG. 38.

In this embodiment, the tool engagement portion 8 has a substantially hexagonal outer shape as shown in FIG. 40, and a pressure detection sensor placement position 80 is formed on its one surface by making the thickness of the base material of the main metal fitting 1 thinner than the other part of the tool engagement portion 8. And, the pressure detection sensor placement position 80 is provided with a pressure detection sensor 515. As shown in FIGS. 38 and 39, a shield wire 516 for taking a detected signal is connected to the pressure detection sensor 515. As the pressure detection sensor 515, a sensor which is formed of, for example, a resistance strain gauge, a semiconductor strain gauge, a piezoelectric element, quartz or the like and can detect distortion of the main metal fitting 1 can be used.

Thus, the pressure detection sensor 515, which detects a combustion pressure from the deformation of the main metal fitting 1 generated depending on the combustion pressure of the internal combustion engine, is disposed on the tip end side from the metal fitting-side fitting portion 9, which is a sealing part for sealing the main metal fitting 1 and the insulator 2 airtight, and the outside of the main metal fitting 1. Thus, the interior of the main metal fitting 1 and the internal combustion engine are communicated on the tip end side of the metal fitting-side fitting portion 9, so that the combustion pressure deforms directly the main metal fitting 1 from its inside, and the combustion pressure can be measured directly according to the deformation. And, there is no application of noise resulting from oscillation or the like of the insulator 2 due to the vibration of the internal combustion engine. Thus, the generation of noise when the combustion pressure is measured can be reduced in comparison with the prior art, and the accuracy of measurement of the combustion pressure can be improved by improvement of an S/N ratio.

The metal fitting-side fitting portion 9 may be configured to hold the insulator 2 and to secure airtightness by any of, for example, shrink fitting, cold fitting and brazing in addition to the above-described press fitting. Regardless of which method is used to perform mechanical holding of the insulator 2 and holding of its airtightness, the metal fitting-side fitting portion 9 which is a sealing part is disposed at the rear end portion of the tool engagement portion 8, so that the pressure detection sensor 515 can be disposed at any portion of the tip end side of the metal fitting-side fitting portion 9. Thus, flexibility of the portion where the pressure detection sensor 515 is disposed can be enhanced.

In the above case, it is desirable to dispose the pressure detection sensor 515 on the rear end side from the bearing surface 5 for mounting the main metal fitting 1 which seals airtight in contact with the internal combustion engine when mounted on the internal combustion engine as in this embodiment. Thus, an influence of a stress applied when the spark plug 190 is mounted on the internal combustion engine can be prevented from being applied to the pressure detection sensor 515.

To dispose the pressure detection sensor 515 on the tool engagement portion 8 as in this embodiment, the pressure detection sensor 515 can be mounted easily because the tool engagement portion 8 has a flat portion. Besides, the pressure detection sensor placement position 80, which is formed by reducing the thickness of the base material of the main metal fitting 1 so to be thinner than the other portion of the tool engagement portion 8, is formed on a part of the tool engagement portion 8 in this embodiment, and the pressure detection sensor 515 is disposed there. Thus, a deformation amount of the pressure detection sensor placement position 80 due to the combustion pressure can be increased, and the combustion pressure can be detected with higher sensitivity.

Figure 41:
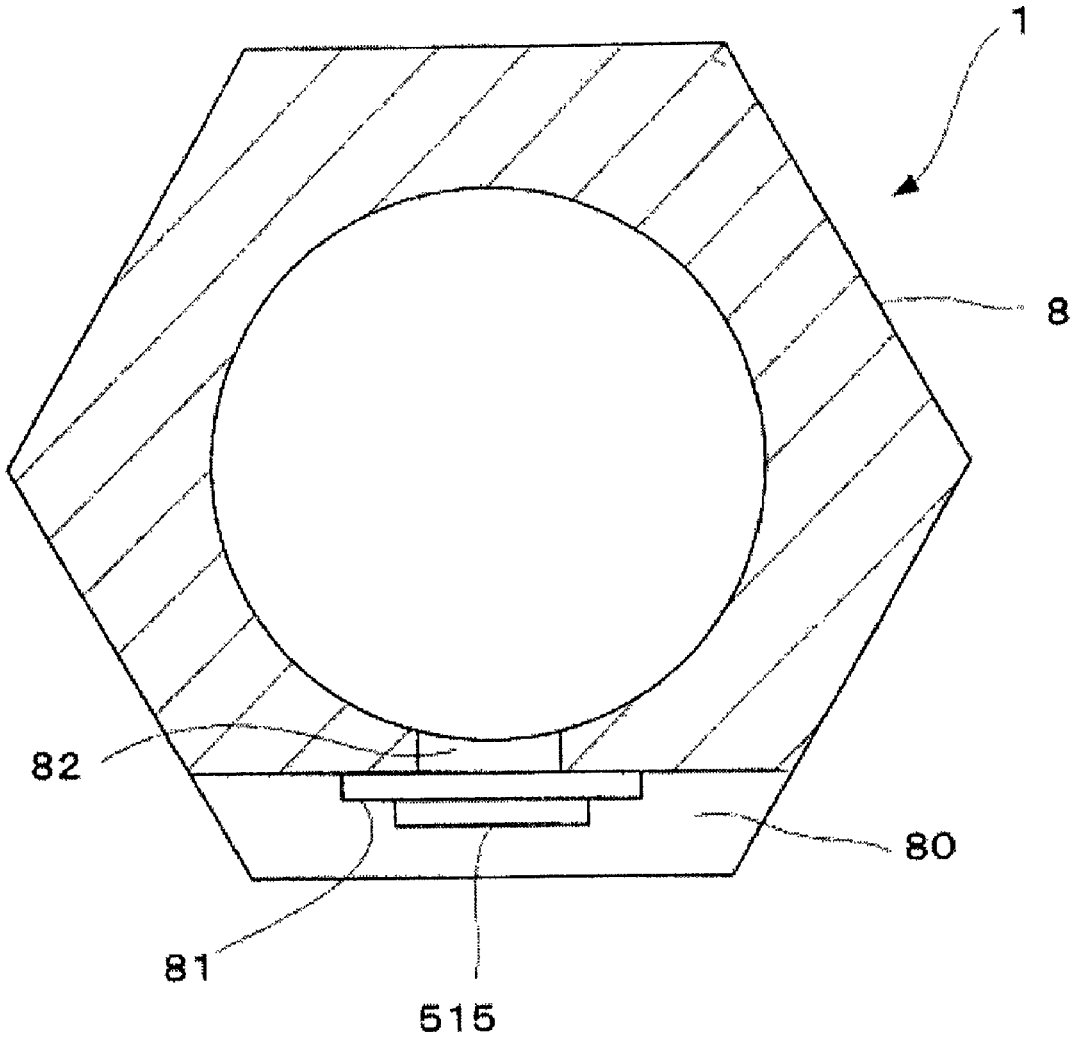
FIG. 41 is a diagram showing in a magnified fashion the structure of a main portion of a modified example.

If it is difficult to fix the pressure detection sensor 515 directly to the main metal fitting 1 by means of a heat-resistant adhesive, a glass adhesive, brazing or the like because of a difference in thermal expansion coefficient or the like between the main metal fitting 1 and the pressure detection sensor 515, for example, a plate-like member 81, which serves as a thermal expansion coefficient buffer material, may be disposed between the main metal fitting 1 and the pressure detection sensor 515 as shown in FIG. 41. In the above structure, the combustion pressure may be applied directly to the plate-like member 81 by welding directly the plate-like member 81 and the main metal fitting 1 by laser welding or the like and forming an opening 82 in a part of the main metal fitting 1 which is located on the lower side of the plate-like member 81. Thus, a decrease in sensitivity due to the disposition of the plate-like member 81 can be suppressed.

In this embodiment, when the combustion pressure is applied, the main metal fitting 1 is deformed to swell in the radial direction, and the measuring direction of the deformation amount of the main metal fitting 1 of the pressure detection sensor 515 becomes a radial direction perpendicular to the axial direction. Thus, there is no influence of the deformation in the axial direction, for example, due to the axial force at the time of mounting the spark plug on the internal combustion engine, so that initial variation due to mounting can be decreased. Besides, a vibrational component (noise component) when the internal combustion engine is operated is mainly in the axial direction, so that a pressure sensor, which is resistant to noise, can be obtained by measuring in a direction perpendicular to the axial direction.

Figure 42:
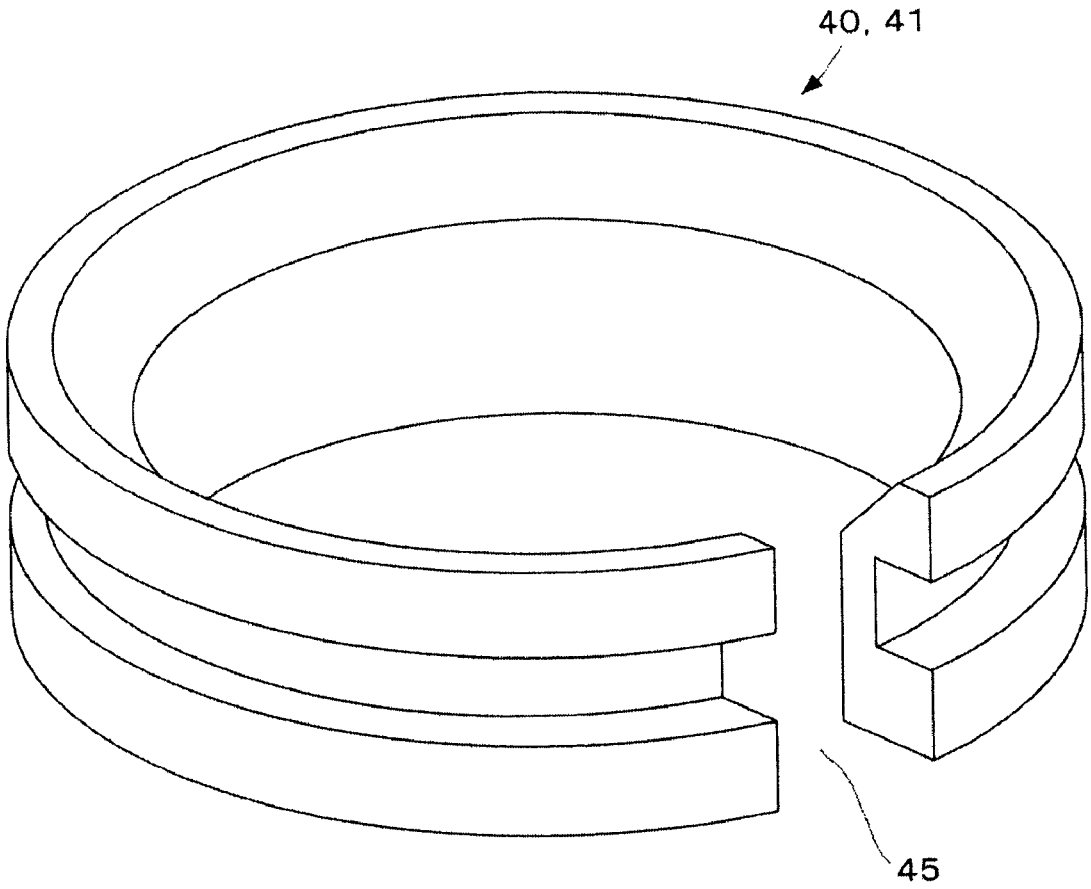
FIG. 42 is a diagram showing in a magnified fashion the structure of the main portion of the spark plug of FIG. 38.

As shown in FIG. 38, annular heat release members 40, 41 are disposed between the insulator 2 and the main metal fitting 1 (in contact with the outer circumferential surface of the insulator 2 and the inner circumferential surface of the main metal fitting 1). The heat release members 40, 41 are made of a metal similar to that of, for example, the main metal fitting 1, to form a heat release path between the insulator 2 and the main metal fitting 1. The heat release members 40, 41 are disposed within the main metal fitting 1 on the tip end side in the axial direction with respect to the placement position of the pressure detection sensor 515. Therefore, the heat release members 40, 41 are provided with a communicating portion 45, which communicates the tip end side with the rear end side in the axial direction so that propagation of the combustion pressure of the combustion gas within the main metal fitting 1 is not disturbed as shown in FIG. 42. Thus, the disturbance of the propagation of the combustion pressure by the heat release members 40, 41 can be prevented while maintaining the heat radiation, and the combustion pressure can be measured with high sensitivity and precision by the pressure detection sensor 515. The shape of the communicating portion 45 is not limited to the one shown in FIG. 42 but may be any type as far as it allows communications between the tip end side and the rear end side in the axial direction of the heat release members 40, 41.

A test was performed to compare the output of the pressure detection sensor 515 with the output of a standard pressure gauge (Kistler Company) mounted on an internal combustion engine by mounting the spark plug 190 of the above embodiment on the same internal combustion engine and measuring the output the pressure detection sensor 515. It was found that both output waveforms were well matched with relatively good precision. And, it was also confirmed that the noise level of the output of the pressure detection sensor 515 was low, and the combustion pressure could be detected at a high S/N ratio with high precision.

Then, the results obtained by simulating the influence of the metal fitting-side fitting portion 9 upon the insulator 2 are as follows. First, physical property values of individual members such as the main metal fitting 1, the insulator 2, the connecting terminal 4 and the glass seal 31 were set as follows.

Main metal fitting: Outer diameter of 9.0 mm, press fitting length of 3.0 mm and Young's modulus of 185 GPa Insulator: Outer diameter of 8.0 mm, inner diameter of 3.0 mm and Young's modulus of 300 GPa Connecting terminal: Part housed within the insulator has outer diameter of 2.2 mm and Young's modulus of 200 GPa Glass seal: 70 GPa The main metal fitting 1 determined as described above was press-fitted into the insulator 2 with a press-fitting allowance of 50 μm, and a stress applied to the insulator 2 by the metal fitting-side fitting portion 9 was simulated under the three following conditions: (1) the insulator 2 only, (2) the inner opening of the insulator 2 was filled with the glass seal, and (3) the connecting terminal 4 was inserted into the axis line position where the metal fitting-side fitting portion 9 was positioned, and the gap was filled with the glass seal. The results are shown in FIGS. 43, 44 and 45.

Figure 43:
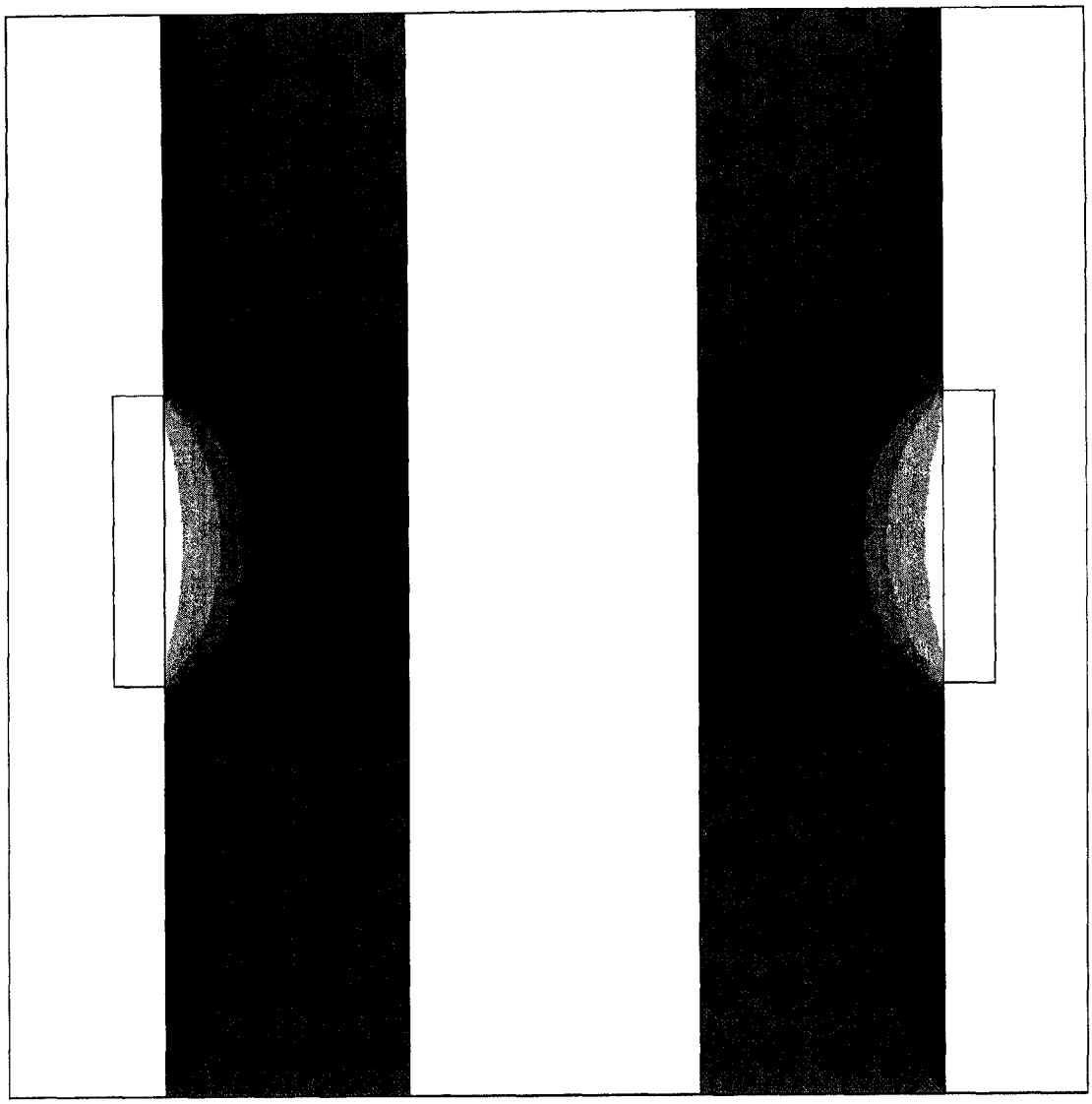
FIG. 43 is a diagram showing a result of simulation conducted about an influence of a metal fitting-side fitting portion on an insulator.
Figure 44:
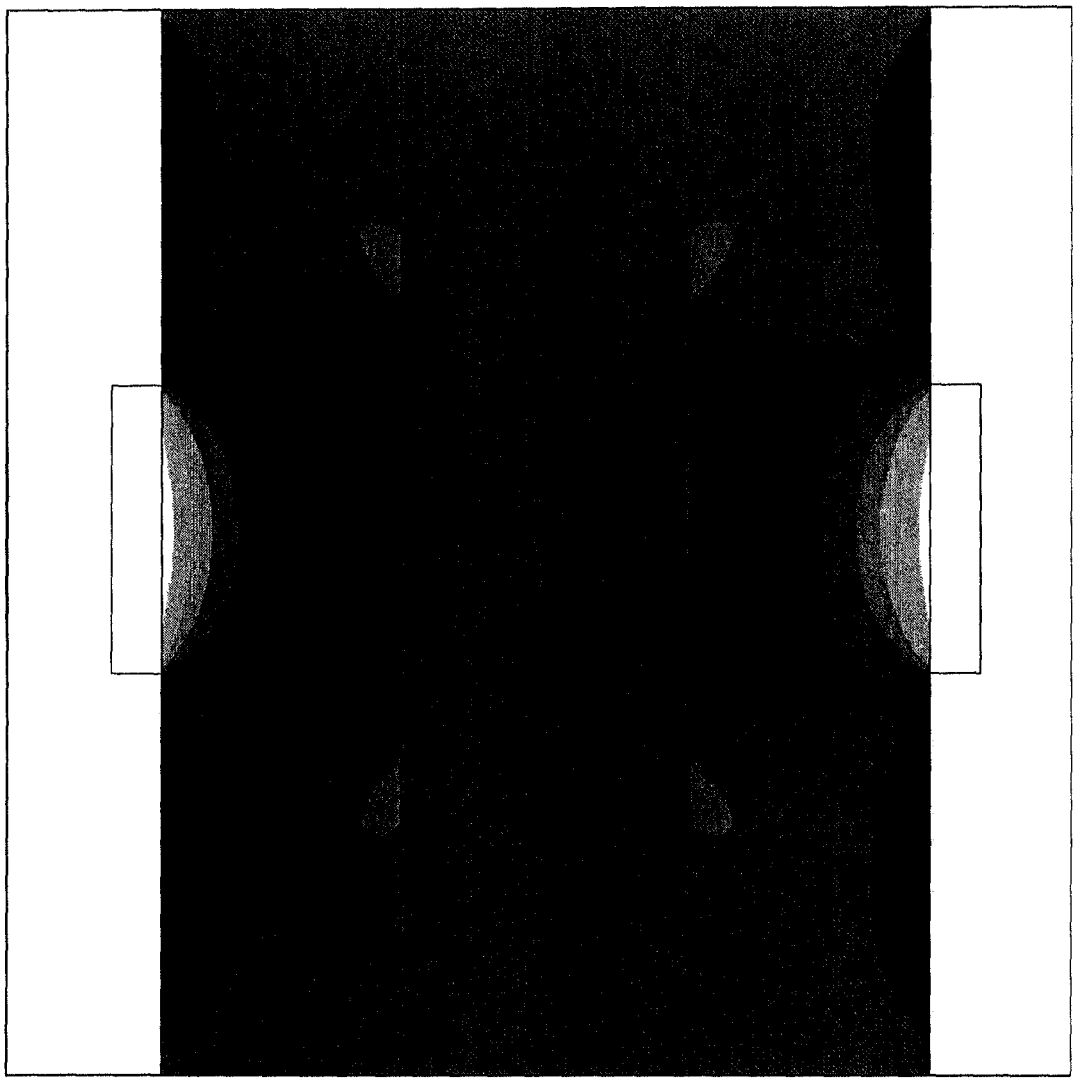
FIG. 44 is a diagram showing a result of simulation conducted about an influence of the metal fitting-side fitting portion on the insulator.
Figure 45:
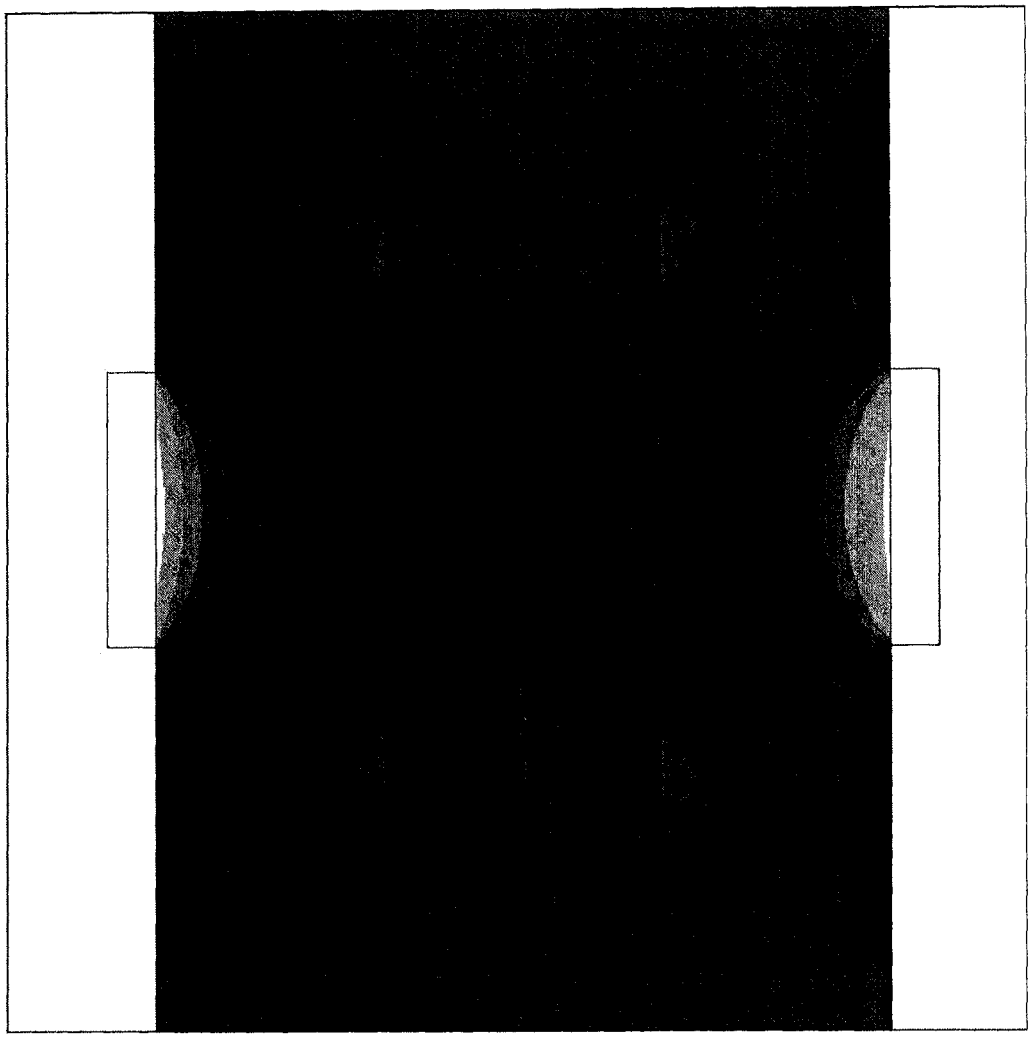
FIG. 45 is a diagram showing a result of simulation conducted about an influence of the metal fitting-side fitting portion on the insulator.
Figure 46:
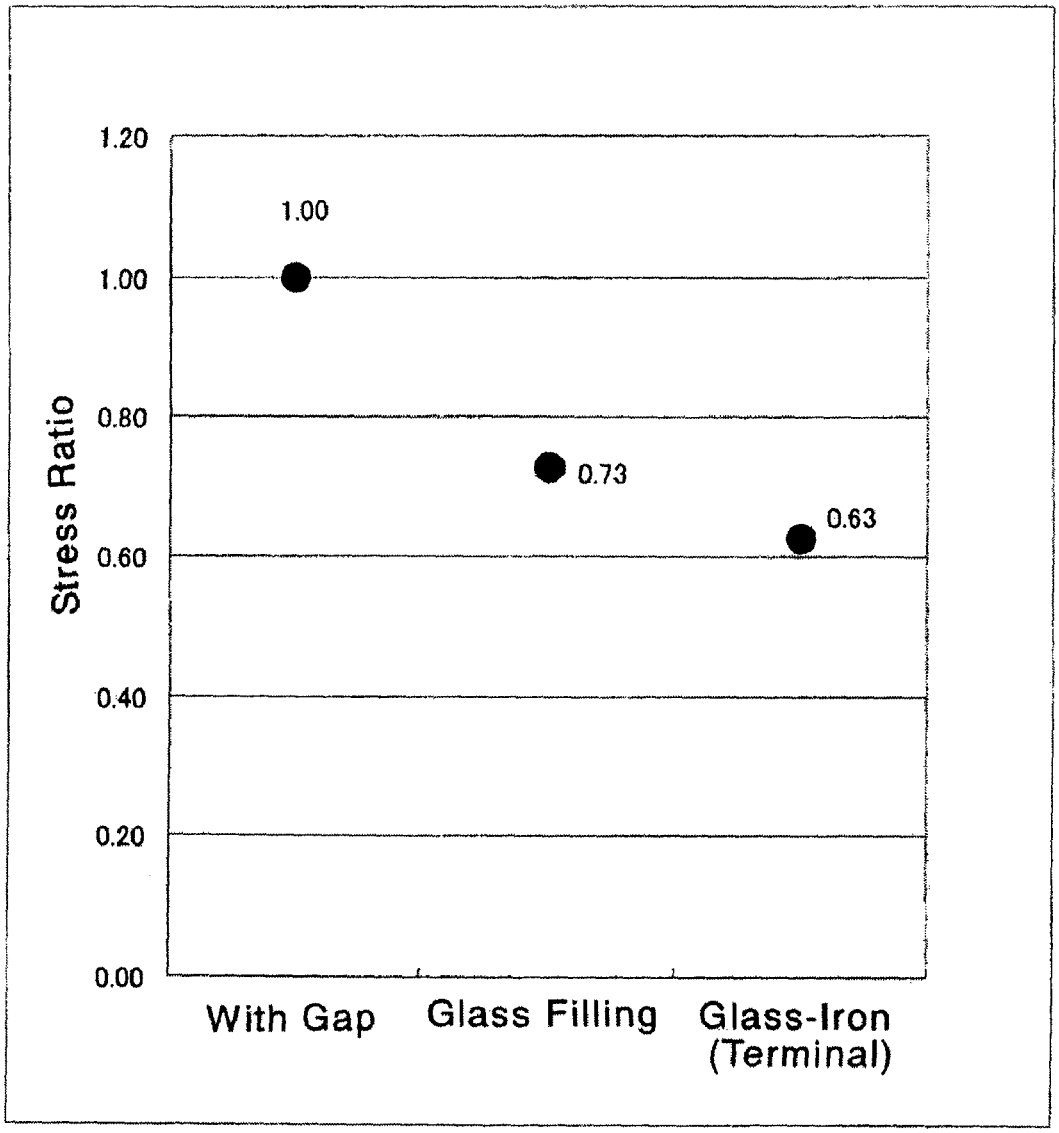
FIG. 46 is a diagram showing a ratio of the types of FIG. 44 and FIG. 45 on the basis of the type of FIG. 43.
Figure 47:
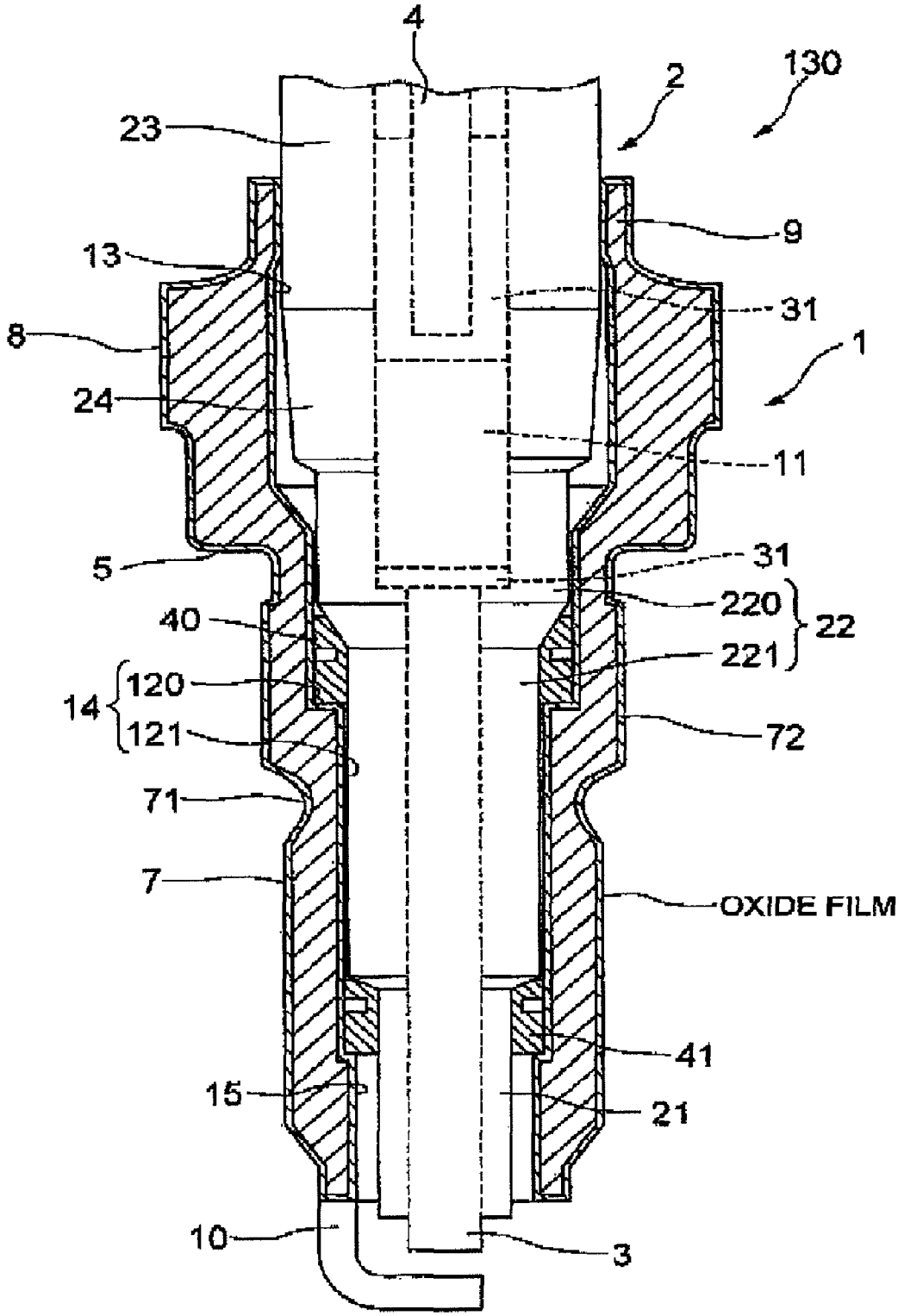
FIG. 47 is a non-limiting illustration of an oxide film formed on the main metal fitting of the spark plug shown in FIG. 13.

In FIG. 43, the inner opening of the insulator 2 is vacant, so that the insulator 2 might be broken by a stress applied by the main metal fitting 1, while a large stress seen in FIG. 43 is not observed in FIG. 44 where the inner opening is filled with the glass seal and FIG. 45 where the connecting terminal 4 is inserted. FIG. 46 shows that the types of FIG. 44 and FIG. 45 are indicated at ratios with reference to the type of FIG. 43.

Thus, it is desirable that the portion of the metal fitting-side fitting portion 9, in which the insulator 2 is press-fitted and held, is a position with the connecting terminal 4 inserted into the insulator 2. And, the connecting terminal 4 at this position has desirably a smooth outer shape, so that parts on which a stress is concentrated are few, and it is preferable that the outer surface of the connecting terminal at such parts is free from formation of irregularities such as a thread, knurl or the like.

Although the invention has been described above by reference to the embodiments of the invention, the invention is not limited to the embodiments described above. It is to be understood that modifications and variations of the embodiments can be made without departing from the spirit and scope of the invention. For example, in addition to the L-shaped ground electrode 10 described in the present embodiments, a combination of plural ground electrodes, and also one of so-called creeping discharge types, namely a type that the tip end portion of the main metal fitting also serves as the spark discharge electrode may be used.

INDUSTRIAL APPLICABILITY

The spark plug of the invention can be used in the field of automobile industry and the like. Therefore, it has industrial applicability.

What is claimed is:

1. A spark plug, comprising: a center electrode extending in an axial direction; a cylindrical insulator which holds the center electrode; and a cylindrical main metal fitting which has a ground electrode at a tip end portion and a tool engagement portion for mounting on an engine, wherein the main metal fitting has a metal fitting-side fitting portion provided at a part of a rear side of the main metal fitting from the tool engagement portion and holds the cylindrical insulator via a press fit connection in a radial direction by the metal fitting-side fitting portion, wherein the cylindrical insulator contacts the metal fitting side portion at a portion at a ceramic sintered body of the cylindrical insulator where a diameter of the cylindrical insulator is the largest.

2. The spark plug according to claim 1, wherein a connecting terminal extends through a through hole of the insulator, and the cylindrical insulator is press fitted via the press fit connection with the metal fitting-side fitting portion at an axial position of the cylindrical insulator where a glass seal is disposed between the insulator and the connecting terminal.

3. The spark plug according to claim 1, wherein the cylindrical insulator is held at a contact area by the metal fitting-side fitting portion, and wherein the insulator also includes an introductory part adjacent a tip end side of the contact area that has a diameter smaller than that of the cylindrical insulator at the contact area.

4. The spark plug according to claim 3, wherein the introductory part for press-fitting is tapered, and the taper has a taper angle of 1 to 5° with respect to the axial direction.

5. The spark plug according to claim 3, wherein the metal fitting has a contact portion, which is in contact with the cylindrical insulator press-fitted into the rear end side, and a pull-out portion, which is not in contact with the cylindrical insulator in a press-fitted state, on the tip end side of the metal fitting-side fitting portion from the contact portion.

6. The spark plug according to claim 1, wherein the main metal fitting is formed of a material having Fe or Ni as a main component and a Cr content of 11.5 to 26 mass %, and an oxide film having a thickness of 5 nm or more is formed on at least a part of the surface.

7. The spark plug according to claim 1, wherein an oxide film is formed within the main metal fitting and on a portion on the tip end side adjacent to the metal fitting-side fitting portion.

8. The spark plug according to claim 1, wherein a thickness T of the metal fitting-side fitting portion and a thickness t between the metal fitting-side fitting portion and the tool engagement portion satisfy a relationship of $t<T$.

9. The spark plug according to claim 1, wherein the main metal fitting is provided with a metal fitting middle body portion disposed on a tip end side of the main metal fitting from the tool engagement portion, the metal fitting middle body portion having a bearing surface for keeping airtightness by directly contacting an engine when mounted on the engine, wherein the bearing surface has an inclined form wherein an outer circumference side of the bearing surface is positioned on the tip end side of the inner circumference side of the bearing surface.

10. The spark plug according to claim 9, wherein an included angle, which is formed by a line segment connecting an inner circumference-side base point of the bearing surface and an outer circumference-side base point of the bearing surface and a linear line perpendicular to the axial direction, is 10 to 15°.

11. The spark plug according to claim 9, wherein the threaded portion has an outer diameter of 8 mm or less, the metal fitting middle body portion has an outer diameter which is larger than the threaded portion, and the tool engagement portion has a minimum outer diameter which is 11 mm or less and larger than the outer diameter of the metal fitting middle body portion.

12. The spark plug according to claim 1, wherein the cylindrical insulator is held by the metal fitting-side fitting portion by press-fitting, and at least the metal fitting-side fitting portion of the main metal fitting has a Vickers hardness in a range of 180 to 500.

13. The spark plug according to claim 1, wherein the metal fitting-side fitting portion of the main metal fitting has a minimum thickness of 0.25 mm or more.

14. The spark plug according to claim 1, wherein the cylindrical insulator at a fitting part with the metal fitting-side fitting portion of the main metal fitting has a thickness of 1 mm or more.

15. The spark plug according to claim 1, wherein it is assumed that the outer diameter of the cylindrical insulator pulled out from the metal fitting-side fitting portion of the main metal fitting is d1, and the inner diameter of the metal fitting-side fitting portion is d2, then a value of d1-d2 is in a range of 6 to 200 μm.

16. The spark plug according to claim 1, wherein it is assumed that the outer diameter of the cylindrical insulator before it is press-fitted into the metal fitting-side fitting portion of the main metal fitting is D1, and the inner diameter of the metal fitting-side fitting portion is D2, then a value of D1-D2 is in a range of 6 to 300 μm.

17. The spark plug according to claim 1, further comprising a heat conductive member disposed between the main metal fitting and the cylindrical insulator, wherein the heat conductive member provides at least two heat release paths for release of heat from the cylindrical insulator to the main metal fitting and the heat conductive member is disposed between a tip end of the main metal fitting and a bearing surface of the main metal fitting which forms an airtight sealing surface with an engine when the spark plug is mounted on the engine, and the at least two heat release paths are separated from each other in the axial direction on a longitudinal cross section of the cylindrical insulator.

18. The spark plug according to claim 17, wherein the heat conductive member comprises a ring shaped member interposed between the main metal fitting and the cylindrical insulator, and the ring shaped member is elastically in contact with the inner surface of the main metal fitting and the outer surface of the cylindrical insulator.

19. The spark plug according to claim 18, wherein the ring shaped member is configured to be deformed in the radial direction by a fitting axial force when the cylindrical insulator is fitted into the main metal fitting.

20. The spark plug according to claim 18, wherein a metal fitting-side step portion is formed to be projected from the inner circumference surface of the main metal fitting, an insulator-side step portion is formed to be projected from the outer circumference surface of the cylindrical insulator, and the ring shaped member is disposed in a state pushed by the metal fitting-side step portion and the insulator-side step portion.

21. The spark plug according to claim 1, wherein a gas release portion is disposed in the cylindrical insulator in the axial direction at a part of the outer circumference of the cylindrical insulator in the form of a recess, the gas release portion configured such that when the cylindrical insulator is moved in a direction to come out of the metal fitting-side fitting portion, the gas release portion is exposed to an outside of the main metal fitting to communicate an inside of the main metal fitting with the outside.

22. The spark plug according to claim 21, wherein the gas release portion is formed to have a curved boundary between the gas release portion and the circumference of the gas release portion.

23. The spark plug according to claim 1, wherein an annular inwardly projected portion is formed on a rear end side of the main metal fitting from the metal fitting-side fitting portion to project inward in the radial direction via a thin wall portion, wherein the thin wall portion is thinner than the metal fitting-side fitting portion, and wherein an insulator rear end-facing end surface having a diameter larger than a bore diameter of the inwardly projected portion is formed on a tip end side in the axial direction of the inwardly projected portion to configure a pull-out preventive mechanism.

24. The spark plug according to claim 23, wherein the pull-out preventive mechanism is configured by caulking inward in the radial direction the rear end portion of the main metal fitting, the pull-out preventive mechanism has an obtuse angle θ2 formed by a tip end-facing end surface of the inwardly projected portion with respect to the axial direction, the obtuse angle θ2 is larger than an obtuse angle θ1 formed by the insulator rear end-facing end surface with respect to the axial direction such that the inside diameter of the inwardly projected portion increased backward.

25. The spark plug according to claim 23, wherein a groove is formed along the entire circumference in the axial position where the thin wall portion is located on the outer circumferential surface of the main metal fitting.

26. The spark plug according to claim 1, wherein a pressure detection sensor is disposed on the main metal fitting on the tip end side from the metal fitting-side fitting portion, and is configured to measure a deformation amount of the main metal fitting generated depending on a combustion pressure of the internal combustion engine and detects the combustion pressure according to the deformation amount.

27. The spark plug according to claim 26, wherein the main metal fitting is provided with a mounting bearing surface which contacts an internal combustion engine when it is mounted on the internal combustion engine, and the pressure detection sensor is disposed on a rear end side with respect to the mounting bearing surface.

28. The spark plug according to claim 26, wherein the tool engagement portion is provided with a pressure detection sensor placement position which has a thickness in the radial direction that is smaller than another part of the tool engagement portion, and the pressure detection sensor is disposed on at least a part of the pressure detection sensor placement position.

29. The spark plug according to claim 26, wherein the main metal fitting on the tip end side with respect to the disposed position of the pressure detection sensor has therein a heat release part which is in contact with the inner circumferential surface of the main metal fitting and the outer circumferential surface of the cylindrical insulator, and the heat release part has a communicating portion for communications between the tip end side and the rear end side in the axial direction.

* * * * *